US005453174A

United States Patent [19]

Van Anglen et al.

[11] Patent Number: 5,453,174

[45] Date of Patent: Sep. 26, 1995

[54] METHOD AND APPARATUS FOR DEPOSITING HARD CHROME COATINGS BY BRUSH PLATING

[75] Inventors: Erik S. Van Anglen, Quakertown; Harold M. Keeney, Whitehall, both of Pa.

[73] Assignee: Electroplating Technologies Ltd., Northampton, Pa.

[21] Appl. No.: 179,579

[22] Filed: Jan. 10, 1994

Related U.S. Application Data

[63] Continuation-in-part of Ser. No. 915,455, Jul. 16, 1992, Pat. No. 5,277,785.

[51] Int. Cl.[6] ..... C25D 5/06; C25D 17/14

[52] U.S. Cl. ..... 205/117; 205/118; 204/217; 204/271; 204/275; 204/212; 204/224 R; 204/237; 204/293; 204/292; 204/227

[58] Field of Search ..... 204/224 R, 225, 204/271, 275, 217, 292–293, 237, 212, 227; 205/117, 118

[56] References Cited

U.S. PATENT DOCUMENTS

| | | | |
|---|---|---|---|
| 3,751,343 | 8/1973 | Machula et al. | 204/225 R X |
| 4,235,691 | 11/1980 | Loqvist | 204/212 |
| 4,452,684 | 6/1984 | Palnik | 204/224 R X |
| 4,610,772 | 9/1986 | Palnik | 204/224 R X |
| 4,713,149 | 12/1987 | Hoshino | 204/217 |
| 4,738,756 | 4/1988 | Mseitif | 205/117 X |
| 4,879,015 | 11/1989 | Adamek et al. | 205/118 X |
| 5,277,785 | 1/1994 | Van Anglen | 205/117 |

*Primary Examiner*—Donald R. Valentine
*Attorney, Agent, or Firm*—Charles A. Wilkinson

[57] ABSTRACT

Thick layers of hard dense chromium coatings are formed on metal substrates by an electrolytic brush plating operation in which a lead-tin anode is closely positioned to a cathodic workpiece in full anode wrap relationship and the surface of the cathodic workpiece is wiped by an open construction wiper to remove hydrogen bubbles and/or outwardly extending dendritic coating material with minimum contact with and force upon the coating surface. The open wiper construction allows free access to the coated surface at all times of fresh undepleted coating electrolyte and allows hydrogen bubbles and dendritic material to be discharged unimpeded from the wiper structure.

26 Claims, 13 Drawing Sheets

Fig. 16
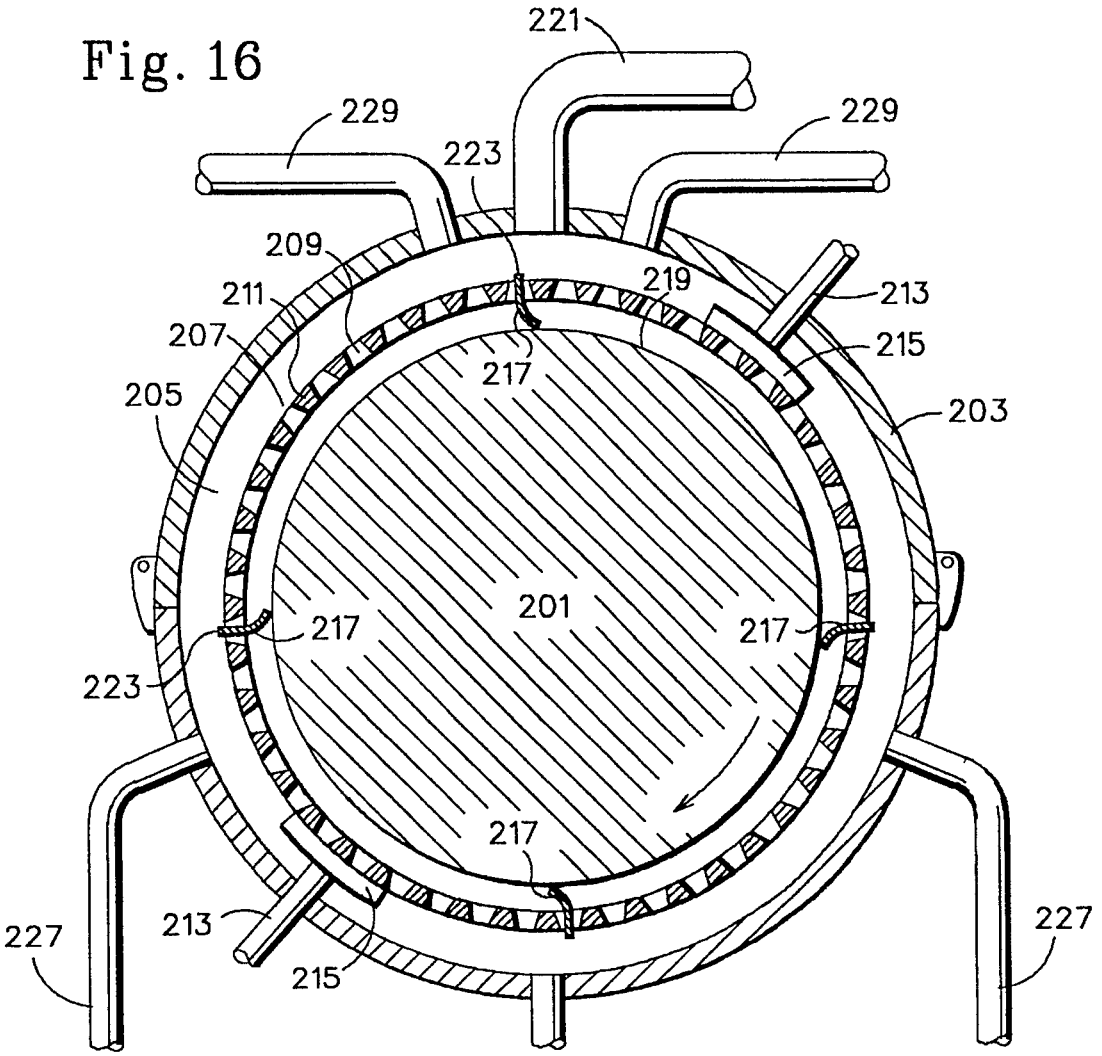
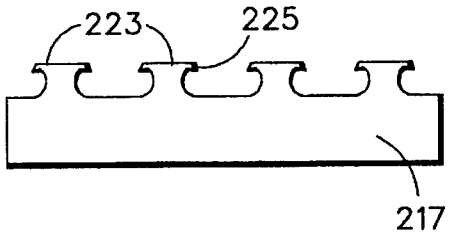
Fig. 16A

Fig. 19
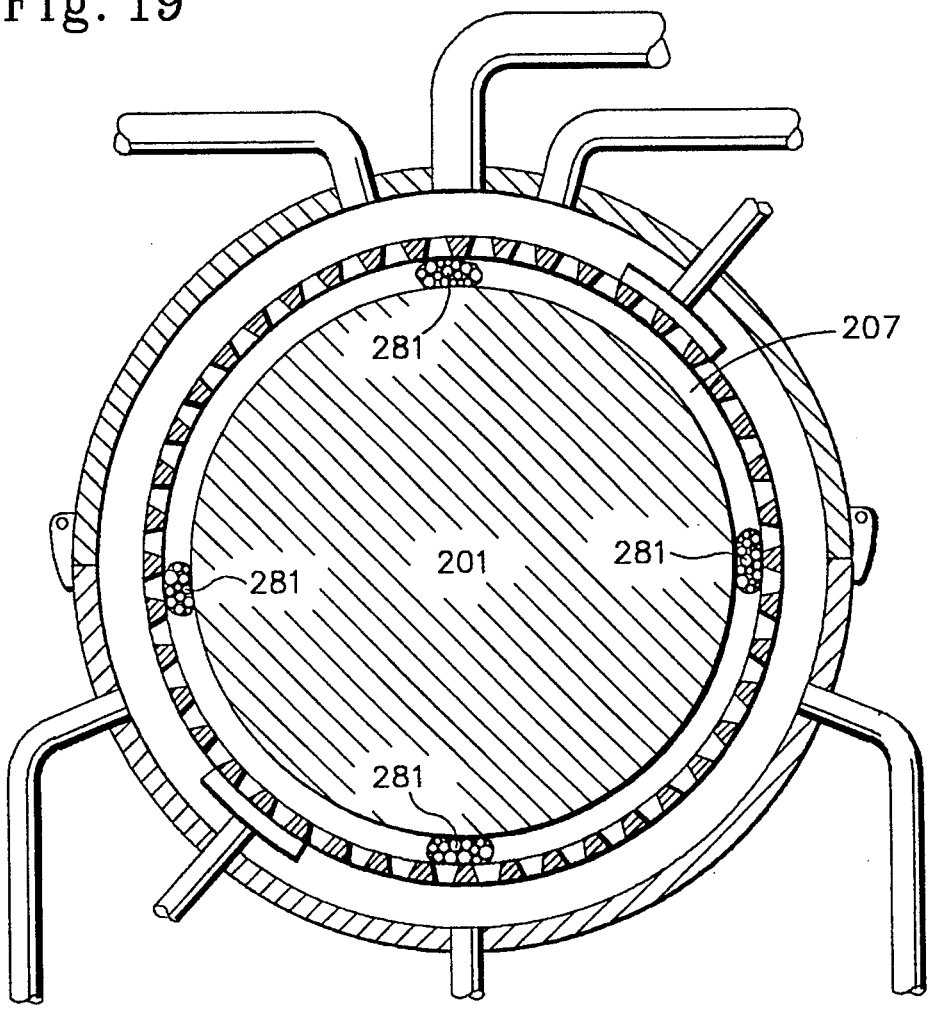
Fig. 19A
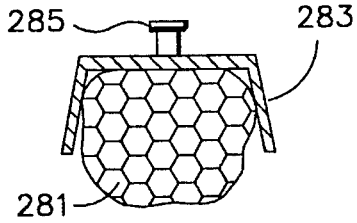
Fig. 19B
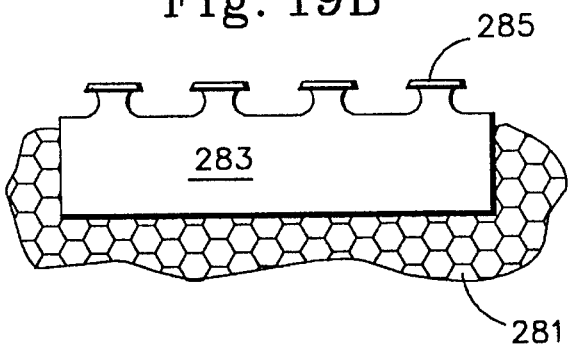
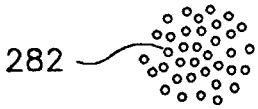
Fig. 19C
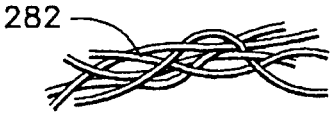
Fig. 19D

METHOD AND APPARATUS FOR DEPOSITING HARD CHROME COATINGS BY BRUSH PLATING

RELATED APPLICATIONS

This application is a continuation-in-part of U.S. application Ser. No. 07/915,455 filed Jul. 16, 1992, now U.S. Pat. No. 5,277,785 by one of the present inventors and from which priority is claimed and is related to a simultaneously filed application disclosing and claiming related apparatus and processes invented by the present inventors and a co-inventor.

BACKGROUND OF THE INVENTION (1) Field of the Invention

This invention relates to the deposition of hard chrome coatings from plating solutions. More particularly, this invention relates to the deposition of hard chrome coatings by means of brush plating and related tank-type selective plating.

(2) Prior Art

A number of coatings are deposited from so-called plating baths in which a coating solution is subjected to an imposed electrical potential. Such imposed electrical potential basically enhances an already naturally occurring tendency for any metal ions in solution to deposit, or plate out, upon any metal object or surface immersed within or partially within the solution. Such metal surfaces are, under favorable conditions, able to supply electrons to metallic ions dissolved in the solution, converting such ions to less soluble metallic atoms which are deposited upon the electron donor material. This natural deposition, or plating out, of the coating material from a natural solution may be rather slow or in many cases even more than counterbalanced by simultaneously proceeding resolution processes. However, the natural deposition or plating rate can be improved dramatically by application of an external electrical potential to a plating bath, in effect causing a current to flow through the bath, such current serving to rapidly convert dissolved metal ions to metal atoms which deposit or plate out as a coating on the cathode from which electrons are derived. Such externally applied current also more quickly forms metallic ions at the anode when appropriate, which ions dissolve within the solution of the coating bath to take the place of those deposited or plated out upon the cathode or other adjacent materials. So-called "electrolytic coating" using electrolytic coating baths is very widely used, both on a small scale and very large scale, for production-type coating facilities.

While conventional coating baths are effective and efficient means for the coating of metal bases such as iron and steel and the like, the large tanks of solution necessary to effect a normal coating from an electrolytic coating bath make the process practical only for fairly large permanent installations. There is frequently a necessity, however, to conduct plating operations in emergency or job shop-type situations, on relatively small pieces or sections or single items or objects of metal, or upon items in the form frequently of single broken or worn metal apparatus which needs to be refurbished by replating or the like. Emergency repairs, for example, may be conducted on shipboard or other places where the provision of a full-scale or even a relatively small scale plating bath is either impossible or at best impractical.

So-called brush plating is an alternative to tank plating, and in some cases, a preferred method of plating. This process, which is generally known as brush plating in the trade at large, is also known by a number of other names, and particularly by plating experts as "selective plating", not to be confused with "selective plating" accomplished in a tank, frequently on copper-based alloy contacts and usually also with gold plating. Selective plating in a plating tank environment is usually accomplished by thoroughly masking all parts not to be plated. Selective or brush plating is generally a more convenient, although to some extent more difficult, process to effectively use than tank plating. There have been a number of recent additional names suggested for brush plating. Among such names are "stylus plating", "contact plating", electrochemical metalizing", as well as "selective electrochemical metal deposition", sometimes known by the acronym "SEMD". The common name among plating experts, however, as pointed out above, is "selective plating". The term brush plating, used commonly in plating shops, is descriptive, since the basic principal of the technique is to continuously agitate or abrade the surface being plated to remove bubbles of hydrogen which bubbles may otherwise collect upon the surface and interfere with the efficiency of the plating. The term brush plating will consequently be used in this description.

Brush plating has a number of advantages over tank plating, of which the following may be particularly mentioned: (a) first and most important, is the ability of brush plating to deposit an electroplated metal precisely onto the portion of the surface of a base metal where it is desired in almost any thickness which is desired. In fact, this is the origination of the name "selective plating"; (b) secondly, in some cases brush plating or selective plating can provide superior coating at a cheaper price;. (c) thirdly, brush plating or selective plating can be used in environments where normal vat or tank plating will not be available, for example, at the location where a repair must actually be made, for example, on shipboard and in other locations where a substantial vat of coating solution would not be available.

Brush plating, or selective plating, has become particularly popular for repairing previously coated surfaces where only a portion of such surface has been seriously worn or is otherwise damaged such as, for example, on rotatable shafts and the like where continuous movement of the shafts may have worn through a previous coating in a particular portion or otherwise seriously eroded the surface. For the same reason, brush plating, or selective plating, can often be used to fill in a discontinuity which has developed in the surface of another metal piece even where such original piece was not coated. Again, therefore, brush plating or selective plating is particularly valuable in repairing or refurbishing worn materials such as shafts and the like which are subject to severe localized wear due often to breakdown in their normal lubrication or to an unequal or unbalanced operation or the like.

Brush plating, or selective plating, can be accomplished either by sophisticated apparatus made especially for such plating or can be a hand operation using only very basic apparatus, the movement of the "brush" portion of which is accomplished manually. Basically, in the usual process, a graphite or sometimes platinum anode, which may be either mechanically supported and actuated or hand held and which is designed to conform to the shape of the workpiece which is to be repaired or coated, is held or supported close to the surface of such workpiece while a current is passed through a plating solution continuously between the anode and the surface to be repaired or otherwise treated. The anode is maintained positive and the workpiece is given a negative charge via a suitable negative contact which converts the workpiece into the cathode. When the anode and workpiece are brought close together with appropriate plating solution between the two and with current passing from the cathode to the anode via the metallic ions of the bath, metal ions from the plating solution are deposited upon the workpiece opposite the anode, or those portions of the anode which most closely approach the surface of the workpiece. This enables the size and shape of the anode to determine the size and shape of the area to be coated. The anode must never touch the surface of the workpiece else all the electric charge would arc between the anode and cathodic workpiece melting any coating already plated out and usually damaging not only the workpiece itself, but also quite likely the anode as well.

Since it is difficult to merely pass or flow plating solution between an anode and a workpiece without the area in question being surrounded by a container of some sort, the anode is usually provided with an absorbent material upon its surface which will temporarily retain the plating solution. The absorbent material is held close to the surface of the workpiece to maintain the workpiece continuously subject to or bathed within the plating solution absorbed in or saturating such absorbent material.

The absorbent material should be formed from a dielectric material to prevent arcing between the anode and cathode. Some form of special abrasive or rubbing material is also frequently affixed to the face of the anode or to the absorbent material to rub on the surface of the workpiece in the area to be plated as the anode passes over it. Such abrading or rubbing serves to displace the bubbles that normally form on the surface of the workpiece in any plating operation, which bubbles may partially shield the workpiece surface from the plating solution, thus interfering with the plating operation. Rapid removal of such bubbles, usually comprising hydrogen, enables a more rapid, uniform and effective plating to be accomplished. If a special rubbing or brushing material is not used, the surface to be plated is rubbed with the surface of the absorbent material which serves to remove the hydrogen bubbles formed upon the surface as plating proceeds.

In order to continuously abrade or brush the surface of the workpiece during the coating operation, either the graphite anode or the cathodic workpiece is maintained in substantially constant motion. Where a round section such as a shaft is being coated, it is usually most convenient to rotate such shaft with respect to the anode, while for other shaped pieces and particularly the usual flat work surface, it is usually found more convenient to move the anode continuously during the brush plating process. The brush-plating process is frequently used to restore both the outside diameter and the inside diameter of cylindrical objects as well as the configuration of plane surfaces of many parts such as, for example, shafts, bearings, hollow members, journals and other workpieces, to an original dimension or to provide specific surface conditions, usually wear-resistant surfaces. The brush coating process is also often used for the filling of corrosion pits and the like in metal surfaces and in providing hard facing and the like upon metal surfaces.

In general, brush plating, or selective plating, coatings are usually more dense and fine grained as well as less porous than similar coatings applied by other types of electroplating processes. It has been said that brush plated coatings are, in general, seventy-five percent less porous than deposits formed by tank plating and ninety-five percent less porous than deposits applied by metal powder or wire spray-type coating processes. Because of such additional denseness, the deposits frequently offer greater corrosion resistance as well as hardness. The final results, however, depend largely upon the metals used as coating materials and the coating process.

Brush or selective plating usually provides, as indicated briefly above, much harder as well as denser deposits than those obtained by other types of electroplating so that brush-plated workpieces are usually more abrasion resistant and less susceptible to fatigue loss during use.

Superior adhesion of the coating material is often also attained by a properly operated brush or selective plating process. This is believed to result, however, more from the fact that an organic plating solution is usually used in a brush-plating operation, whereas an inorganic solution is frequently used in tank plating and other general electroplating operations. Organic plating solutions generally have a higher conductivity than inorganic solutions and therefore the workpiece is customarily subjected to a far greater current density, often in the range of 1000 to 3000 amps per square foot rather than the 100 to 500 amps per square foot which is more customary in tank plating arrangements. Such high current density is almost equivalent to an arc welding process and the metal ions therefore seem to be driven more forcefully into microscopic valleys and cracks upon the surface structure of the base metal, locking them more effectively into place. In conventional tank plating, on the other hand, the plated coating often seems to merely plate over valleys, cracks and other inequities in the surface of the workpiece. The close spacing between the anode and the cathodic workpiece and the fact that the charge on the anode is not dissipated by dissolution or dissolving of anode material into the plating bath to replenish the metal ion content of the bath also probably has considerable to do with the more intimate coating produced.

Many metals can be successfully brush plated, including cadmium, cobalt, copper (both from acidic and alkaline solutions), gold, nickel (both from acidic and neutral plating solutions), rhodium, silver and tin. One notable and well-known failure of brush plating, however, has been the inability to provide a hard chrome deposit by brush plating even though brush plated deposits are usually more dense than equivalent tank plated coatings. While extremely thin hard chrome coatings have been sometimes attainable and generally thin, relatively soft deposits of chrome could be attained heretofore using brush plating techniques, thicker hard chrome deposits were completely unattainable. As may be imagined, this lack of ability to form hard chrome coatings has been a serious drawback, since hard chrome deposits are, in general, superior to any other electroplated surface for wear resistance, low coefficient of friction, hardness, heat resistance and non-galling characteristics. In view of this, sometimes nickel has been plated in place of chrome and a nickel tungsten or nickel cobalt alloy has also sometimes been used in place of a hard chrome plating to take advantage of the preciseness, affordability and other conveniences of the brush-plating process.

A number of efforts have been made to successfully deposit hard chrome coatings or thicker hard chrome coating using the brush-plating process. However, until the present invention, no successful process or apparatus for plating with hard chrome has, so far as the present inventor is aware, been developed. Furthermore, no adequate theory to explain the inability to provide hard chrome coatings by brush plating has been advanced. While very thin hard chrome coatings have been made, it has been impossible to provide useful thicker hard coatings. There has been a need, therefore, for a brush-plating process which can successfully provide a hard chrome surface coating of reasonable thickness. Some of the more pertinent prior art patents related to the problem of brush plating of hard chrome coated surfaces or having disclosures showing the state of the art or otherwise of interest in this regard are as follows.

U.S. Pat. No. 2,473,290 issued Jun. 14, 1949 to G. E. Millard discloses an electroplating apparatus for plating crankshafts and the like with chromium in which a curved anode partially surrounds the portion of the workpiece to be coated. The curved anode has orifices in its surfaces to allow the escape of bubbles formed during the coating process and also has extending through its surface, a support for a so-called positioning block or scraper block 54 which is provided to maintain a close spacing between the anode and cathodic workpiece. Millard states also that his spacing block removes gas bubbles from the cathode and also removes threads of chromium. He also states that the block, which has a significant width, dresses and polishes the cathode during plating. The aim of Millard, is clearly to burnish or compact the coating surface somewhat in the manner of several earlier patents. While Millard talks, therefore, about scraping off the gas bubbles and also removing "threads" of chromium by which it is understood that he means dendritic material, he is primarily interested in conducting a burnishing operation and spacing his cathode from his anode by his relatively wide spacer block.

U.S. Pat. No. 3,001,925 issued Sep. 26, 1961 to E. V. Berry discloses an anode structure for an electrolytic coating bath for coating crank shaft sections rotated within a coating bath to provide rapid deposition of hard chromium coatings. Berry makes use of a lead anode which at least in part closely surrounds the portions of the workpiece to be chromium coated. The anodes are made either of a lead-antimony or lead-tin alloy which is preferably grooved or ridged in order to provide an increased ratio of anode-to-cathode surface. The Berry patent is directed specifically to tank plating and not to brush plating and generally illustrates the only viable practical type of arrangement for plating hard chrome coatings upon workpieces available in the past.

U.S. Pat. No. 3,619,383 issued Nov. 9, 1971 to S. Eisner, discloses an electrolytic coating composition in which the surface of the strip which is being passed through an electrolytic coating tank is contacted with a special "activation" means which scratches the surface of the strip to activate such surface by, it is postulated or believed by Eisner, removing the polarization layer and distorting the metallic deposit in a manner which results in an increase in the rate of electrodeposition. The activation of the surface is provided by passing in contact with the strip an open weave fabric or compressed non-woven substrate having abrasive particles on the surface which scrape and plow the surface just as the electrodeposition takes place. The fibrous nature of the activating means also tends to draw along electrolyte with it so that the surface of the cathodic workpiece is always exposed to a fresh electrolyte. It is said that the activation process "precludes dendritic growth".

U.S. Pat. No. 3,749,652 issued Jul. 31, 1973 to S. Eisner, discloses a further method of forming soft chromium deposits which are not as subject to cracking as hard chrome. Eisner uses in one embodiment at least, a mechanical activator disk formed by Dacron fibers and carrying a coating of 600 grit silicon carbide abrasive secured to the Dacron fibers by a polyurethane adhesive. The disk is rotated against the end of the rod during electrodeposition and is indicated to result in a superior non-cracking coating.

U.S. Pat. No. 3,751,343 issued Aug. 7, 1973 to A. J. Macula et al. discloses a hand tool for brush coating metal surfaces with an increased rate of deposition. Macula provided a combined rubbing action on both the anode and the cathodic workpiece at the same time. Such rubbing, he believed, removed unwanted products of electrolysis and avoided passivation and polarization of the anode and cathode as well as the usual physical removal of gases and unwanted precipitates from the surface to be plated.

U.S. Pat. No. 4,125,447 issued Nov. 14, 1978 to K. R. Bachert, discloses the use of a brush attached to a movable anode within a hollow member being electroplated. The brush comprises a plurality of bristles made from plastic or other insulated material which rub against the inside surface of the tube being electroplated as the anode vibrates. This, it is said, provides an agitation, scrubbing and/or washing action inside the tube which tends to remove any plating material that does not have good adhesion and results in a uniform plated surface on the tube.

U.S. Pat. No. 4,176,015 issued Nov. 27, 1979 to S. Angelini, discloses the brushing of the surface of a series of bars as they are passed in a straight line through an anode immersed within an electroplating bath. The brushing is provided by a brush comprising a construction having a layer of fiber or the like scraping material compressed between two side plates. Such brush material is made of acid resistant material from which the glass fibers protrude only as much as necessary to touch the surface of the bars to be polished. It is said that the removal by the action of the brush of the cathodic film on the surface of the bars remarkably improves the plating process and the quality of the chromium layer on the bar surface. The cathodic film is formed, according to Angelini, of hydrogen ions which interfere with the plating current flow consequently hindering the electrodeposition of the chromium. As indicated, the brushing device removes such cathodic film.

U.S. Pat. No. 4,210,497 issued Jul. 1, 1980 to K. R. Loqvist et al., discloses the coating of hollow members including movement inside the cavity of electrolytic solution by means of a "conveyor" which consists of a resiliently and electrically insulating material such as perforated, net-like or fibrous strip which is wound helically around a reciprocating anode. The strip is fringed or slit on the edges facing towards the cavity wall to form fingers extending outwardly into contact with the cavity wall. It is said that the helical arrangement of the strip aids in conveying foam and gases formed during plating with high current density out of the cavity. It is also stated that in order to increase the rate at which the electrolyte, foam and gases are transported, the workpiece along with the anode and the fringe strip about it can be arranged vertically or at a suitable inclination calculated to aid the removal apparently of the gases. It is also stated that the gas conveying and electrolytic conveying material can consist of various types of perforated fibers or net-like bands other than the plastic strip mentioned and that the function of the resilient electrically insulated material is to act as a conveyor of electrolyte, foam and gases which can be supplemented by forming the anode as a screw conveyor. Furthermore, it is stated, several conveyors can be arranged in the cavity.

U.S. Pat. No. 4,269,686 issued May 26, 1981 to A. W. Newman et al. also discloses an apparatus for chromium plating the bearing surfaces of a crank shaft within a plating bath as distinguished from brush coating. Newman discloses an arrangement for his anodes to closely encompass the surfaces of the crank shaft to be plated without touching such surfaces and discloses that such anodes should be formed from a lead composition.

U.S. Pat. No. 4,452,684 issued Jun. 5, 1984 to K. Palnik discloses a brush or selective plating apparatus said to accomplish high speed selective plating of gold and other precious metals on electrical apparatus by the brush method using a brush comprised of a molded body formed with a porous, hydrophobic material covered by a felt-like material. A porous platinum sheet or screen is positioned between the two to serve as the anode. The electrolytic solution is distributed through a conduit located interiorly of the brush and passes outwardly through small pores in the hydrophobic material till it covers the felt-like material. A suitable porous hydrophobic material is disclosed by Palnik to be preferably a molded polypropylene having pores uniformly dispersed throughout so that it is pervious to liquids. Palnik states as a generalization that larger pores and greater pore density will permit faster plating rates, but may result in more plating solution being deposited on the surface of the material to be plated than necessary, making selective plating more difficult to control. In the arrangement of Palnik, the parts to be coated are passed by the stationary brush material in contact therewith only once rather than being subjected to multiple passes or a back-and-forth rubbing or abrasion.

U.S. Pat. No. 4,595,464 issued Jun. 17, 1986 to J. E. Bacon et al., discloses the use of a so-called brush belt for continuously treating a workpiece. The brush belt is in the form of a continuous loop which passes over suitable rollers or pulleys and brings plating solution in the brush portion to the plating area. The brush is formed of a highly absorbent material which is chemically inert to the plating solution. It is stated that an open-cell urethane foam or other materials such as felt or neoprene is preferred. The absorbent material must be capable of allowing the solution to pass through one side to the other and be held by the material. It is said that the belt may be driven in a direction opposite to the workpiece at a speed that will most effectively break down the cathodic film buildup on the interface or contact point between the brush belt and the web workpiece. It is also stated that a squeegee apparatus may be placed at a location on the brush belt after it passes by the supply of plating solution to squeeze out plating solution remaining on the belt after the plating operation. Essentially, therefore, Bacon et al. provides an absorbent belt which passes in opposition to the material to be coated.

U.S. Pat. No. 4,610,772 issued Sep. 9, 1986 to K. Palnik discloses the use of a porous hydrophobic material as in his previous patent, but provides for the use of a rotating rather than a stationary brush.

U.S. Pat. No. 4,738,756 issued Apr. 19, 1988 to W. M. Macitif discloses a brush-type chrome plating process utilizing a so-called standard tank chrome plating solution instead of a specialized brush-chrome plating solution. The process described is essentially a hand-coating process using a hand applicator.

U.S. Pat. No. 4,750,981 issued Jun. 14, 1988 to H. W. Dalland et al. discloses the use of a portable chamber for clamping onto the surface of a workpiece at the point where a coating is to be provided, said chamber having within it an anode which is located closely adjacent to, but electrically isolated from the surface to be coated. The anode is typically a carbon anode or else an anode made of the metal which is to be coated upon another metal. The Dalland et al. apparatus is designed to be used where neither tank plating nor brush plating are practical. Dalland et al. further discloses that "brush coating is not suitable for applying certain desired chrome platings that, heretofore, have required dip tank-type solutions".

U.S. Pat. No. 4,853,099 issued Aug. 1, 1989 to G. W. Smith discloses an electroplating apparatus for rapidly electroplating a surface of a workpiece by a so-called gap-type electroplating in which an anode in a shape and having a surface generally matching the shape and selective surface of the workpiece being plated. While gap plating can be accomplished in a tank and is often done in a plating tank, it can also be accomplished by directing a plating solution into the gap between the anode and cathode as a current is applied between such two electrodes as long as a closed fluid flow can be maintained through the gap. The contribution of the Smith patent to the art of gap coating is to form a very narrow gap and then pump a large amount of plating solution to it so that the plating solution passes very quickly. It is stated that these ultra high flow rates allow high current densities which in turn cause rapid deposition of metal from the flowing plating solution.

U.S. Pat. No. 4,931,150 issued Jun. 5, 1990 to G. W. Smith, discloses a so-called gap-type electroplating operation in which a selected area of workpieces is coated by forming an electrode closely about such so-called gap and passing electrolytic solution through the gap at a high rate. It is stated that the ultra-high volume flow assures the removal of gas bubbles, the maintenance of low temperature and high solution pressure contact with the anode surface and a workpiece surface. It is stated that gaps approaching two and one half inches can employ the invention, but the gap would preferably be smaller, but at least 0.05 inches in width. It is stated that a fresh plating solution having a controlled temperature and no staleness is available at all times in the gap for uniform plating and while in high pressure contact with the surface of the gap. In practice, the plating solution is forced in a vertically upward direction so that any gas generated by the electrolysis in the gap migrates upwardly in the same flow direction as the plating solution is being driven and, therefore, can readily escape. It is also stated that chromium is difficult to use in the invention because chromium deposits slowly regardless of current density so that the deposition is slow and the advantages of gap plating are not fully attained.

It has simply not been possible previously to provide successful hard chromium coatings by the brush plating method and as a result, the preciseness of coating, the convenience of coating at the work site as well as the portability of the necessary apparatus and the other advantages of brush or selective coating have not been available for the provision of hard chrome coatings, yet hard chrome coatings are one of the prime metallic coatings for the repair particularly of the bearings for shafts, shaft surfaces and the like. There has been a critical and long continuing need, therefore, to have a brush plating-type apparatus and procedure for plating with hard chromium.

BRIEF DESCRIPTION OF THE INVENTION

The present inventor has discovered that hard chrome coatings can be formed upon workpieces by use of a brush-plating-type process including the use of a preferred apparatus, including or incorporating a lead anode, and preferably a lead tin anode, having a surface closely configured to the surface of the workpiece and provided with an arrangement by which the anode is continuously moved with respect to the surface of the workpiece and wherein the anode substantially continuously covers or is at all times immediately adjacent to the section of the workpiece which is to be coated, with the surface being rubbed by wear-resistant plastic fingers or bristles resistant to chromic acid solution and wherein a rapid flow of coating solution is maintained past the surface of the workpiece in the space between the workpiece and the anode which are very closely spaced, but insulated and shielded from arcing between the electrodes by a dielectric material. The required current density between the anode and the workpiece was described and claimed in Applicant's previous application upon which this application is a continuation-in-part, as being between 2.5 to 3.5 amperes per square inch of anode "contact" or envelopment area and the temperature of the solution was described as being held within a range of 130° to 150° F. with the solution strength being preferably in the range of 20 to 30% $CrO_3$ and 0.20 to 0.30 percent $H_2SO_4$ when the solution is a mixed catalyst fluoride-type plating solution. Further experimentation has now indicated, however, that the previously indicated limits for current density and temperature are merely the most preferred limits for the most popular mixed catalyst fluoride-type plating solution and that other preferred ranges may, and in fact, are, operable for other types or compositions of plating solutions. Several different apparatus have been developed to accomplish thorough wiping of the cathode surface to displace hydrogen bubbles and at the same time maintain a constant electrode spacing and insulation plus rapid exchange of plating solution.

In general, it has been discovered by the present inventor that if the brush plating operation is conducted within the correct ranges and is, with certain exceptions, maintained at a steady rate once initiated that a hard chrome coating can be obtained, whereas if any significant variation in the rate of deposition or hiatus in the plating process occurs, the deposition of hard chrome may cease and cannot then be readily reinitiated without starting the whole process again. Consequently, in order to make the best quality product, the anode should be continuously maintained over the area to be coated, the relative movement between the anode and cathodic workpiece should be continuously maintained, the current density should be closely maintained and the strength and uniformity of the electrolytic coating solution at the coating site must be maintained substantially uniform at all times. In particular, the anode surface should be maintained at all times substantially opposite the area being coated and relative movement of the brush surface to the surface being coated maintained. Furthermore, it has now been discovered that the uniformity of the electrolytic coating solution at the coating site has two principal aspects or requirements (a) that fresh solution reach or be available at the coating site at all times, and (b) that such fresh solution have access to the surface to be coated at all times during coating. Requirement (a) is met by providing a substantially continuous flow or rapid interchange of coating solution to or at the coating site at all times to absolutely assure that the metallic content of such plating solution does not become depleted by the plating operation itself, and requirement (b) is met by making certain that no physical or chemical obstructions occlude access of the solution to the surface during coating. This requires that no guide means or the like block access to the surface for even a very short period and that all bubbles of hydrogen as well as any thin cathodic film which may form is promptly removed. It is also important that the distance between the anode and the cathodic workpiece be minimized and a distance centering about three eighths (⅜) of an inch has been found to be most effective or preferably, between about one quarter (¼) and one half (½) inch for best results.

More particularly it was discovered previously that good quality hard chrome coatings of significant thickness can be formed if care is taken to (a) preferably initially electrolyze the surface of a lead electrode, (b) the electrode is maintained thereafter at all times with a portion of its active surface in effective anode contact with the surface of the workpiece to be coated by maintaining at least a portion of the anode surface continuously over all portions of the workpiece surface to be coated, (c) the workpiece surface is continuously brushed with a chromic acid resistant plastic wiper which may take several forms including a brush surface which is a portion of an anode wrap section comprising an absorbent base material which provides or maintains electrolyte between the anode surface and the workpiece and a bristled outer surface which brushes the workpiece surface, (d) the current density and relative movement between the brush material and the workpiece surface is maintained between strict operating limits and (e) the electrolytic plating solution is moved through the plating area evenly and at a rate preventing depletion of the chrome content. As noted above, the maintenance of a portion of the anode always adjacent the area being coated and relative movement between the anode and the workpiece providing continuous brushing was found to be especially important to make the best quality coated product. Means for practicing the invention in an environmentally acceptable manner are also disclosed. It was also discovered that with proper technique, the standard chrome plating solutions designed for tank chromizing can be used in an effective brush plating operation forming significant deposits of hard chromium coatings.

The Applicants have now learned that the important requirement of providing access of undepleted or fresh electrolytic coating solution to the coating area, plus the equally important requirement of promptly removing hydrogen bubbles and any cathodic film from the coating theatre or area being coated plus maintaining a close spacing between the cathodic workpiece and the anode can be accomplished by several different types of apparatus. More particularly, the coating process can be accomplished not only by bringing the electrolytic solution to the coating theatre by means of an absorbent base material and dislodging hydrogen bubbles and other coating occludants by means of plastic brush material overlying the absorbent base material, but by using other types of hydrogen dislodging apparatus either in combination with an absorbent base material or in combination with what may be defined as a modified selective coating process in which the coating takes place within what is essentially a tank-type coating bath or a modified brush coating flow arrangement and the hydrogen bubbles and other coating residuals are removed and/or prevented from accumulating by means of a coating surface rubbing means having a relatively open structure and restricted surface contact characteristics so that hydrogen bubbles can readily escape or be removed from the coating theatre after dislodgment from the surface and the access of fresh coating electrolyte is not inhibited or impeded from reaching the coating surface. Several different apparatus for accomplishing this are disclosed, including plastic bristle surfaces, open-weave fibrous scraping means and elongated solid wiper blades. More particularly, three basic types of wiping apparatus and operations have been found suitable. In the first, the surface being coated is wiped with a chromic acid resistant wiper where the wiper construction is that of a series of discontinuous fibers secured at one end and brushing against the surface with their other end. The second major embodiment of wiping apparatus is formed from a series of continuous fibers secured basically at both ends, either in the form of a woven, knitted or braided construction or a series of adhered fibers acting upon the coating surface.

The third major type of wiper is the use of a thin essentially solid blade, this being the most preferred apparatus and method. Several other types of wiping apparatus or materials are also applicable so long as they have an open structure allowing free passage of electrolyte to the coating surface and bubbles of hydrogen away from the surface.

BRIEF DESCRIPTION OF THE DRAWINGS

FIG. 16 is a transverse cross sectional view of a presently preferred arrangement for practice of the invention.

FIG. 16A is a side view of one of the preferred wiper blades shown in FIG. 16.

FIG. 19 is a cross-sectional view of an alternative arrangement for practice of the invention involving the use of knitted, woven or continuous polymeric fiber-type wipers.

FIG. 19A is a cross sectional view of a fibrous wiping material shown in FIG. 19 held or seated in a longitudinal support.

FIG. 19B is a side view of the wiping material and support therefore shown in FIG. 19A.

FIG. 19C is an enlarged transverse section of a portion of fibrous wiping material having an open woven structure.

FIG. 19D is an enlarged longitudinal view of open woven material such as shown in FIG. 19C in cross section.

DESCRIPTION OF THE PREFERRED EMBODIMENTS

Figure 1:
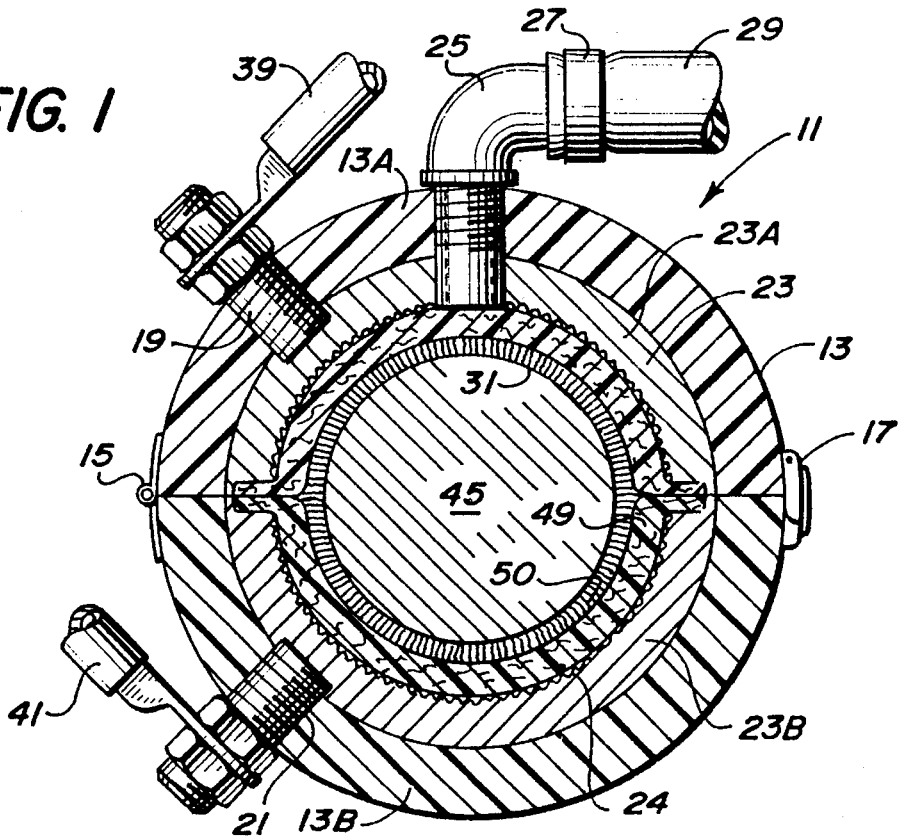
FIG. 1 is a transverse cross section of one arrangement for practice of the invention.

So-called brush plating, or selective plating has come more and more to the fore, particularly since the end of the second World War, because of its convenience in making field repairs and adjustments to the surfaces of damaged coated and uncoated products and equipment and its ability in general to make harder and more wear and corrosion-resistant coatings than other electrolytic-type coatings. However, a rather critical defect or disadvantage in the brush coating, or selective coating, process has been its inability to produce good, hard chrome coatings of reasonable thickness. This long continued lack in selective coating technology has now been solved by the present invention, which enables hard chrome coatings having excellent properties to be easily and efficiently provided upon various workpieces.

Essentially, the present Applicants have discovered that a hard chrome coating can be formed on a workpiece by coating such workpiece within an anode enclosure apparatus which provides at all times, a fresh, undepleted electrolytic solution in an area between the surface of the anode, which is formed from lead, or a lead composition, and the surface of the workpiece. In accordance with one embodiment of the invention, a polypropylene or other appropriate plastic felt or felt-like material resistant to chromic acid degradation is provided on the surface of the lead anode to retain the electrolytic solution continuously between the anode and the surface of the workpiece while providing a substantially free flow of electrolytic solution. Likewise, a polypropylene or other appropriate plastic brush or discontinuous scraper element is preferably provided to continuously abrade or rub the surface of the workpiece to dislodge from such surface, bubbles of hydrogen as well as any contaminants derived from the coating bath. It has also now been discovered that the plastic brush should effectively break off any dendritic material extending outwardly from the coating surface as coating material is progressively laid down and should allow such broken off dendritic material to escape from the brush material to prevent marring of the coating surface by any such material as might become lodged in the wiping material. Any dendrite material caught in the wiping material will become cathodic and grow larger as it thieves current and thus prevents an even distribution of chromium metal being deposited on the workpiece.

The plastic brush, or divided scraper material, must be both resistant to attack by the chromic acid material in the electrolytic solution and snag and tear resistant with respect to the coating deposit, which can become quite rough, especially around the edges, during coating and will tear or shred a weak plastic material if directly applied to the surface being plated. A force feed of the electrolytic solution is provided to the anode enclosure apparatus and provision is made for very rapid removal of such solution from the anode enclosure area so that there is a rapid interchange of electrolytic solution through the apparatus.

The anode can be from 0.125" to 1" from the surface of the workpiece, with the preferred distance being approximately 0.375". Any closer spacing than 0.125" precludes the use of anything other than a very thin felt or porous material as an anode "wrap" and seriously increases the risk of burning the deposit. At a distance greater than 0.375" plating efficiency tends to drop off and an anode wrap of felt or woven material becomes so thick as to be unmanageable and difficult to anchor, or in the case of the use of preferred form of thin wiper blades disclosed hereinafter, the width of such blades becomes so great that they may tend to warp and become ineffective in wiping the work surface.

Since the apparatus is designed to function using the various tank solutions normally available to all hard chrome plating shops, it is advisable to take into account the different operating parameters recommended by the manufacturer or formulator for each type of bath that could be used in any given brush plating program.

There are three broad types of plating baths generally used for hard chrome tank plating, i.e. conventional, mixed catalyst and proprietary fluoride-free. The significant parameters for each type of bath extend over a combined range of 0.25 to 6 amps per square inch (ASI) and the suggested temperature may be from 120 to 140 degrees F., depending somewhat upon the particular chromic acid concentration and chromic-acid sulfate ratio in each bath. The producer recommended parameters can be departed from in some cases, but in general, may be best followed.

When operating with a mixed catalyst bath electrolyte using a plastic solution delivery system as well as a plastic bristle surface scraper, the coating temperature is preferably held at about 140° F. (60° C.) or preferably within plus or minus 10° F. and less desirably 15° F. of such temperature and the current density is maintained after fully starting the process at between about 2.5 amps to 3.75 amps per square inch and preferably about 3 to 3.5 per square inch. The voltage will normally be adjusted to be about 8 to 10 volts in potential difference between the cathode and the anode.

Movement between the anode surface and the workpiece surface should be in a range of about 30 to 60 surface feet per minute. It is critical that the plated surface or surface to be plated be maintained substantially continuously adjacent to the anode surface during actual coating. This is fairly easy to arrange in a shaft-type arrangement where the workpiece rotates within an anode. However, it can become more difficult to attain where the anode is being moved horizontally or the like with respect to the workpiece surface. In such case, the anode must be sufficiently larger or greater in area than the surface which is actually to be coated so that there is at all times substantially a 100% anode contact with the surface to be coated, or in other words, at least a portion of the anode surface will at all times be adjacent to the surface being coated or plated. Adjacent surfaces which are not to be coated can in such case usually be shielded with the usual shielding tape, which should be a high temperature tape designed for such masking in either electrolytic coating baths or brush plating. Lead tape may be used as thieving tape to reduce edge buildup on the coating. The type of high temperature tape used frequently with sulfamate nickel electrolytic plating baths has been found to be satisfactory.

It has also been found very important to maintain an adequate and uniform flow or actually a reasonably rapid replacement of the electrolytic solution adjacent to the surface of the workpiece so that the coating is plated out substantially continuously from essentially fresh solution throughout the coating operation. If the electrolytic solution becomes deficient or depleted in chromium at isolated points or times due to insufficient flow with respect to the plating rate, the quality and hardness of the chromium coating will become unsatisfactory. The required flow of plating solution will depend upon the rapidity of plating out of the solution and, therefore, upon the current density and other factors including the chromium content of the solution and the like. In general, it is believed the flow of solution should be greater through any volume of the coating theatre with increasing current density, but in general, the important aim is to have a sufficient flow of electrolytic solution to prevent depletion of such solution of plateable chrome ions. When operating in accordance with the invention, it will be found that a very dense, hard chromium surface layer will be formed. Coatings of normal thickness can be made. The denseness and adhesion of such chromium layer to the underlying metal may be easily tested by grinding the surface of the chromium to determine how hard and dense it is and also whether it is well adhered to the surface.

It has been further found, particularly in fairly recent experiments, that it is particularly important to not only maintain substantially full coverage of the cathodic work surface to be coated with the anode surface, but also for the anode to be closely spaced, as set forth above, to the cathodic work surface. Thus, the anode surface should preferably be within preferably about ⅜ or 0.375 inch from the cathode surface to be coated, although the actual distance can vary from about ⅛, or 0.125 inches, to as much as about one full inch with the preferable range being approximately ¼, or 0.25 inches, to ⅜ or 0.375 inches or less preferably, to about ½ or 0.5 inches. This requires, in the usual arrangement, that the anode take the general shape of the surface of the workpiece. As the anode recedes from the cathodic work surface beyond 0.375 inches, it becomes more difficult to attain a good coating as plating efficiency drops off. It also becomes more difficult to attain an efficient and effective wiping with either brush-type, woven or solid blade-type wipers, although fairly good coatings can be obtained with special care up to a gap between the electrodes of one half inch, after which there is considerably more difficulty.

It has also been found, particularly in recent experiments, that the plastic brush bristles should be sufficiently spaced so that any dendritic material dislodged from the surface will be easily discharged from the brush portion and not be entrained in the brush where it can damage the coated surface and also so that a rapid interchange of electrolytic solution is attained at the coated surface so that there is no depletion of the concentration of the electrolytic solution adjacent the coated surface. The plastic bristles or fingers must, however, be sufficiently closely spaced and stiff or resistant enough to provide an effective scouring of the surface to effect substantially complete removal of hydrogen bubbles and/or any thin cathodic film formed principally of hydrogen upon the coating surface so that such cathodic film or hydrogen bubbles do not interfere with effective contact of the electrolytic solution with the surface being coated.

It has also been learned during recent experiments that the same coating effects or requirements can be attained by the use of a modified brush coating arrangement in which the coating solution is allowed free access to the surface to be coated by having such surface essentially submerged in the electrolytic coating solution. This can be accomplished in several manners, including the elimination of the plastic felt material and merely containing the solution in a space between the wall of the coating chamber and the cathodic workpiece surface with an electrode or anode having a large surface area disposed also within such space close to the surface of the cathodic workpiece. A continuous movement is provided between the surface of the cathodic workpiece and the anode either by moving or revolving the workpiece within the anode as well as the larger chamber or moving the anode past or revolving it about the cathodic workpiece. At the same time, the surface of the cathodic workpiece is either continuously rubbed with a plastic bristle arrangement having a sufficient open structure to both discharge or allow to be washed out any dendritic material that may be dislodged from the surface of the cathode as well as to allow the escape of hydrogen bubbles and to allow free access of the electrolyte to the surfaces to be coated at all times.

Alternatively, instead of using a brush-type construction for dislodging hydrogen bubbles and any cathodic film from the cathode work surfaces, an open fibrous plastic construction can be used to scour the coating surface. Such a fibrous construction may comprise either a knitted or woven plastic construction and can be conveniently formed from a plurality of wear-resistant and chromium-solution-resistant plastic fibers. Such plastic fiber construction, which may appear essentially like an open-mesh material folded together may also have an appearance and construction essentially like that of a plastic pot scrubber material. The open construction of such material both allows free access of the electrolytic bath to the cathodic coating surfaces and at the same time will allow any dendritic material removed from the coating surface by contact with the fibers to be discharged from the open weave. If such dendritic material were retained in the fibrous material, it would tend to mark or damage the coated surface because of current thieving caused by the presence of broken off chromium dendrites, and cause an uneven deposition of coating and even lacunas or openings through the electrolytic coating.

A third and presently preferred manner of removing hydrogen bubbles as well as a generally very thin cathodic film formed of hydrogen which bubbles and film normally accumulate as the coating proceeds, is by the use of so-called "wiper blades" which are formed from a thin chromic acid plastic material and bear along one side or edge against the surface being electrolytically coated. Such wiper blades cause a very copious effusion of hydrogen bubbles from the cathodic work surface as they pass over such cathodic work surface, which bubbles then quickly float to the surface of the body of electrolyte and may be removed or conducted from the vicinity of the coating bath. It has been found that even though the wiper blades may be only intermittently spaced about the coated surface, or along the coated surface, their efficiency is such that any hydrogen accumulation is substantially completely removed even more efficiently and effectively than using a plurality of plastic bristles essentially over the entire surface of an anode wraps for more or less continuous impingement against the surface of the cathodic workpiece being coated. The thin wiper blades constitute, it will be recognized, the ultimate in unrestricted access of the coating solution with the surface being coated as well as lack of any hindrance to dispersal into the coating bath of any dendritic material that may be displaced from the surface of the coated material. The thin wiper blades, therefore, provide the best results in keeping the surface of the coated product clear of gas bubbles which occlude the surface with respect to coating and also the removal of any thin cathodic film also formed of hydrogen. It is believed that the plastic blades scraping over the surface of the workpiece essentially cause the thin cathodic film to combine or coalesce into larger bubbles which then quickly grow into still larger bubbles which rapidly rise from the bath and are dissipated into the surrounding atmosphere or drawn away into some other apparatus. The rapid and voluminous evolution of hydrogen gas is so copious, in fact, that it has been discovered that such hydrogen can be collected at the surface of the bath, the moisture extracted and the gas further purified, if necessary, and used as fuel. In many cases, such gas is so concentrated that little, if anything, other than passing through a drying medium is required prior to use for some less critical fuel uses, such as use in a burning torch and the like.

An effective continuum of suitable wiping means for the dislodgment of gas bubbles from the surface of the cathodic workpiece, may be considered to extend from the use of a plastic felt material having a fiber density sufficiently close to at least temporarily retain electrolyte therein for dispersal to the coating surface, but open enough to allow hydrogen bubbles to escape, through a more open fiber or felted material which may be used essentially as a brushing or scrapping surface, continuing through the use of plastic bristles in a brush-like arrangement having a fairly wide spacing through a woven, knitted or braided plastic fiber material having a fairly loose fiber arrangement which does not impede the access of electrolyte to or escape of bubbles from the coated surface and ultimately to a basically thin flat plastic blade which neither blocks access of electrolyte to or escape of bubbles from the surface to be coated, nor retains any dendritic material upon its surface. In general, it has been found that results become better as the continuum is progressed through from the fairly dense felted material to the flat blade. However, reasonable results can be obtained from all of the disclosed wiping mediums with respect to formation of hard chrome coatings in a brush or selective coating operation so long as the free access of coating solution to the electrolytic coating site is not inhibited and the escape of bubbles of hydrogen from the coating site is not impeded and so there is a continuous supply of non-depleted electrolyte solution available at the coating site and no buildup of hydrogen bubbles or a cathodic film on the surface of the cathodic workpiece and the spacing between the anode and the cathodic work surface is minimized without becoming so small as to encourage arcing between the surfaces. In general, the dielectric or plastic wiping material between the electrode surfaces aids in preventing too close an approach of the electrodes toward each other and aids therefore in preventing arcing.

Essentially, the present inventors have found that hard chrome coatings can be effectively made, if the coating operation is run as a completely uniform operation from beginning to end with no interruptions whatsoever in continuous plating and preferably no substantial variations in coating speed. If the plating operation should be interrupted for more than a few seconds, deposition of hard chrome may cease or occasionally may change to soft chrome, and if the rate of deposition varies from time to time to any significant degree, the quality of the coating may well be detrimentally affected. Consequently, the process of the invention requires substantially completely continuous operation within critical limits with no substantial interruptions or variations whatsoever from the beginning to the ending of coating. In other words, it has been found that the chromium coating operation is inherently much more "touchy" than the coating of other metals by a brush coating operation, but with appropriate care and the proper conditions, hard chrome coatings can be applied by brush plating or a semi or modified brush or selective coating.

Unlike the usual situation in brush coating with other coating metals, the chrome brush coating process simply cannot be interrupted for more than a few seconds at best without the chromizing completely stopping, requiring the entire process to be restarted from scratch. Normal brush plating technique, for example, does not require the anode to be always kept adjacent to the coating area during coating, because even if the anode passes beyond the coated area for a short period, the coating merely picks up with the same quality where it left off when the anode is returned to the coating area. It has been discovered that this does not occur in the brush plating of chrome or hard chrome and that in order to detain the best quality coatings the coating process once started must be maintained at substantially a uniform rate until completed. It has been further discovered that if the proper techniques are used with usual care, ordinary tank-type chrome plating solutions can be used.

In particular, it has been found that the anodic electrode, or anode, should in order to make the best quality product be maintained in continuous effective anode contact with the surface to be coated at all times. In other words, at least a portion of the anode should be kept at all times opposite to every portion of the areas to be coated with substantially continuous movement between the two, to achieve the best coatings of hard chromium. In a similar manner, it is very preferable for the other parameters of the coating operation to be maintained relatively constant. In the ordinary brush plating operation, on the other hand, the anode wrap is customarily provided less than full contact with the work surface at all times and other parameters are also frequently operated discontinuously with no ill effects.

While, as indicated above, it is very desirable to maintain the coating at a continuous rate at all time, it also may be desirable to begin a coating process with a significantly lower current density, referred to as making the strike at a lower current density and it may be advantageous to give the cathodic workpiece a so-called strike at lower current density at intervals of about twenty minutes as this encourages dense nucleation and a more uniform coating. On the other hand, if a high current density is used continuously, nucleation is more diffuse or scattered and the uniformity of the coating tends to be decreased.

As indicated above, it has also been found that the electrolytic solution cannot be allowed to become depleted of the coating metal as this will vary the speed of plating, possibly causing the hard chrome plating to cease and, for a like reason, the surface being coated cannot be allowed to accumulate a coating of bubbles of hydrogen or a significant or thick cathodic film as this will also cause the rate of deposition to vary, possibly causing the deposition of hard chrome to cease. It has also been found that the spacing of the anode and the cathode should be within certain minimum limits and escape of bubbles of hydrogen from the coating site must not be inhibited, else the coating rate will also be varied, effectively stopping the coating process for hard chrome. Not interfering with the removal of hydrogen bubbles and allowing free access of fresh undepleted electrolyte to the surface being coated are closely related, since each requires that there be, in effect, open access to the surface being coated and it has been found, as indicated above, that there is more or less of a continuum of apparatus arrangements for effecting this, particularly in connection with so-called "modified brush coating," which, in effect, brushes the surface of the substrate being coated while such surface is effectively immersed within electrolytic coating solution.

While the exact reason why the coating of hard chrome should be maintained with substantially completely uniform conditions and why in particular, the anode surface should be kept in continuous anode contact with all portions of the work surface at all times for the best chromium coating, is not known, it is theorized that, since chrome plating solutions are relatively inefficient potential or current carriers, if the work surface moves for a moment beyond the effective anode plating or current carrying range and the potential between the anode and the work surface drops precipitously, this allows the essentially uncharged solution adjacent the coating area to inactivate or passivate the surface to be coated. Once passivated or inactivated, the surface cannot thereafter be effectively coated. In brush plating with other metals, on the other hand, the conductivity of the solution is sufficient to maintain an effective potential between the anode surface and the surface to be coated, even when the two are displaced somewhat apart and the surface to be coated is not passivated or inactivated allowing the coating or process of coating to be continued until a desired coating thickness is attained. It is emphasized that these suppositions are merely theoretical at the present time. Further investigation is continuing and may or may not confirm such theory. It may be noted in this regard, however, that chrome solutions are frequently considered to be less than 15% effective as coating solutions on an overall basis.

A further consideration which has been found experimentally in connection with the instant invention is that it is beneficial to break off unequally growing dendritic material from the surfaces of the hard chrome deposit. Such removal of unequally upwardly extending portions of the coating tend to prevent the coating from depositing unequally which in itself may cause the deposition of hard chrome to cease. It has been found, however, that it is also necessary for such broken off dendritic material not to be collected upon the wiper surface, else the movement of the wiper relative to the surface of the cathodic workpiece will, in effect, scratch the surface of the coating and uneven deposition of such coating due to thieving of electrical potential caused by the presence of the broken-off chromium dendrites causing defects in such surface. This is undesirable, although it may not cause the deposition of hard chrome to cease. For example, it has been found that if a dense plastic felt surface is brushed upon the surface of the coating, it will effectively remove bubbles of hydrogen from the surface, but will also both tend to collect or retain broken off dendritic material scratching and otherwise marring the surface being coated and causing an uneven coating deposite, but will also not allow free escape of hydrogen bubbles. If the hydrogen bubbles build up, they tend to block the removal of further bubbles. Consequently, it is necessary to use a wiping material that has a sufficiently open construction to allow both the dendritic material and the hydrogen bubbles to be readily disengaged from the wiper and to either escape from the system with the used electrolytic solution or to, in the case of the hydrogen bubbles, escape from the coating vicinity and then to separate from the coating solution. As indicated, there is a continuum progressing from more open to less open starting with a completely open wiper structure such as a wiper blade, progressing through an open weave plastic wiper to a fairly open brush structure, then to an open felted structure which may still be satisfactory for displacement of dendritic material or hydrogen bubbles, to a fairly close felted structure which will tend to retain both dendritic material and hydrogen bubbles and will not be satisfactory. However, as indicated, the more open arrangements of wipers have been found to be most satisfactory for effective wiping of the cathodic work surface during electrolytic coating.

In FIG. 1, a partially cutaway view of a brush coating apparatus in accordance with the invention, particularly, in the case shown, for brush coating a damaged shaft or the like, is designated, in general, by the reference numeral 11. The brush coating apparatus 11 is composed of an outer plastic casing 13 which in the case of a shaft or the like as shown, may conveniently be comprised of a portion of a plastic pipe, although it will be understood it could also be comprised of any other molded casing arrangement. Such plastic pipe 13 has been severed into two casing sections, an upper section 13A and a lower section, 13B mounted together by hinge arrangement 15 and with a clasp or latch arrangement 17 on the opposite side. An upper electrode connection 19 and a bottom electrode connection 21 are shown in the form of threaded fittings extending through the casing 13 and partially screwed into two sections of lead anode 23. An upper anode section 23A and a lower anode section 23B comprise the two sections of the anode which are preferably secured to the corresponding sections of the plastic casing 13A and 13B. In the center of the upper casing 13A and upper section of the lead anode 23A, there is provided a solution feed connection 25 which is attached as shown by a clamp 27 to a solution feed hose 29. It will be understood that the electrolytic solution or plating solution will be fed via the solution feed connection 25 into the interior of the electrode chamber 31 through which the shaft to be repaired or the like also passes. Direct current, or DC, powerleads 39 and 41 provide power to the anodes 23. It will be understood also that a further groundwire from the same rectifier apparatus will be connected to the workpiece or shaft within the center of the electrode assembly or brush coating apparatus 11. A rectifier apparatus used with the invention should be designed so that it has less than a 5% ripple effect in order to provide an effective plating operation. In other words, the current or current density should be kept as uniform as reasonably possible, although as indicated above, it may be desirable to initially strike the current at a lower current density to obtain a denser coating with increased nucleation and to periodically use a lower current density to periodically increase the nucleation. In other words, the invention does not preclude the use of pulse plating.

In the interior of the anode 23 is to be found a so-called "anode wrap" comprised of an inner plastic felt material 49 formed of a chromic acid and other chromium compound resistant material such as preferably polypropylene and an outer plastic brush material 50 also formed from a chromic acid resistant material and preferably polypropylene. Other chromic acid-resistant materials such as some polyesters and polyamides or the like can also be used. The felt material 49 is arranged or held next to the inner surface of the anode 23 and the brush material 50, which should be abrasion-resistant as well as chromic acid-resistant, is arranged or held next to the outer surface of the felt material or between the felt and the surface of the workpiece. The felt material is of such consistency as to absorb and hold electrolytic coating solution received through the solution feed connection 25 and distributed preferably to the inner surface of the anode 23 in grooves or flutes 24 upon the surface of the anode running lengthwise of the shaft 45, which, in the case illustrated, is the workpiece. Such flutes or grooves 24 also serve to increase the anode-to-workpiece surface area or ratio to preferably about 1.5 or more. The electrolytic solution soaks, or is absorbed, through the felt material 49 to the backing of the plastic brush material 50, which backing is perforated between bristles to allow the electrolytic solution to flow through the backing into the spaces between or among the brush elements. The brush element may be unitary with the felt material, i.e. there may be a backing or perforated dividing structural wall between the felt material or section and the brush section. Alternatively, the felt and brush may be separate elements merely held or maintained together in any suitable manner. As shown, the two elements may be conveniently clamped between the two sections of the electrode sections 23A and 23B so long as the electrode sections are clamped together sufficiently tightly so there is no significant discontinuity between them. The anode wrap sections can also be held to the surface of the anode by any other convenient means or fastening arrangement. In small sections, chromic acid-resistant dacron fish line may be merely tied about the anode and the interior anode wrap to hold such anode wrap in place within the anode.

The brush element has preferably fairly short bristles as well as fairly thin bristles so that they can be reasonably easily bent over or partially "squashed down" to provide an effective brushing action without being so stiff as to mar the chromium coating as it forms by forming grooves in it. (The chromium, which is very hard, is not actually worn by the soft brush element, but the bristle elements, it is believed, interfere with the coating operation if too hard.) A very suitable brush element made from polypropylene by molding or possibly by dynamic extrusion has a backing of about one hundredth of an inch (0.01 inch) in thickness, individual bristles which are approximately one hundredth of an inch (0.01 inch) in diameter, about thirty-five hundredths of an inch (0.035 inch) in length and which are spaced in rows with approximately seventy-five and twenty five-hundredths of an inch (0.075 and 0.025) between bristles along the rows. The shorter spacing is arranged transverse to the relative movement between the anode and the workpiece surface to provide a thorough brushing of the surface to keep bubbles off such surface. The outer ends of the brush bristles are preferably round or arcuate and smooth. Other arrangements or specifications are possible. The bristles should be fairly short so as not to provide too much of a flow area between the backing and the surface of the workpiece and should not be too thick or stiff so they do not rub or abrade the surface too severely during coating. Too stiff bristles may cause grooves to form in the surface during coating, even though the chrome is very hard. There must be flow openings or orifices through the brush backing at spaced intervals to allow circulation of electrolyte from the absorbent felt area to the bristle area. There should also be sufficient space between the bristles as distinguished from the length of the bristles to allow bubbles of hydrogen brushed from the surface to readily escape from between the bristles and to also allow broken off or severed dendritic material to escape.

Figure 2:
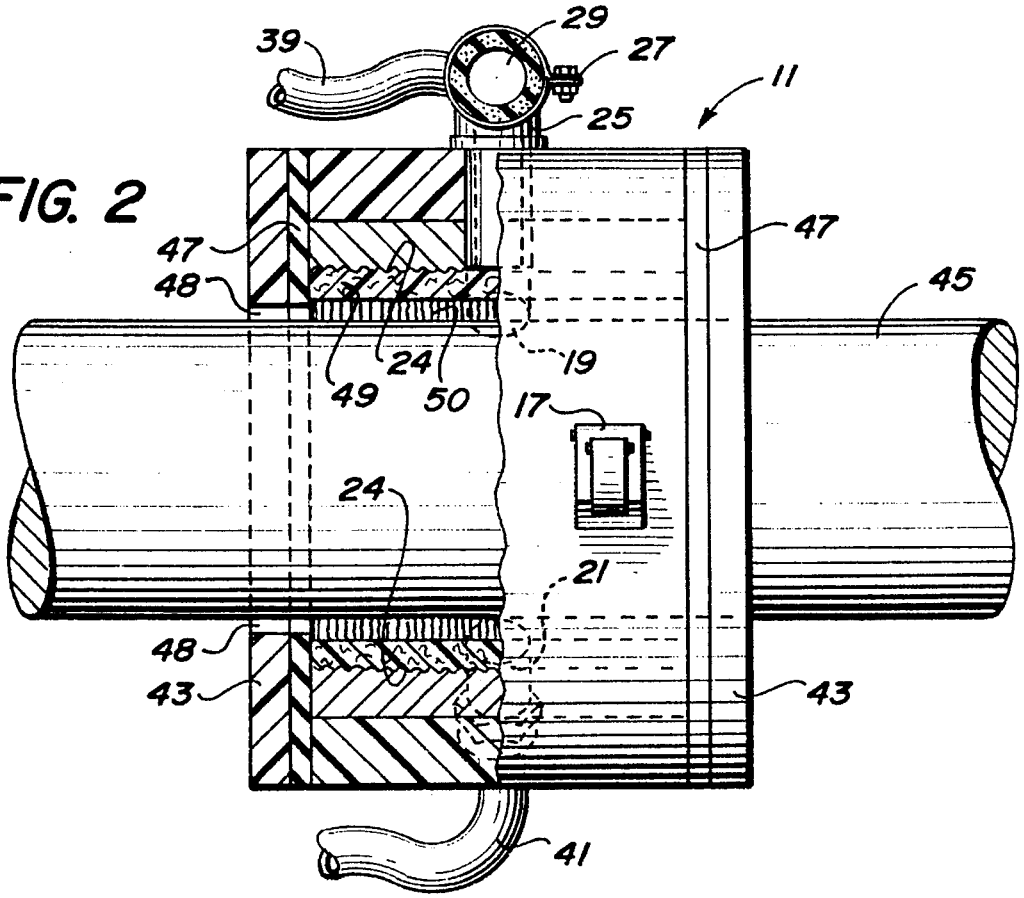
FIG. 2 is a partially broken away side elevation of the arrangement shown in cross section in FIG. 1.

FIG. 2 shows a side view or elevation of the brush coating electrode apparatus assembly shown in FIG. 1. The same structures are designated by the same reference numerals in the two figures, including the plastic casing 13 and the solution feed line or feed connection 25. It will be noted in FIG. 2 that the feed connection is not only provided at the highest point of the circumferential chamber within the coating apparatus, but is also positioned more or less in the center of the longitudinal length of such coating chamber. However, for long shafts or other workpieces, there may be two or more feed connections. As emphasized earlier, it is necessary to maintain a relatively constant and uniform supply of fresh, or at least uniform, electrolyte between the anode and the shaft or workpiece surface, and for long shafts or workpieces, multiple feed connections may be necessary to accomplish this in some installations. The inner portion of the anode surface 24, as noted, is corrugated longitudinally of the shaft in order to provide an increased ratio of effective anode surface-to-workpiece surface and such grooves also, since the porous plastic felt material 49 does not enter such grooves, but rather merely wraps about the shaft, serve to provide a fairly uniform transfer of electrolytic solution from the feed line 25 along the longitudinal extent of the shaft and allows its direct entrance into the upper portion of the plastic felt material 49 and hence through the perforated backing of the brush element 50 into the bristle area of the brush element along its length.

Two further structures are shown in connection with the apparatus in FIG. 2, namely, plastic flanges 43 positioned on the ends of the coating chamber or brush coating apparatus assembly. Such flanges 43 were, in early versions of the invention, provided with suitable flexible gaskets sealing the flanges against the edges of the shaft 45 extending through the center of the plastic flanges 43. In such arrangement, a large gasket 47 was also used on either side or either end of the apparatus between the plastic flanges 43 and the plastic casing 13 to form a seal between the plastic flanges and the casing. A similar gasket was also extended against the edge of the shaft 45 to prevent the electrolytic solution from leaking freely from the opening between the plastic flanges 43 and the surface of the shaft 45. Such gasket could be a continuation of the outer gasket 47 or a separate gasket arranged around the shaft.

Along with such sealed arrangement, there was provided a central drain more or less opposite to the feed line 25 to drain away the electrolytic solution, the theory being that the solution would enter the center of the casing at the top, flow toward the ends, and then reverse and flow at the bottom toward the drain in the center. While such arrangement operated after a fashion, it has been found very much preferable for the electrolytic solution to be allowed to leave the brush coating operation in the direction in which it initially flows. Consequently, the preferred arrangement is to inject the coating solution centrally in the apparatus at the top of the casing, allow it to flow toward the ends and then allow it to leave the coating field outwardly in a clearance between the end flange 43 and the shaft. It has been found that this arrangement improves the operation and quality of results by a factor of at least two. Such improvement effects better maintenance, it is believed, of the uniformity of the composition of the electrolytic plating solution during plating, avoiding localized or even general depletion of chromium ions from the electrolytic solution.

Consequently, it has been found that a central solution drain is insufficient to drain the solution from the internal chamber of the brush coating apparatus assembly sufficiently rapidly to provide a change of coating or electrolytic solution adequate to provide uniform operation. It has been found from experimental work that if used solution from which many of the metallic ions have been plated out tends to become isolated or trapped in the ends of the apparatus away from the central drain, a slight differential concentration of metal ions appears in the solution. This results in a variation in the effective coating rate in the same manner as a varying current density will cause a variation in the coating rate resulting in a possible cessation of chromium deposition or decrease in density of the chromium deposit which cannot thereafter be regained. It has been found that this problem can be overcome by removing the portion of the gasket about the shaft and allowing the electrolyte solution to freely drain through the openings in the side of the apparatus between the plastic flange and the shaft and out the space 48 which the gasket 47 might normally close off. Such free flow of solution allows a continuous fairly rapid change of electrolytic solution as the metallic ions in it are thrown down or plated out upon the shaft and prevents the electrolytic plating solution from having any significant dwell period within any portion of the apparatus. In particular, such arrangement allows a solution which is flowing in from the central solution feed 25 to spread out evenly, both downwardly about the circumference of the coating chamber and outwardly towards the flanges of the coating chamber. Since the solution is now also able to leave the coating chamber at the ends by simply flowing out, such solution maintains essentially its full concentration of the coating metal ions and is rapidly renewed so that such concentration does not tend to decrease with the coating operation. At the same time, the current density may be reduced somewhat to further assure that the solution does not become significantly depleted in coating metal before it passes out of the apparatus to be renewed.

Figure 3:
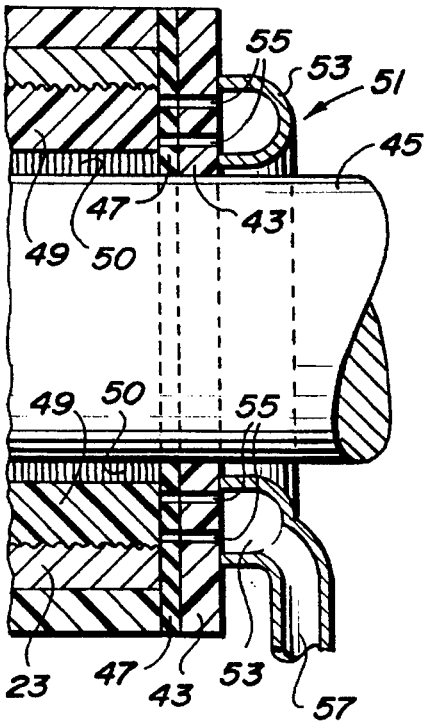
FIG. 3 is a longitudinal cross section of an arrangement for effectively removing coating solution from the cite of coating in a brush coating operation to maintain a continuous flow of such solution with no variation such as might be caused by stagnate areas.
Figure 4:
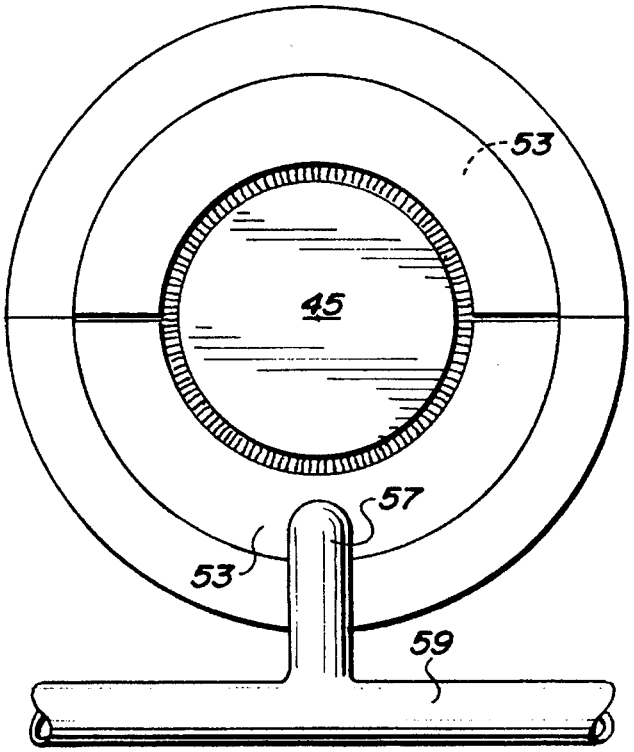
FIG. 4 is an end elevation of the electrolytic solution removal arrangement shown in FIG. 3.
Figure 8:
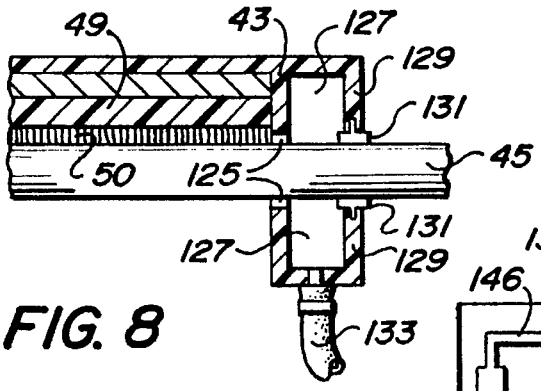
FIG. 8 is a diagrammatic view of an alternative arrangement for isolating the brush plating arrangement of the invention from the surrounding environment while at the same time allowing completely free flow of the brush plating solution past the coating area while acted upon by the current density of the invention.

As will be understood, merely removing the gasket 47 on both sides and allowing the solution to escape freely from the chamber, while it dramatically increases the efficiency of the coating operation and the quality of the coated product produced, also may have detrimental environmental implications due to the spilling out of the electrolytic solution into the surroundings. Electrolytic chrome solutions, in particular, have a significant tendency to form an objectionable mist, especially when warmed or heated. It is preferred, therefore, to provide auxiliary drain apparatus at the two ends of the coating apparatus assembly, as shown in FIG. 3, which is a side view of one end of a modified version of the coating apparatus of FIGS. 1 and 2. In FIG. 3, wherein the same reference numerals are used to indicate the same structures as already shown in FIGS. 1 and 2, there is shown a further auxiliary drain system 51 provided on both sides of the plating apparatus, only one of which drain systems is shown in FIG. 3, to freely drain away the coating solution and prevent it from evaporating into or otherwise contaminating the surrounding atmosphere. Such auxiliary drain system 51 may comprise various arrangements. However, in the arrangement shown in FIG. 3, the drain system comprises an arrangement wherein a hollow drain ring or chamber 53 is mounted on the side of the plastic flange 43 and a multiplicity of drain holes 55 are provided or bored through the plastic flange from the interior of the coating chamber to the inside of the circumferential drain chamber 53. The drain holes will also be seen to pass through the gasket 47 to allow free drainage of electrolytic solution from the interior of the coating chamber near the surface of the shaft 45 which is being plated. FIG. 4 shows a side view of such arrangement in which can be seen the drain chamber 53 extending circumferentially upon the plastic flange or plate 43 about the shaft 45 adjacent to the inner edge of the flange 43 of the coating assembly apparatus where it surrounds the shaft so that the drain passages 55 lead from a point adjacent to the surface of the shaft 45 from the interior of the apparatus into the circumferential drain chamber 53. An auxiliary solution drain 57 then conveys the used electrolytic solution collected in the circumferential drain chamber 53 and recirculates it back to a solution storage reservoir, not shown, where it is mixed with fresh solution material and recirculated after replenishment into the solution feed for the apparatus. As will be understood, the solution drain 57 may most conveniently be connected to and drained into a general manifold 59, see FIG. 4, which returns the solution to the reservoir and to any make up apparatus, not shown. The drain arrangement shown in FIGS. 3 and 4 is very effective in rapidly and efficiently draining away all excess solution from the coating chamber. It will also be understood, however, that other effective drain systems may be devised which will also effectively drain away all the solution fast enough so that there is substantially no dwell time of such solution within the coating chamber and the effect or result is substantially as though there was nothing preventing the solution from flowing freely from the ends of the chamber to the environment with no build up whatsoever of the solution within the chamber. A further alternative arrangement for draining the solution is shown in FIG. 8 described hereinafter. While it has been found that a central drain arrangement is undesirable, in general, and an end drain is preferred, it is believed that an efficient central drain might be designed including perhaps a special arrangement of grooves in the lower anode to effectively lead the used solution to the drain and proper venting in the drain to avoid air lock and the like.

A very important portion of the coating assembly shown in both FIGS. 1, 2 and 3 is the plastic felt-like lining 49 which extends completely around the interior of the coating chamber next to the surface of the workpiece which is to be coated. Such plastic felt-type material 49 into which the coating solution is directly flowed from the solution feed connection 25 effectively distributes the electrolyte solution and holds it, not only on the bottom of the coating chamber, but on the sides and top as well, in an even, moist condition which very effectively distributes the material about the coating chamber. The plastic felt material is preferably formed from a polypropylene material which is uneffected by chromic acid.

The inside of the anode 23, as explained above, is fluted or grooved to increase the ratio of the anode surface to the smooth workpiece surface and such fluting 24 is oriented to run longitudinally of the shaft. The plastic felt-like material preferably does not dip into the flutes, but instead passes across them, leaving channels through which the electrolytic coating solution may more or less freely flows towards the ends of the channels so it is quickly and easily distributed over the outer surface of the plastic felt and the felt is completely saturated by the solution.

Another important part of the interior configuration of the coating system is the use of a polypropylene brush material 50 upon the inside surface of the felt material 49. Such polypropylene brush material 50 serves to continuously brush or rub the surface of the workpiece rotating within the chamber to remove bubbles of hydrogen which otherwise may form on the cathodic surface and block the ready access of the coating solution to the surface as well as to generally remove any solution derived particulates or the like which may form as contaminants upon the surface of the coating. The plastic felt material 49 is, as indicated, also formed preferably of polypropylene in order to be uneffected by the chromic acid in the bath. The plastic brush material 50, while adjacent to the plastic felt material 49, may constitute a separate layer so there are two separate layers in contact with each other or each may constitute different parts of a single structure having a felted-type texture in the inner portions next to the lead anode and a brush-type structure in the outer portions next to the cathodic workpiece. In either case, there must be access orifices in any barrier between the two layers to allow free flow of electrolyte from the felted-type material to the brush material against the workpiece. It is necessary that the plastic felt-type material 49, which may in some cases take the form of an open cell plastic foam-type material through which liquids may easily migrate from one portion to another, serve to quickly conduct the coating solution in an even layer about the metal piece being coated and to hold an even supply of coating electrolyte at all times adjacent to the surface of the workpiece, or more properly the brush section 50, which is saturated with the electrolyte so that the workpiece is at all times entirely surrounded by and immersed in such electrolyte. The felt-like material 49 may also be a true felt-type material formed of a polyolefin such as preferably polypropylene or other suitable plastic or polymeric material. Such felted material may be formed of matted polypropylene or other suitable polyolefin fibers.

During operation, the plastic brush-type material 50 continuously brushes the surface of the workpiece to make certain that no bubbles build up or collect to obscure the surface from the coating action of the electrolytic solution. It is important not only that the brush-type material be unaffected by chromic acid, but that it also be strong and wear-proof as well as having a minimum tendency to snag upon a rough surface of the depositing chrome.

It is also important, although not necessarily critical, to the present invention that the surface of the anode be electrolyzed prior to the beginning of the plating operation. This may be accomplished by placing the anode initially in a bath of the electrolyte and passing direct current through the anode for about two hours. This forms a chromium oxide surface on the anode and renders it essentially impervious to the solution and any changes during the actual coating operation. In effect, the surface becomes a chrome-lead surface which may operate for long periods in the bath without significant change in surface characteristics.

It is convenient in practicing the invention for the workpiece to be a round workpiece such as a shaft or the like, since it is easy in such instance to make certain there is continuous movement between such shaft and the surrounding electrode, as well as to ensure that all portions of the shaft to be coated are substantially continuously opposed by sections of the anode at all times. However, the present invention is also operative with other than round workpieces, for example, with flat workpieces.

Figure 5:
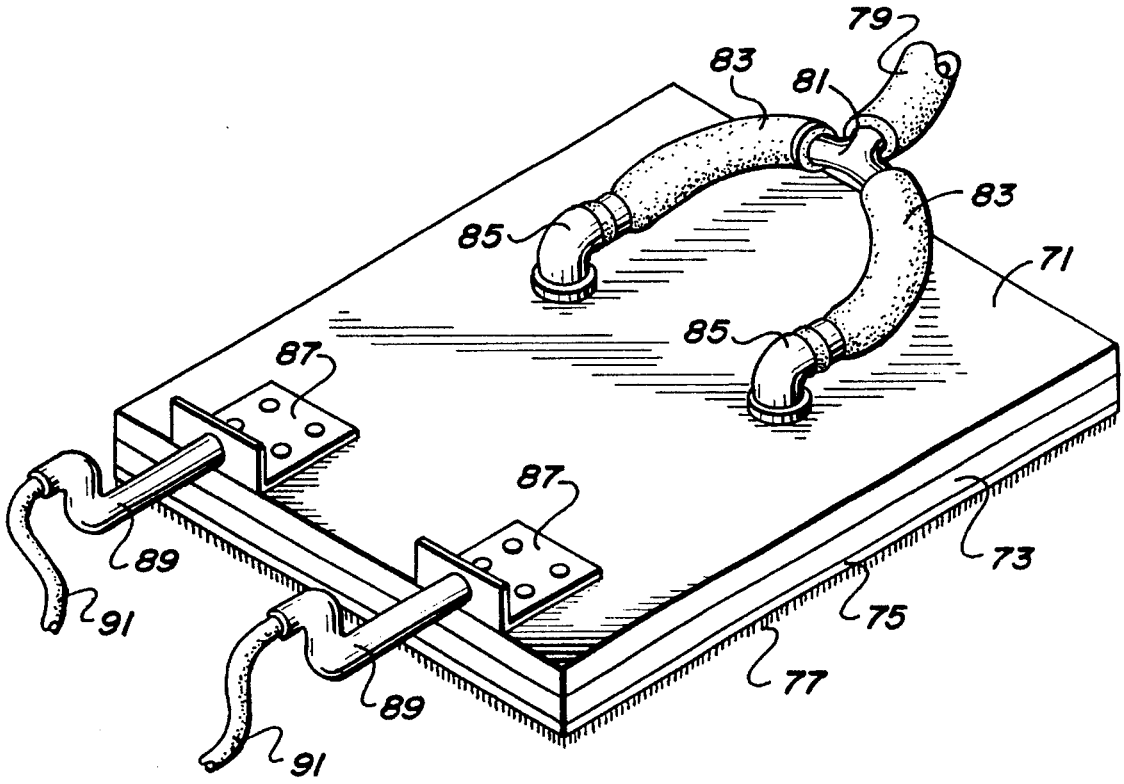
FIG. 5 is an isometric view of an arrangement for practicing the invention on a flat surface.

In FIG. 5, there is shown an arrangement for coating flat sections of a metal workpiece, in which a plate 71 formed from plastic or the like is attached directly to a lead-tin anode 73 which in turn has a plastic resin or polypropylene felt-type material 75 attached to its surface and a polypropylene brush-type material 77 attached to the lower portion of the polypropylene felt material. A solution feed line 79 leads from a source of electrolytic coating solution, not shown, to a Y-section 81 where the feed is divided into two separate lines 83 which are connected by fittings 85 to two locations on the top of the plastic plate 71. Fairly close to these inlets for the coating solution are two stainless steel or copper connectors 87 which are connected by stainless steel bolts through the plastic plate 71 to the lead tin anode 73. Electric connections 89 may be in the form of plastic tubes which may serve also as insulated handles through which lead wires 91 from a power source pass to the connectors 87. It will be understood that the insulated handle sections 89 may actually be longer and/or heavier in order to provide a good grip for the operator, who basically holds the plate or anode apparatus and continuously moves it over an underlying workpiece during coating. Alternatively, other suitable handles may be used or other mechanical movement apparatus may be provided.

It will be understood that during operation of the apparatus shown in FIG. 5, the coating solution enters the plastic felt material 75 via the coating solution connections 85 and fluting or grooves on the surface of the anode, which fluting also serves to increase the anode to workpiece surface ratio, and is quickly spread out across the bottom of the plate contained evenly in the felt material and between the plastic bristles of the brush material and essentially filling the space between the material to be coated and the anode 73. Used electrolytic solution will flow freely from the sides of the plate 71 assuring that at all times there is a fresh solution of material flowing not only in the plastic felt or sponge material 75, but also between the bristles of the brush material 77 from the connectors 85 towards the edges of the plate. It may in some cases be advantageous to provide a round or curved exterior to the plate 71 so that the edges of the plate are always equidistant from the solution entrance fittings 85 to provide an even flow of electrolytic coating material across the plate at all points. However, it will be understood that the distribution of the fluting or channels on the surface of the anode can be arranged also to obtain an essentially even distribution of coating solution regardless of the exterior shape of the anode.

It will be understood that while the arrangements shown will provide an even flow of material with a resulting very excellent coating function, one disadvantage is that the electrolytic solution ends up on the outside of the apparatus possibly causing misting as well as other possible air pollution effects. This detrimental effect can be avoided in various manners such as, for example, by providing a continuous drain along the outside of the plate having a gasket or squeegee-like moving dam which will contact the upper portion of the plate maintaining the electrolytic material within the confines of the drain defined by the gasket or squeegee. In a preferred arrangement, there may be a solution circuit which draws the electrolytic material from the surface of the material being plated into a solution circuit and returns it to a reservoir where it is mixed with fresh solution and/or replenished and recirculated back to the plate. Such an arrangement is shown in FIG. 6 described below, which briefly illustrates an arrangement having a drain about the surface of the plate in a position to drain all free material passing from under the plate into the drain portion and remove it for return to a feed tank.

Figure 9:
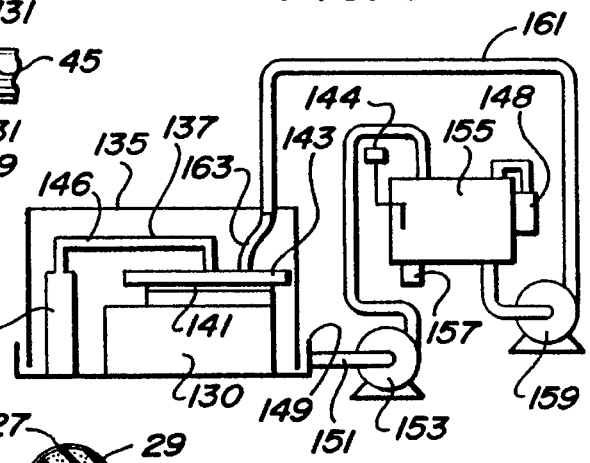
FIG. 9 is a diagrammatic view of an alternative arrangement for isolating the apparatus and process of the invention from the environment.

The above described arrangement can only be used where the relative area of the plate as a whole, and the portion of the plate which is to be plated are sufficiently disparate in size or area and the portion to be plated is sufficiently centralized so the movable drain portion does not move off the side of the plate. Also, since the surface of the plate which is by necessity to be exposed to the plating solution, but not plated, is usually masked by shielding tape, the surface may not be conducive to the passage of gaskets across such surface. However, the principle that the operation must, of necessity, be isolated from the environment is illustrated by the arrangement shown in FIG. 6, even though it may be applicable only in specialized instances. A more practical arrangement in most cases, at least for small operations, involving the use of a shielding tent, is shown in FIG. 9.

Figure 6:
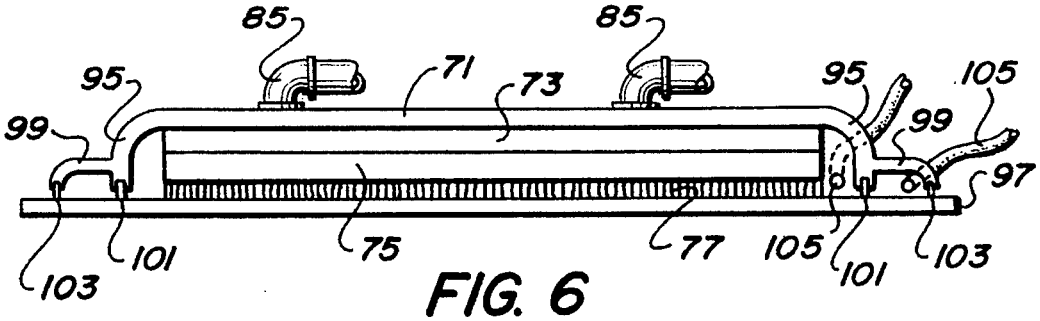
FIG. 6 is a side elevation of the arrangement shown in FIG. 5 including, partially broken away, a further arrangement for continuous removal of plating solution from the brush coating theatre of operations.

Since, in accordance with the present invention, it is important, in order to produce the best quality product, that the anode be maintained substantially continuously adjacent to all parts of the workpiece to be coated so that the parts are continuously exposed to a constant current density and there are no substantial interruptions in the coating operation which will cause thin or defective chrome plating to form rather than the hard dense heavy chrome deposit which is sought, it is necessary in an arrangement such as shown in FIGS. 5 and 6 for the coating plate to be larger than the section of the material which is to be coated. Preferably, the anode should be at least 1.5 times as large as the area to be coated or plated and may desirably be as much or more than 2.0 times as large as such area in order to make certain that as the anode is moved continuously the surface of the workpiece is constantly stroked with the brush processes in the area to be coated in order to continuously and completely dislodge any bubbles which might interfere with coating. In other words, the anode must be large enough so that it can be moved to the side without passing from over the top of the section of the workpiece which is to be coated. Since it is desirable for the movement of the anode to be more or less random, or at least not in a straight back-and-forth motion, such additional area is desirably provided on all sides of the anode so that a 50% increase in area actually does not provide a great deal of additional area on any one side.

It is also important that the surface of the anode be fluted to produce at least a 1.5 to 1 ratio of the surface area of the anode to the surface area which is to be coated. Even higher ratios may be desirable. As indicated above, this same ratio also applies with respect to the apparatus shown in FIGS. 1 and 2. This reduces the formation of trivalent chromium in the plating solution which is undesirable in a hexavalent plating operation. The same would be true, however, in a trivalent plating solution where it would be desirable to avoid the formation of hexavalent chromium in the coating solution. Normally, the differential movement between the cathodic workpiece and the anode will be provided by regularly moving either the workpiece or the anode and attached brush sections relative to the other members by some mechanical movement engendering device.

FIG. 6, as indicated above, shows a side view of a modification of the arrangement shown in the isometric view of FIG. 5. In FIG. 6, the same central dielectric plate section 71 with a lead anode 73 attached directly to it and to which in turn is attached a plastic felt material 75 and finally a plastic brush material 77, is shown as is also shown in FIG. 5. Two fittings 85 are shown for providing electrolytic coating solution to be applied to the plastic felt material 75. It will be understood that the embodiment shown in FIG. 6 is square like the embodiment shown in FIG. 5. However, as indicated above, the outer shape of the material could also be curved so as to provide a more or less equal distance to the edges of the coating plate from each one of the solution inlets. This has advantages in assuring equal dwell times of the electrolytic solution between the surfaces of the workpiece and the anode surface at all times.

In addition to the parts shown in FIG. 5, there are also shown in FIG. 6, solution drain sections 95 which are curved sections curving from the top of the plastic plate 71 toward the surface of the workpiece 97 with a squeegee-type gasket arrangement 101 on the end of such sections 95 contacting the surface 97 of the workpiece. These sections 95 form in effect, tubular drainage sections about all the edges of the coating plate apparatus. A further tubular section 99 is shown to the outside of the section 95. Section 99 provides a further drainage section which is designed to take up any liquid which may escape through the squeegee-type sponge or sponge-type gaskets 101 on the bottoms of the sections 95. It will be understood that the sections 99 also are provided with similar squeegee gaskets 103 which prevent the liquid electrolytic material from flowing outwardly of the sections 99 so that no electrolytic material is exposed to the atmosphere where it might cause fumes, mist or other toxic conditions. Drains in the form of forced drains 105 lead from the two chambers 95 and 99 or, more particularly, the volume within the members 95 and 99, and the solution picked up in such drains is pumped to a central heated reservoir, not shown, where it may be mixed with back up solution and returned to the coating apparatus through the inlet fittings 85. Alternatively, and even more preferably, a gravity drain could be arranged to remove used electrolytic solution. As indicated above, the arrangement of FIG. 6 is useful only in certain instances and a more widely practical arrangement is shown in FIG. 9 for example.

Figure 7:
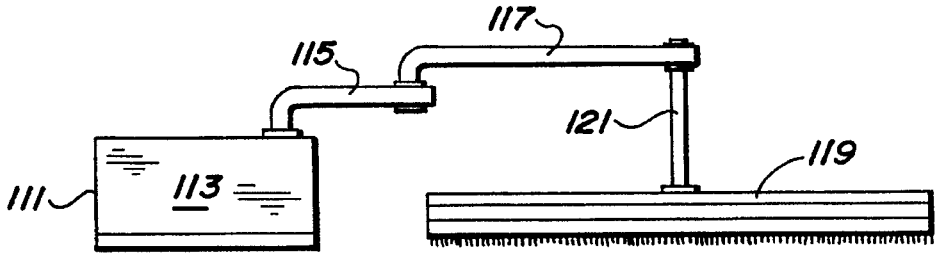
FIG. 7 is a side elevation of a means for continuously moving the apparatus shown in FIGS. 5 and 6 to obtain continuous movement of the brush coating anode over the surface of the metal piece being coated.

FIG. 7 is an illustration of a mechanical device for moving the plates shown in FIGS. 5 and 6 continuously in a varying pattern in order to attain or maintain continuous movement of the plastic brush elements against the plating surface to prevent the build up of any gaseous hydrogen or the like. As indicated above, the device is shown basically diagrammatically to illustrate the principal rather than the exact device. It will be understood by those skilled in the art that there are various of these devices made by several manufacturers to provide a continuous movement of one workpiece or element with respect to a second workpiece or element. Usually the differential movement provided is a figure eight or modified figure eight-type pattern. In FIG. 7, a base 111 will be understood to contain or support a motor illustrated schematically as 113 from the top of which a rotatable or, alternatively, a reciprocal arm 115 extends and on the end of which arm 115 there is a second arm 117 which, it will be understood, is usually maintained in one orientation, but which may also be reciprocated from side to side by a suitable mechanical arrangement. A coating plate 119 which, as will be understood, is similar to the coating plates shown in FIGS. 5 and 6, is attached by an arm 121 to the arm 117. It will be understood from the sketch shown in FIG. 7 that as the two arms 115 and 117 continuously travel in an arcuate pattern or in some other pattern with a reciprocable motion, that the plate 119 will be moved into various positions with respect to the base 111, depending on the relative position of the two arms with respect to each other. As a result of the rate of rotation or partial reciprocable or arcuate motion of the two arms, the motion of the plate, although regular on a long term basis, will, on a short term basis, be irregular following a different pattern of movement from minute to minute.

As indicated and explained above, the anode should, if the best quality product is to be made, never be brought for other than an insubstantial time beyond the area of the workpiece which is to be coated with a hard chrome coating, else the deposition of the chromium will be interrupted resulting in either a defective or thin chromium coating or plating rather than a hard thick chromium coating as desired. Once the plating operation entirely stops for more than a second or two or even occasionally a fraction of a second, it cannot be restarted except by starting over from the beginning including reactivation of the electrolyte. In order to obtain a reasonably thick hard chrome deposit, therefore, it might be necessary to restart the plating operation ten or more times, which is completely impractical. In the usual brush plating operation, on the other hand, it is customary to have substantial though usually fairly brief times when the area of the workpiece to be coated is not completely covered by the anode, no special precautions being taken and, in fact, in the plating of shafts it is the normal practice to use a discontinuous electrode in order to obtain an easier matching of the electrode surface to the curvature of the shaft. It has been found by persistent experimentation that this is not substantially possible when plating with a hard chromium deposit, however. As indicated above, while the exact reason the deposition of a hard chrome coating requires continuous effective anode contact with the surface to be coated is not known, it is believed or theorized that the lower conductivity of a chrome plating solution requires the substantial continuous opposition of the anode with the surface to be coated to prevent the surface from becoming passivated or being inactivated by the coating solution when no significant current or potential is active between the two. While such passivation is not instantaneous and is a matter of degree, it may occur very rapidly under the right conditions and is to be avoided, if possible, at all costs.

It will be understood, therefore, that the anode cannot at any time during the plating process pass substantially beyond the area of the workpiece which is to be coated with a hard chrome coating, else the deposition of the chromium may well be interrupted, resulting in a defective or thin chromium coating rather than a thick hard chromium coating, as desired. It will be understood, therefore, that the size and swing of the arms 115 and 117 will be adjusted so that the movement of the plate 119 at any given moment will never bring any portion of a work surface which is to be coated with a hard chromium coating substantially beyond the position of the surface of the lead anode or, more precisely, will not bring the electrolyzed surface of the lead anode beyond any portion of the area of the workpiece which it is desired to coat or plate with hard chromium. As indicated above, this relationship is extremely critical, since it is important that the same substantial current density be maintained continuously during coating between the coating anode and every portion of the workpiece surface which is to be coated with the hard chromium coating.

FIG. 8 is a side illustration partially broken away of a very practical and somewhat preferred alternative arrangement for assuring a rapid even removal of coating electrolyte from the ends of a shaft being coated in accordance with the invention. In FIG. 8 the ends of the plastic flange 43 extend to within a half inch or so of the surface of the shaft 45 being coated and adjacent to the plastic felt 49 formed preferably of polypropylene or other suitable polyolefin or other plastic resin and the similarly formed bristles of the brush section 50 leaving an opening 125 through which the solution may freely pass into a circumferential drainage chamber 127 about the surface of a shaft 45. The circumferential drainage chamber 127 is formed by an arcuate or other shaped shield member 129 having a suitable circumferential gasket 131 on the lower or outer end contacting and sealing with the surface of the shaft 45 to prevent escape of electrolytic solution as a vapor or mist to the environment. A drain line 133 is provided to rapidly drain the electrolytic solution from the circumferential chamber 127. It will be recognized that the arrangement shown in FIG. 8 is essentially an adaptation of the drain system shown in FIG. 6 for a flat member or workpiece to use with a round or cylindrical workpiece. Such an arrangement is more practical in general to use with a shaft because the contact area of the shaft with the confining gasket is not usually encumbered with masking or thieving tape and there is no edge of the workpiece for the gasket to pass beyond. The anode 23, felt-like material 49 and brush-like material 50 are shown only on the upper side of the shaft 45 in FIG. 8, but it should be understood that such anode and anode wrap material extend completely around the shaft and would appear, therefore, also on the lower side of the shaft.

FIG. 9 is a diagrammatic view of an alternative and somewhat old fashioned, but still effective, arrangement for brush coating with an unrestricted flow of electrolytic coating solution. In FIG. 9 a tent or flexible moisture shield 135 has been erected over a brush plating arrangement 137 including a support 130, a flat workpiece 141, an anode plate 143 with a lower anode wrap material, not shown, and a variable movement mechanism 145 which supports and moves the anode plate 143 through a rotatable or reciprocatable arm 146. The entire apparatus sits or rests in a drain pan 149 which has a drain 151 leaving one side and entering a centrifugal pump 153. The centrifugal pump 153 pumps the electrolytic fluid drained from the drain pan 149 to a heated reservoir and make-up tank 155 which is heated by a convection heater 157. The fresh or readjusted electrolytic solution is then delivered via centrifugal pump 159 and rigid feed conduit 161 plus flexible feed line 163 to the anode plate 143, which, it will be understood, includes a support plate, a lead anode, a plastic felt material and a plastic brush section; all as described previously in connection with earlier figures. The use of a centrifugal pump 153 to remove electrolytic solutions from the drain pan 149 is shown as one alternative and for convenience of illustration only, since in most actual arrangements the reservoir and make-up tank 155 would be located at a lower level than the drain pan 149 and used electrolytic solution would discharge into the reservoir 155 by gravity.

The chromic acid content of the electrolytic solution may preferably be in a range of about 20 to 30% and preferably about 25% $CrO_3$ and it should contain about 0.25° $H_2SO_4$ and be maintained at a temperature of about 130° to 150° Fahrenheit or preferably about 140° F., or 60° C. As indicated previously, the current density is preferably maintained at between 2.5 to 3.5 amperes per square inch of anode contact area at a voltage of about 8 to 10 volts. The sulfuric acid content can vary between about 0.2% and 0.3% $H_2SO_4$. There are various proprietary and commercially available chrome coating solutions which may be used. Ordinary tank plating solutions are usable with the arrangement of the invention and special brush plating solutions are not required. Special commercially available analysis apparatus 144 to continuously monitor the analysis of the electrolytic solution and replenish apparatus 148 to bring the analysis back into a prdetermined balance is diagrammatically shown mounted upon the make-up tank 155.

Figure 10:
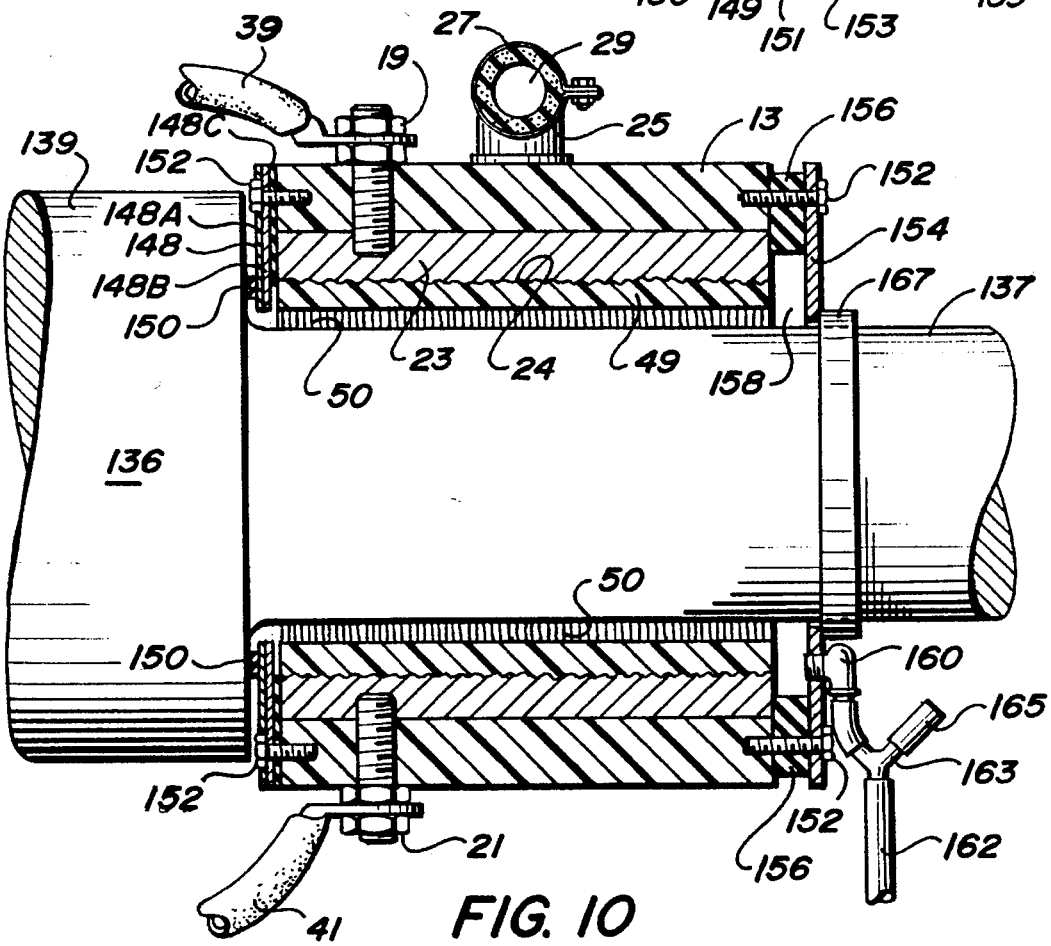
FIG. 10 is a broken-away side elevation of an apparatus for practicing the invention upon a journal of a roll close to the roll body.
Figure 11:
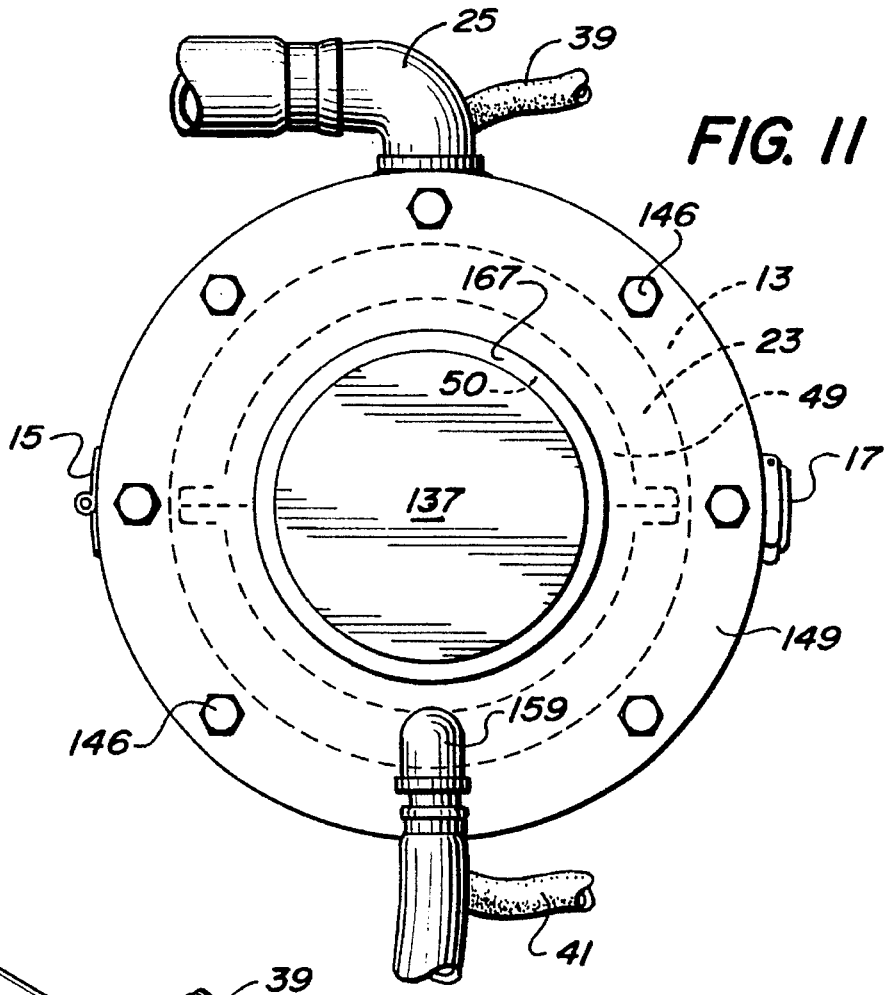
FIG. 11 is a partially broken-away end view of the apparatus shown in FIG. 10.

It is frequently desirable to chrome plate the journal of a roll or a portion a journal of a roll close to the main or working portion of the roll, i.e. to the roll body. In such case, the arrangement for draining the used electrolyte shown in any of FIGS. 1, 2, 3 and 8 will not be possible at one end of the coating apparatus, since the anode 23 must be moved very close to the enlarged central working section of the roll. In such instance, however, the electrolytic coating arrangement shown in FIGS. 10 and 11 has been found to be very practical. In FIGS. 10 and 11, the same reference numerals have been used to designate the same structures as in the previous figures. In FIG. 10, a lead anode 23 corrugated or fluted on the inner surface is provided with a polypropylene felt material 49 over the surfaces of the anode adjacent to the top surfaces of the flutes 24 upon the anode surface and a plastic brush material 50 extends over the outer surface of the plastic felt 49. As indicated previously, these plastic resin members are preferably made from polypropylene which is unaffected by chromic acid and related corrosive chromium compounds. The anode 23 is contained within a dielectric casing 13 and is mounted over a journal 137 of a roll 136 having a main body section 139 which is considerably larger than the roll journal 137. The plastic casing 13 has at the end adjacent the roll body a plastic cap plate 148 which closes off this end of the casing, except for the short section of the journal 137 which extends through such cap plate. The plate 148, which as shown is composed of two longer somewhat flexible adjacent members 148A and 148B and a shorter resilient gasket member 148C, is provided at the lower or inner end with a narrow ribbon or hoop-type seal 150 extending about the journal 137 and preferably secured or sealed to the edge of the plastic cap plate 148 about the orifice, not shown, in the plastic cap plate 148 through which the journal 137 extends. The other edge of the ribbon or hoop seal sealingly contacts the edge of the roll body 139 on the opposite side so that the escape of liquid in the small clearance between the roll body 139 and the outside of the plastic cap plate 148 is prevented. As indicated, there is insufficient space between the anode apparatus and roll body to allow the convenient use of an actual drainage arrangement at this end of the anode apparatus. The plastic cap plate 148 is preferably securely attached to the plastic casing 13 by screw, bolt, or other threaded fastenings 152 shown entered into the casing 13 in the cross sectional portion of FIG. 10.

At the opposite end of the casing 13, there is shown a second heavy section plastic cap plate 154 which is also attached to the plastic casing by suitable threaded fastenings 152. Such threaded fastenings extend through a circumferential end gasket 156 having a substantial section which spaces the cap plate 154 from the end of the plastic casing 13 by the thickness of the end gasket 156. The space between the second cap plate 154 and the anode 23 as well as between the cap plate and the plastic felt material 49 and plastic brush material 50 is completely open and serves as a free-flow drainage opening or chamber 158 at the one end of the anode apparatus into which used electrolytic solution can flow to maintain a rapid flow of solution from the end of not only the brush material 50, but from the plastic felt material 49 and also the flutes 24 indicated diagrammatically by a broken line in FIG. 10. At the bottom of the drainage chamber 155, there is provided a drain fitting 160 extending through the end cap 154 preferably more or less opposite the end of the anode 23. Connected to the drain fitting 159 is a solution drain 162 provided with a "Y" fitting 163 with a vent section 165 which vents the drain and prevents the system from becoming air-bound and possibly preventing free flow of the electrolytic solution from the drainage chamber thereby possibly allowing depletion of the metallic values of the electrolytic solution and detrimentally affecting the chromium plating operation.

Since the drain chamber 155 is positioned only at one end of the anode apparatus, it is desirable to establish a flow of electrolytic solution from the other end of the anode apparatus to prevent the solution from becoming stagnant at that end. In order to attain a straight-through flow, therefore, the solution feed fitting may even more preferably be provided at the far end of the anode or brush coating apparatus 11 rather than in the center as shown. However, it will be understood that various arrangements of the flutes 24 at the surface of the anode and next to the plastic felt material may be used which might conduct the electrolytic solution generally on a complete circuit from the solution feed to the solution drain chamber. It is very desirable, however, that no "dead areas" occur where drainage of the solution is impeded and where depletion of the chromium content may occur interfering with proper chromizing of the workpiece. The upper power feed 19 and bottom power feed 21 may be positioned at various convenient locations, since the charge of the electrode 25 is, in general, evenly distributed over at least most portions of the electrode.

A suitable tight fitting circumferential seal 167 is provided over the journal 137 of the roll 136 with its side abutted against the outside of the cap plate 154. The seal 167, which is removable, is positioned tightly against the surface of the cap plate 154 to prevent electrolytic coating solution from flowing from the opening, not shown, in the plate through which the journal 137 extends. The seal 167 rotates with the journal 137 while the anode apparatus is held stationary over the journal providing the necessary relative movement between the journal and the anode and particularly the polypropylene brush to provide the necessary continuous brushing of the surface of the journal being chromized.

It will be understood that if the workpiece being coated was a straight shaft or substantially a straight shaft rather than a journal of a larger roll body, an anode coating chamber similar to that shown in FIGS. 10 and 11 could be used while incorporating a drain chamber at both ends rather than just one end and having the solution feed fitting 25 essentially positioned in the center of the apparatus more or less midway between the solution drain chambers at both ends.

It should be noted that rolls and the like may have journals or shafts having various diameters as well as a larger central roll body. The anode arrangement shown in FIGS. 10 and 11, therefore, is equally usable with all such unequal sized journal arrangements where the brush coating anode may by necessity be required to be essentially butted up against a larger diameter section on one side while repairing or coating the surface of a smaller section of the journal.

Figure 12:
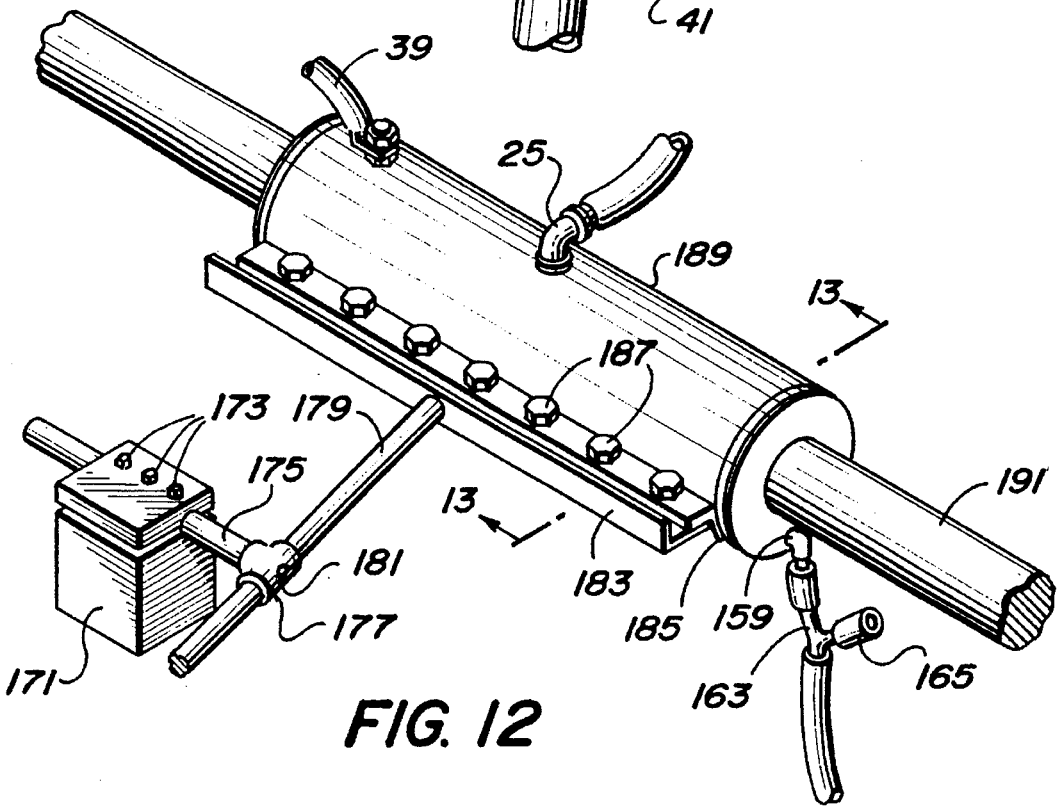
FIG. 12 is an isometric view of a holding or support arrangement for mounting of the apparatus of the invention on a shaft being repaired by brush plating.
Figure 13:
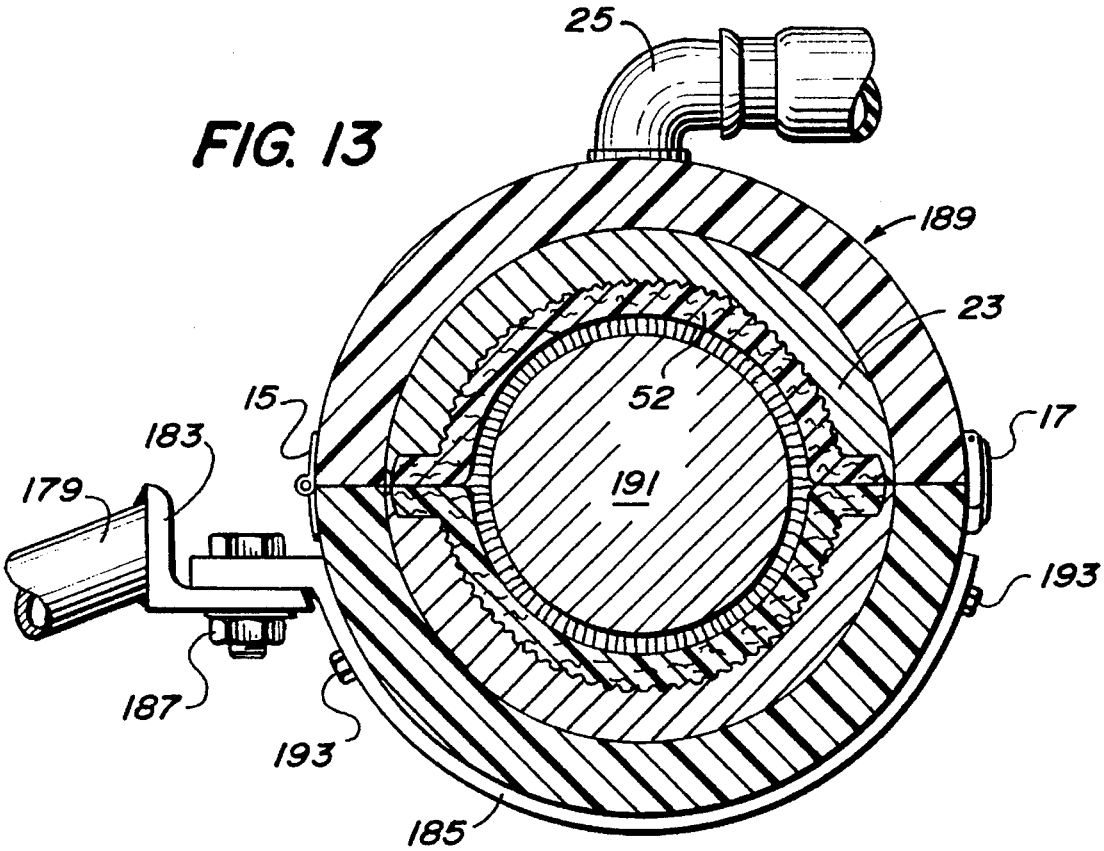
FIG. 13 is an enlarged end view of the clamp apparatus shown in FIG. 12 at the end of the clamp arm showing how the anode apparatus is mounted upon the clamp including a cross section through a coating apparatus in accordance with the invention.

FIGS. 12 and 13 illustrate diagrammatically a convenient and very practical arrangement for mounting an anode coating apparatus in accordance with the invention for coating a rotating shaft or the like. It is frequently convenient when brush coating a shaft or the like to rotate such shaft in a lathe apparatus or sometimes a grinding apparatus having appropriate capacity to mount and rotate the piece. All lathes are provided with a tool post for support of tools and the like during shaping of sections in or mounted on such lathes. Such tool post, therefore, provides a convenient support for the usual coating apparatus in accordance with the invention. In FIG. 12, there is shown a tool post 171 of a lathe, not shown. A series of heavy bolts or set screws 173 are arranged to bear against a rod or pipe such as a 2-inch pipe section 175 and hold such pipe section stationary with respect to the tool post. At the end of the clamped pipe 175 is a T-fitting 177 with the pipe 175 screwed into or otherwise attached to the center of said fitting 177 and an open bore across or through the top into which a second rod or pipe 179 may be slidingly inserted. A set screw 181 in the center of the T-fitting 177 may serve to stabilize the pipe 179 at any longitudinal position. On the end of the pipe or rod 179 there may be welded a support section in the form of a crosspiece 183 having a series of mounting holes or orifices which may be used to secure an anode support cradle 185 to the cross piece 183 either by means of threaded fastenings 187 or by means of other suitable fastenings. See FIG. 13 in particular. The anode chamber or assembly 189 is closed over a shaft 191 to be coated, which, as indicated, may be supported in an industrial lathe or the like. In such an arrangement, most of the weight of the anode assembly is actually supported by the lathe, or lathe chucks, not shown, through the workpiece shaft, while the remainder of the weight of the anode assembly and holder is supported by the tool post through the mounting attachments. The weight of the anode chamber, furthermore, may be easily counterbalanced, if necessary, by a counterweight, not shown, provided on the opposite end of the supporting pipe or rod 179. The anode chamber 189 may be conveniently secured to the anode support cradle 185 by set screws 193.

Figure 14:
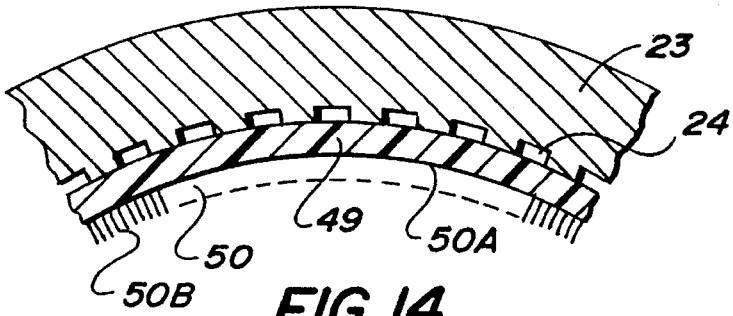
FIG. 14 is an enlarged sectional view through the absorbent plastic felt and brush arrangement of the anode wrap as it lies against a circumferential or arcuate anode surface.

FIG. 14 is a side or sectional view through an arcuate anode 23 showing more clearly the fluted or splined inner surface against which the anode wrap 52 is disposed. Such anode wrap is, as explained elsewhere, comprised of a first felted plastic material 49 and a second plastic brush element 50. This is shown in FIG. 14 as a brush element comprised of a perforated plastic backing 50A having bristles 50B extending away from it on the opposite side of the backing from the felted material. Flow orifices 50C shown more particularly in FIG. 15, extend through the backing 50A to provide openings for flow of electrolytic coating solution from the absorbent felt material 49 to the bristle area of the plastic brush 50. The bristles 50B preferably extend in rows somewhat closer together in one direction than the other. The perforations or flow orifices 50C, on the other hand, are usually more or less randomly spaced, although they can be regularly or evenly spaced in a pattern.

FIG. 16 is a cross section of an apparatus for practicing a modified form of selective plating to attain a hard chrome coating in accordance with the invention which does not utilize the customary fibrous or porous plastic material to bring electrolytic solution to the surface area to be coated and does not make use of a fibrous brush material to brush the surface to remove hydrogen bubbles and break off dendritic material, but instead, uses solid wiper blades to accomplish the same purpose. The operation, however, is analogous to brush plating in operation and results, although more analogous to tank plating in concept and apparatus. It can reasonably, therefore, be referred to as selective plating. In FIG. 16, a shaft 201, having a surface or a portion of a surface to be electrolytically hard chromium coated is mounted within an outer plastic shell 203, similar to the outer shells 13 shown in previous figures. Such outer plastic shell 203 surrounds a substantially open electrolytic solution space 205 which extends between the shell 203 and the surface of the shaft to be coated 201. Within the electrolytic solution space 205 is mounted a grid-type electrode 207 comprised of longitudinal grid members 207 and transverse grid members 209. It will be seen that the longitudinal grid members have been bisected in the cross sectional view of FIG. 16, while the transverse grid members 209 can be seen beyond the bisection plane. Such grid-type electrode may be formed by an appropriate casting operation in the form shown more particularly in FIG. 17. Usually the grid-type electrode will be cast initially in a flat mold and will then be bent to the necessary curvature to closely surround the coating piece to be plated. The exact method of forming the grid electrode does not form a part of this invention.

The grid 207 is attached to bus bars 213 as shown in FIG. 16 through the intermediate electrode surfaces 215 and may also, if necessary, be supported at other places by insulated brackets, not shown. Mounted upon the electrode grid 207 at spaced points are so-called wiper blades 217, which are preferably mounted dependent from the anode 207, and bear against the surface 219 of the shaft 201. The wiper blades 217 are formed of a flexible or resilient plastic material resistant to degradation by chromium acid solutions and arranged to bear upon the surface 219 of the roll 201 preferably on the side of one end of the plastic wiper blade. The top of the plastic wiper blade 217 is preferably fixed in the grid of the electrode 207 by essentially a snap action provided by pressing integral snap sections 223 into appropriate orifices in the grid of the electrode 207 so that the upper portion of the wiper blade 217 is oriented towards the shaft 201, but is then deviated to the side by contact with the surface 219 of the shaft 201. The amount of pressure exerted upon the surface of the shaft as it rotates in contact with the end of the wiper blade, which is bent in the same direction as the rotation, is therefore related to the thickness of the wiper blade in the section of such blade extending from the surface 219 of the shaft 201 to the grid-type electrode 207. The preferable wiper blade thickness will be about 1/16 to 1/8 inch in thickness and the distance of the electrode surface from the grid, as indicated above, may be between 1/8 and 1/2 inch or up possibly to 1 inch, but preferably within the range of about 1/8 to 3/8 inch and preferably about 1/4 inch. Consequently, the length of the wiper blade should be approximately 1/2 inch, or in those cases where the spacing between the cathodic coating surface and the anode surface is greater than 1/2 inch may be correspondingly greater. The normal bearing of the wiper blade upon or against the surface of the roll will, therefore, be rather light and insufficient to burnish or polish the surface, but sufficient to detach any dendritic material extending upwardly into the bath from the cathodic work surface and to cause evolution of hydrogen bubbles from the surface. It appears that the evolution of the bubbles involves more than mere detachment of bubbles already formed, but also involves a coalescence of very thinly spaced minute hydrogen bubbles upon the surface as well as in the form of a thin cathodic film into first very minute bubbles and then rapidly, under the influence of the repeated contact with the wiper blades as the shaft revolves, into larger bubbles which are displaced from the surface of the roll and rise through the liquid. Such bubbles collect in the upper portion of the plastic sheath and may be discharged through the hydrogen collection, or take-off, pipes 221 at the very top of the casing 203.

Since the wiper blades are very thin and only the side of the end of the blade contacts the surface, only a minimum contact of the blade with the surface is involved so that a minimum interference with actual coating upon the surface occurs. Furthermore, since the wiper blades are very thin, in any event, and although they are made from a dielectric material, such blades have a very minimum interference with the electrical field between the anode and the cathodic work surface and thus minimum interference with the throwing power of the electric field during the coating operation. Preferably the top of the coating blade is made, or formed, as shown more particularly in FIG. 16A. It will be seen in FIG. 16A that the upper portion of the wiper blade is formed into a series of expansion-lock or snap sections 223 having outwardly expanded tops 225, which may be jam-fitted into the openings between the longitudinal and transverse sections 211 and 209 of the grid-type anode 207. This construction allows the wiper blades to be quickly interlocked with the anode grid and to be simply and easily removed when the wiper blades 217 become worn and need to be replaced by new wiper blades. Normally the wiper blade 217 will be made by stamping out a series of the blades with the expanded top sections already formed upon them. However, it will be understood that various sections or shapes of the portion of the wiper blade which holds such blade in place may be formed depending upon how it is desired to attach the wiper blade to either the electrode, i.e. the anode, or to some other portion of the apparatus.

In FIG. 16, two electrolyte inlets 227 are positioned near the bottom of the structure for passing fresh electrolytic solution continuously into the electrolytic chamber 205. Likewise, two outlets 229 are shown at the top where the electrolytic solution can flow from the electrolytic coating solution chamber 205. The outlets 229 are located near the top of the coating chamber, but displaced therefrom somewhat in order to leave the top portion free for the hydrogen outlet 221. It has been found advisable to inlet the solution near the bottom of the electrode chamber and to remove the used solution from the top so that the chamber will always be completely filled. As a practical matter, considerable hydrogen will leave by both routes, but more will escape through outlet 221.

Figure 17:
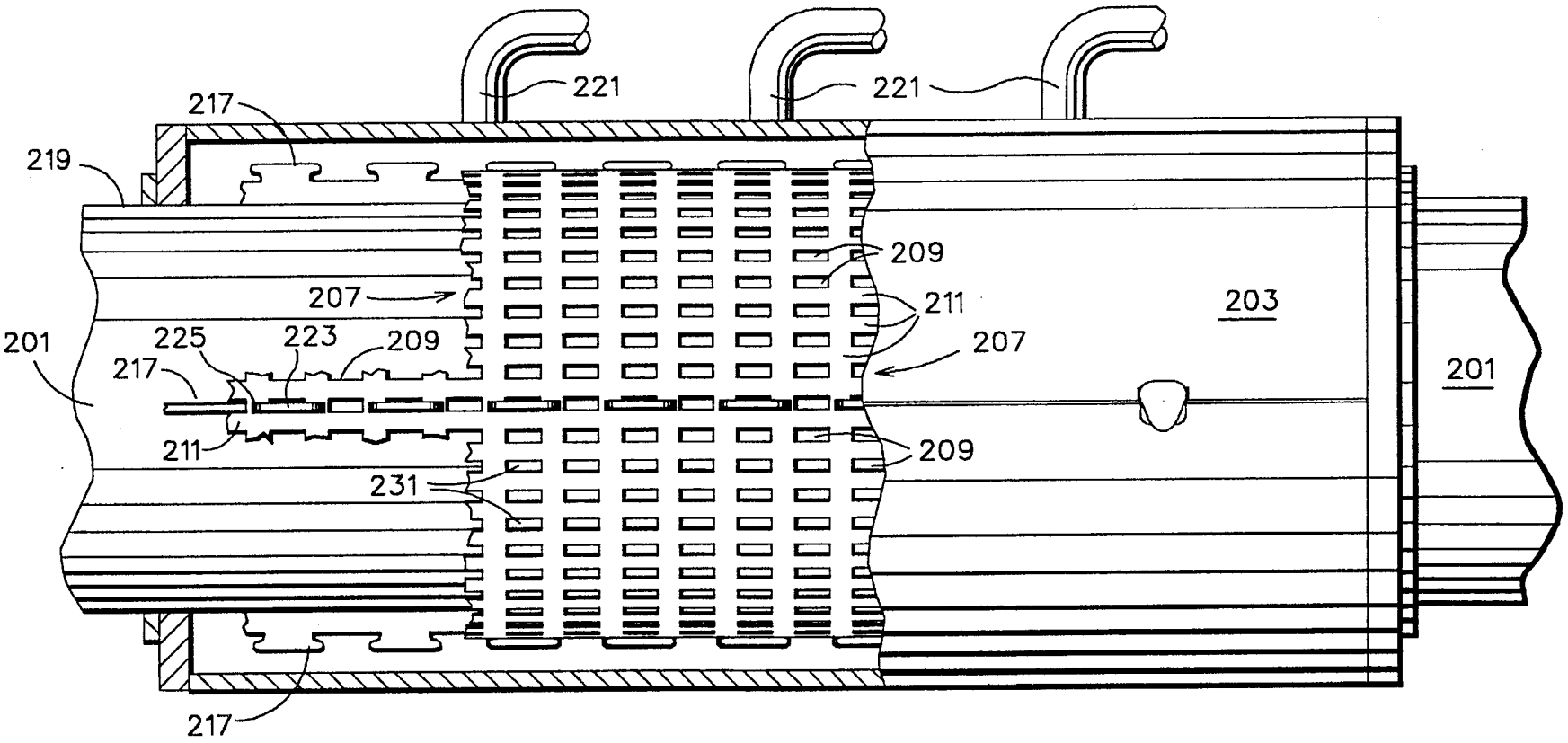
FIG. 17 is a partially broken-away side elevation of the preferred arrangement for practice of the invention shown in FIG. 16.

FIG. 17 is a partially broken away side elevation of the coating arrangement shown in FIG. 16. In FIG. 17, it may be seen that there are several of the hydrogen-removal passages 221 on the top. It has been found that the evolution of hydrogen from the action of the wiper blades 217 is extremely vigorous with a very large evolution of gas. Consequently, it is desirable to have adequate exhaust capacity for removal of such hydrogen, not only to prevent internal pressure from building up in the coating, but to eliminate the gas so it cannot occlude the cathodic work surface. It is believed, furthermore, that the thorough removal of hydrogen in bulk from contact with the electrolytic solution minimizes retention of a cathodic film on the cathodic coating surface.

It may be seen in FIG. 17 that the electrode grid is arranged essentially in line with the shaft surface. The electrode grid is shown partially broken away to the left to reveal the wiping blades 217 as well as the top expanded lock portions 223 of the wiping blades 217 which essentially fit, as seen, into the openings 231 between the grid pieces 209 and 211. In FIG. 17, the outer plastic sheath or shell 203 of the coating chamber is shown towards the right, but broken away in the center to reveal the electrode grid 207 thereunder. It will be noted in both FIGS. 16 and 17 that the wiper blades 217 are spaced essentially at 90 degree intervals about the shaft 201. This has been found to be about right where the shaft rotates during coating at a fairly rapid velocity. The wiper blades should be spaced so that bubbles of hydrogen, in particular, are wiped from the surface before any significant deposit has been allowed to form. Consequently, the spacing of the wiper blades will be dependent to some extent, upon the speed of the shaft and the rate of coating, since a higher rate of coating, occasioned by a high current density between the electrodes will also normally form more hydrogen by electrolysis of the coating solution. Consequently, if the revolution of the shaft is set to be rather slow, more wiper blades may be desirably spaced about the shaft. Likewise, if the shaft section is fairly small and rapidly rotating, less than the number of blades shown in the FIGS. 16 and 17 may be used. For example, for a small rapidly rotating shaft, it may be found that a single wiper blade on each side of the shaft may be quite adequate. For larger shafts, however, more frequent placement of the blades may be desirable. It is preferred to have at least three equal spaced wiper blades to aid in centering the anode about the cathodic work surface unless both are otherwise securely fixed in place.

Since it it is frequently difficult to form an adequate seal about the surface of the member being coated where it is necessary for such member to extend from the coating chamber or where a rotating shaft or other movement engendering means must extend through the wall of the coating chamber to cause movement of the cathodic work surface, or, alternatively, movement of the anode about the cathodic work surface, difficulty in effectively sealing the electrolytic solution within the coating chamber may be encountered. It has been found preferable, therefore, in those instances where applicable, to use an apparatus such as shown in FIG. 18 where the coating is accomplished within a vertical tank having closed sides and bottom, but open on the top where the material to be coated can be passed into the tank between the sides of a grid-type electrode, preferably as shown, by any suitable hoisting means, and then rotated within the anode to effect electrolytic coating of the cathodic surface of the workpiece. In FIG. 18, an in-ground tank 231 is shown sunk below the surface 233 of the ground or the floor of a shop. The tank may be in a pit and will preferably be surrounded with at least one additional safety tank, not shown. A grid-type electrode 235 is suspended in the tank 231 by any suitable support means, not shown. The grid-type anode 235 is shown in cross section so that only the horizontal members 237 of the grid-type electrode 235 are shown in section. However, both horizontal members 237 and vertical members 239 are shown in the background between the edges of 2 wiper blades 241, which extend vertically along the grid and are locked into the grid by the expanded locking sections 243.

A roll or shaft 245 is shown supported by a grip or chuck 247 of a crane arrangement, not shown, and the roll or shaft 245 may be rotated by a rotational mechanism 249 mechanically attached to the chuck 247. During operation of the coating process of the invention, the shaft 245 will be supported by the chuck 247 which is attached to the beam 251. This beam 271 can, as shown diagrammatically, be supported during coating upon the beam supports 253 on the shop floor and the shaft 245 rotated, by means of the rotating mechanism 249, within the grid-type anode 235 with the wiper blades 241 bearing lightly upon the surface of the shaft 245 to both remove bubbles of hydrogen and also sever and remove outwardly growing dendritic material extending from the coating surface.

Since the tank 231 will be maintained completely full of electrolytic solution, the bubbles of hydrogen will rise, due to their minimum specific gravity to the top of the tank 231 and may be removed through the outlets, or offtakes, 255 which, as may be seen in FIG. 18, are attached to the highest portions of the top 257, which portions, for convenience, are provided on the outside to form an internal collection ring or zone 259 within the closed top 257 of the tank 231. Any suitable seal 261 may be provided between the closed top 257 of the tank 231 and the side of the round chuck 247, as shown more particularly in FIG. 18A described hereinafter. The seal 261 does not need to be extremely tight, since some escape of hydrogen through such seal is not critical and moisture in the gas does not tend to pass through the seals, since there is no head of liquid forcing itself against the seal. Usually fume suppressants will also be used in the electrolyte. It will be understood that the liquid in the tank 231 will be established below the very top 259 of the tank where the gas offtakes 255 are located. The top surface 263 of the liquid is established by solution offtakes 265 which allow electrolytic solution to pass from the in-ground tank 231, if it becomes over full to a pump 269 from whence it passes to a filter to remove small dendritic particles, and then to a mix or holding tank 273. A third off-take may be provided in the bottom of the tank to continuously remove electrolytic solution from the tank and pass it via a line 267 to a pump 270, which forces the solution through a filter device 271 to a reservoir or mixing tank 273, both shown diagrammatically, and then returns the electrolytic solution to the coating tank 231 via a feed line 275 near the bottom of the tank 231. It will be understood that the reservoir 273 is shown diagrammatically only, and may be considerably larger than shown and that various makeup arrangements and the like as well as testing facilities for maintaining the solution strength at a predetermined level will be involved in conjunction with the reservoir 273.

The electrolytic solution removed from the bottom of the tank through the line 267 will tend to contain the majority of small pieces of dendritic material and the like from the cathodic coating surface which have been broken off by the action of the wiping blades 241 and such small particles of dendritic material will be removed from the solution as it is forced through the filter apparatus 272 and also 271 at the top of the tank so that clean solution without solids is returned via the feed line 275. The filter take-off line 267 and associated filter and the like may not be necessary in most installations, but is used as a precaution.

Figure 18A:
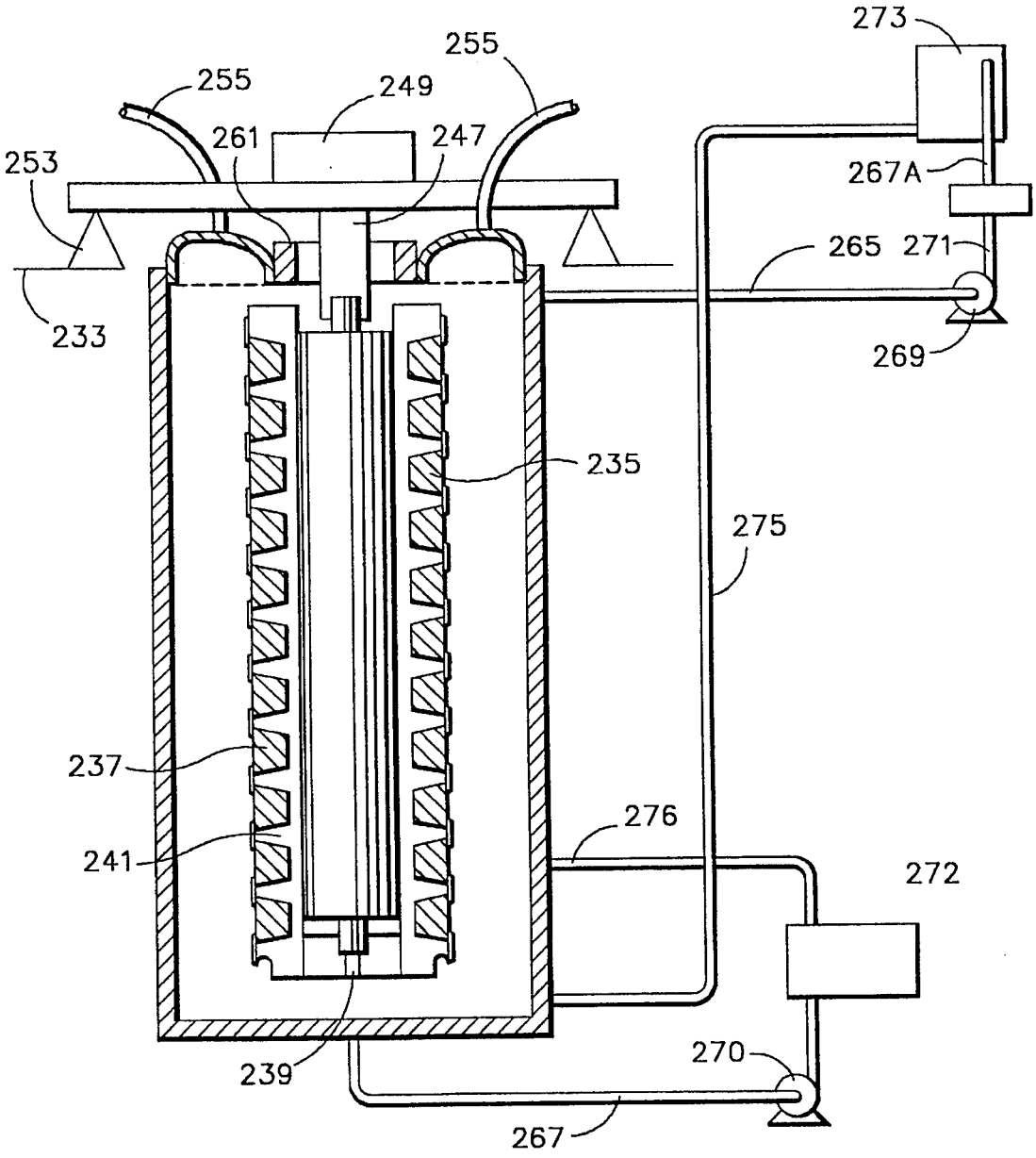
FIG. 18A is a diagrammatic side view similar to FIG. 18 showing the cathodic workpiece in coating position.
Figure 18:
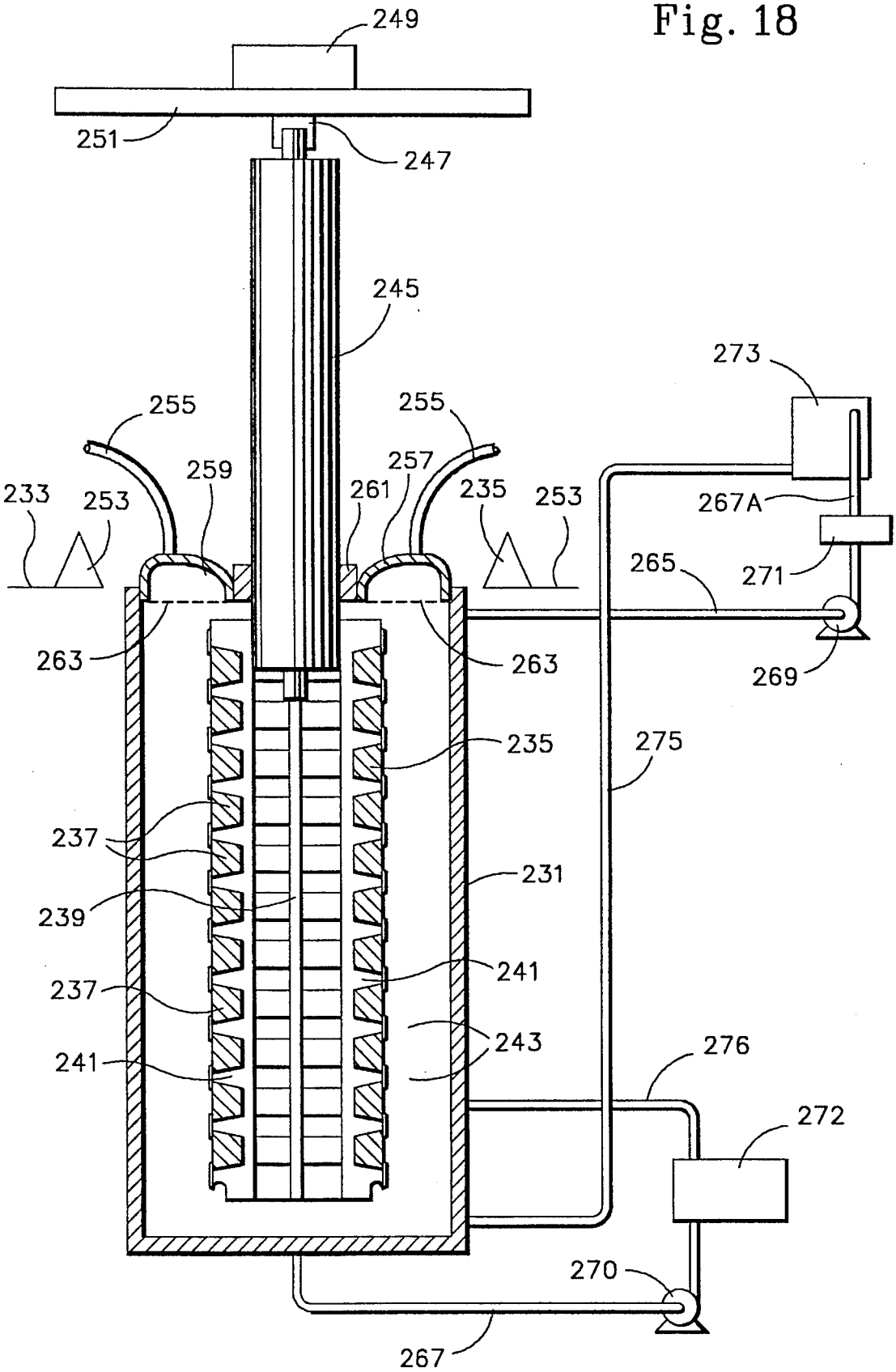
FIG. 18 is a diagrammatic side view of a presently most preferred arrangement of the invention for coating cylindrical workpieces involving the use of a vertical containment tank.

FIG. 18A is a diagrammatic view of the coating arrangement shown in FIG. 18 in preparation position with the shaft to be coated lowered into coating position in the center of the electrode 239. It has been found that the arrangement of the coating apparatus shown in FIGS. 18 and 18A is extremely convenient and effective when used with the present invention. Since such arrangement eliminates one of the prime areas of difficulty in brush coating or modified brush coating, namely, to contain the solution at rotating seals. In general, if a seal is made tight enough to prevent leakage through such seal, it may bind the moving member and prevent it from turning, or at least turning easily, while, if the seal is backed off with a lesser pressure to allow convenient rotation of the moving part, the effectiveness of the seal in preventing the passage of the liquid, and particularly an aggressive chromic acid electrolytic material is essentially largely lost.

It will be seen in FIG. 18A that the length of the anode assembly may not be the same as the length of the workpiece. Thus, while it is necessary in order to provide effective hard chromized coating upon a workpiece, to have the anode extend effectively at all times substantially completely about the portion of the workpiece to be coated, it does no harm if the electrode extends beyond such area to be coated and, in fact, in many cases, the electrode will necessarily extend beyond the area being coated and such area which is not to be coated will be protected by masking tape and the like. It is desirable to provide a bearing block of some kind in the bottom of the tank, however, to steady the lower end of the shaft. Any suitable constraining arrangement, not shown, can be used.

Figure 22:
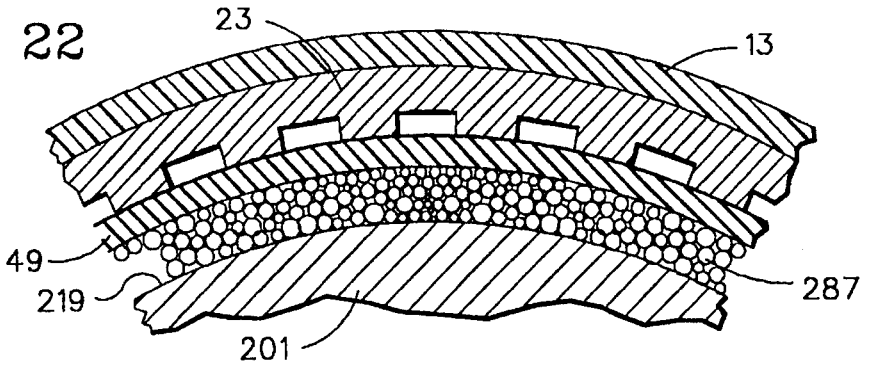
FIG. 22 is a section through a portion of an alternative electrode and wiper arrangement for practice of the invention.
Figure 23:
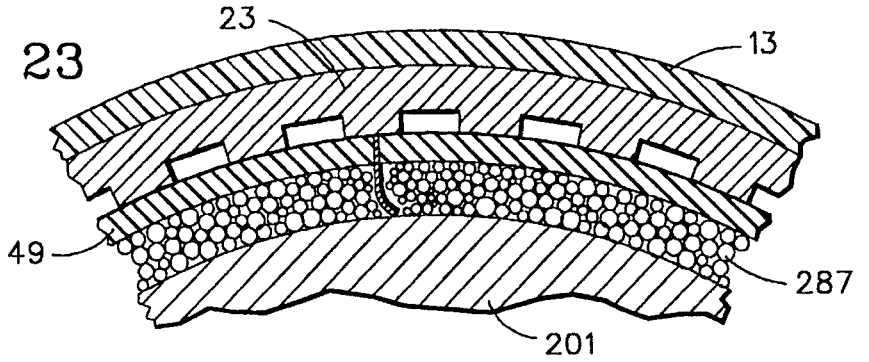
FIG. 23 is a section through a portion of a further alternative arrangement for practice of the invention involving the combined use of two separate wiping materials or structures.

FIG. 19 shows a variation of the arrangement for coating shown in the FIG. 16 which, instead of using the preferred wiping blade embodiment of the invention shown in FIGS. 16 through 18A, uses an open plastic fiber-type wiper in the form essentially of either a flat section of fibrous material or a more or less round section of fibrous plastic material. Such fibrous wiper material, which must have a very open structure which will allow free flow of electrolyte through its structure such that no substantial dendritic material will be caught in the interstices or particularly on the surface, can be a very open-woven material, an open-knitted material or, in some cases, even an open-braided material. Such wiper, which should be formed from a chromic acid-resistant plastic material, which is also resistant to abrasion and wear, can very effectively be made of polypropylene or polyethylene. The individual fibers of the material are usually very loosely knitted, woven, or even braided together preferably, however, in a sort of net construction made by knitting, which net can then be folded or rolled up into an overall pad or roll. Since the knit weave of the material is relatively open, there are large open spaces within the roll of material which provide adequate space for the passage of fresh electrolytic solution to the site of coating at all times and also a large amount of space or clearance for the escape of dendritic material which may be broken off from the surface of the electrolytic coating as a wiper passes over it. Because of the very open nature of the wiper, the electrolytic solution passes without substantial hindrance to the surface upon which the wiper impinges at all times and very good coating results are obtained. More particularly, in FIG. 19, most of the apparatus is the same as in FIG. 16 and is designated by the same reference numerals, except for the wipers themselves, which are shown in cross section from the side extending between the grid-type anode and the cathodic surface of the shaft 201 being coated. The open weave wiping material 281 may be conveniently supported in the bath by an open cage-type support member 283, shown in FIG. 19A in cross section and in FIG. 19B in longitudinal section. As shown, the support member 283 may be a plastic half-cage arrangement into which the open weave, knit or braided plastic wiper material 281 may be placed and retained by any suitable tying or clipping mechanism, not shown. From the rear of the cage are extended jam-type clip members 285 which provide interengagement with the grid-type electrode 207 in the same manner as in FIGS. 16 and 17 for the wiping blades 217. Other arrangements for holding the open weave wiping material 281 may also be used, including merely tying such material by means of plastic thread resistant to chromic acid to the grid-type electrode or even to the grid members 207. It may be most convenient in the arrangement shown in FIG. 19 to use an open woven or even braided material so that it exhibits considerable longitudinal strength and can be stretched across the electrode surface. The use of a knitted material is usually more convenient in an arrangement such as shown in FIGS. 22 and 23, however, where essentially a sheet of material is stretched over the entire surface of the electrode or an intermediate porous material.

The particular open fibrous structure of the wiper material 281 shown in FIGS. 19A and 19B is essentially the knitted structure found in a fishnet or a plastic-type household pot scrubber material. In fact, ordinary plastic household pot scrubber material can be used in the invention and will operate quite effectively, although use of a somewhat heavier plastic material is desirable for durability. As indicated, where the open fibrous material is stretched across only discrete portions of the electrode chamber, the use of woven or even loose open-braided material may be particularly convenient. Such a woven material is shown in cross section and longitudinally in FIGS. 19C and 19D. The fibers of such open woven strand 282 are even more desirably melt adhered or otherwise adhered to each other to aid in preserving its open construction under longitudinal tension.

The difficulty with the arrangement and material shown in FIGS. 19 through 19D is that the very open weave of the material results in a very low mass ratio so that while the material is very effective in scraping the surface and removing both dendritic material and allowing free escape of bubbles of hydrogen from the coating surface without interfering with the coating operation, the wiper material itself quickly wears, and upon wear, unravels into an unusable collection of threads. The material can be made somewhat more wear resistant by treating it to a partial melting or softening operation in order to adhere the threads together so that the wearing through of one fiber at one place will not cause a complete unraveling of the material. However, the material and particularly knitted material, is still so open with so little body or mass (which is exactly what is desired in order to attain effective coating by removing hydrogen bubbles and dendritic material) that it still wears very rapidly and may be impractical for long, continued use. As explained above, flexible wiper blades of the preferred apparatus for coating largely avoid this difficulty by, in effect, being both completely open so that they provide no hindrance to the escape of bubbles of hydrogen and no place for the deposit or collection of dendritic material, while at the same time, providing a substantial body of plastic material which has a much longer wear life. Consequently, it has been found in most cases that the wiper blades are the most desirable wiping apparatus for the practice of the invention, but that other equivalent materials can be used where they are designed to accomplish the same ends.

Figure 20:
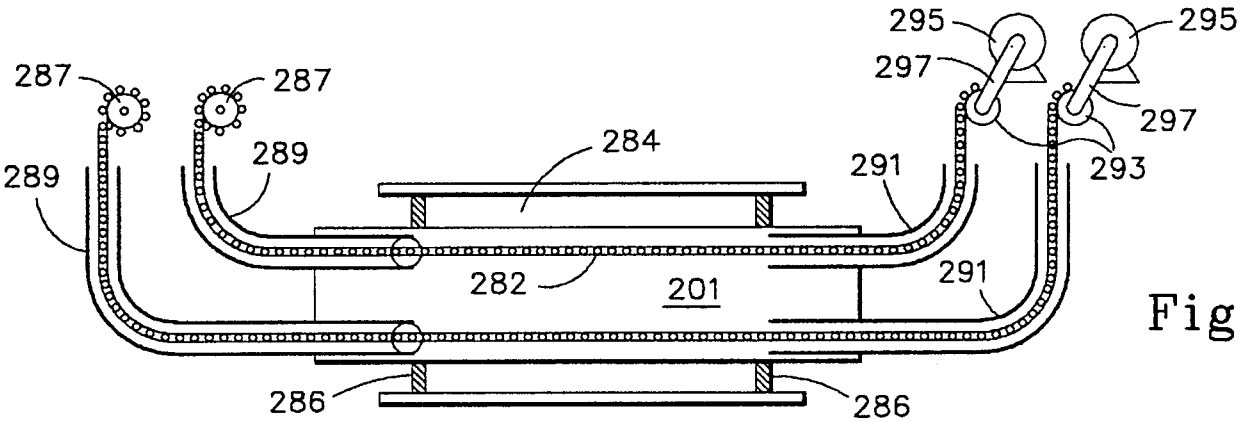
FIG. 20 is a diagrammatic side view of a still further alternative arrangement for practice of the invention applicable as an improvement of the arrangement shown in FIG. 19 using the open woven material of FIGS. 19C and 19D.
Figure 20A:
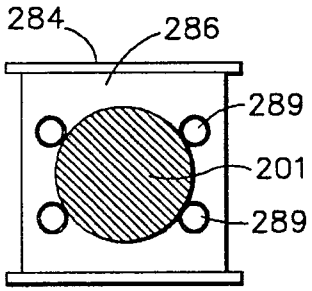

FIG. 20 is a diagrammatic view of one embodiment of an arrangement for making an open weave wiping material, more practical for long, continued use. In FIGS. 20 and 20A, there is shown in longitudinal and transverse cross section, a coating chamber 284 such as shown in FIG. 19 in longitudinal section similar to that shown in FIG. 17 and having end walls 286. Long strands of the open weave material 282 are shown passing from supply rolls 287 through guide tubes 289 which extend adjacent to the supply rolls to the side of a coating chamber such as already illustrated in FIG. 19 and which is set up to coat a shaft 201 as in FIGS. 16, 17 and the like. On the opposite side of the coating chamber, continuations of the guide tubes 291 are shown extending from the opposite side in line with the first guide tubes 289. These tubes, 291, extend upwardly adjacent to two capstans or winding drums 293 operated by motors 295 through connecting shafts 297. The capstans 293 are shown diagrammatically, but it will be understood that they are adapted to have wrapped upon their surfaces and to place tension upon and draw about their surface the long strand of open weave wiping material 282. By the operation of the motors 295, the capstans 293 are caused to draw the open weave wiping material through the guide tubes 289 and 291 and through the coating bath between such tubes held against the surface of the shaft 201 being electrolytically coated which, it will be understood, is rotating within the coating bath. No electrode grid or other type of electrode is shown in the coating chamber in FIG. 20, but it will be understood that a suitable anode will be present within the bath as shown in the other figures. As the shaft 201 rotates, the open weave wiping material 282 rubs against the surface of the material being coated and lightly breaks off the dendritic shaft which may be growing out into the bath, keeping the top of the surface of the coating more or less coincident with the actual deposition of a dense coating and at the same time, wiping from the surface, both bubbles of hydrogen and a thin cathodic film of hydrogen which may also be present. As the open weave, or in some cases, adhered open weave, i.e. where the individual threads of the open weave material have been adhered to each other by partial melting or the like to form a more unitary and more permanent open structure, wears, new sections of such wiping material can be unrolled from the supply rolls 287 and brought into contact with the sides of the roll or shaft 201 so that a good continuous wiping of the surface of the shaft may be had during the coating procedure. No support for the open weave wiping material as it passes through the bath is shown in FIG. 20, but it will be understood that a support similar to that shown in FIGS. 19A and 19B can be used within the plating chamber. Alternatively, any other suitable arrangement may be used. If sufficient tension is placed upon the material between the takeoff or supply rolls 287 and the capstan rolls 293, such tension in the material will be sufficient to maintain the open weave wiping material against the surface being coated and very effectively remove both bubbles of hydrogen and upstanding dendritic material which may interfere with the smoothness of the coating.

The guide tubes 289 and 291 being open to the electrolytic coating bath, are extended upwardly beyond the surface of the coating bath and, in fact, beyond the upper portion of the coating chamber in FIG. 20. In this way, even though such guide tubes are completely open to the bath, they do not provide a point for the electrolytic coating material to flow from the bath, since the level of liquid in the tubes will be essentially the level of the liquid in the coating bath itself.

Figure 21:
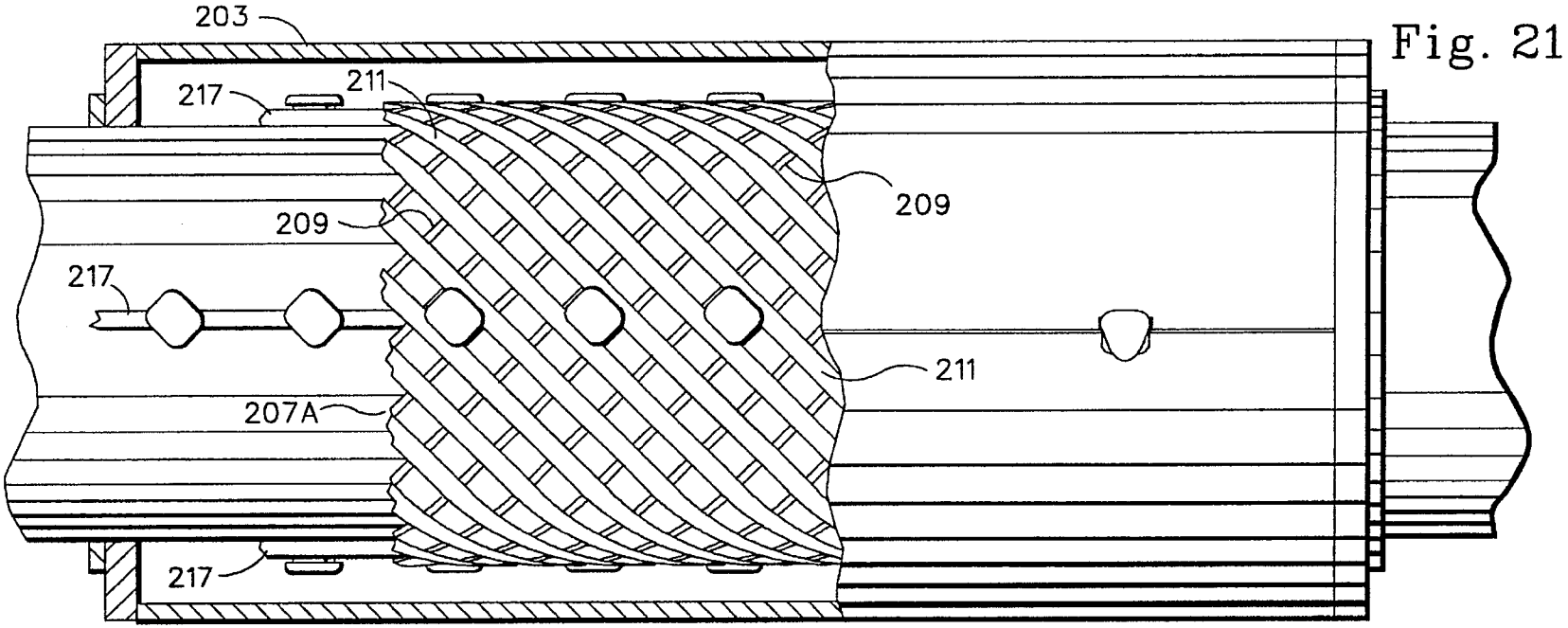
FIG. 21 is a partially broken-away side view similar to that shown in FIG. 17 showing the use of a preferred transverse grid-type electrode.

FIG. 21 is a partially broken away view of a coating chamber arrangement similar to that shown in FIG. 17, except that the orientation of the grid-type electrode has been changed so that instead of such electrode 207A being orientated generally in the direction of the shaft being coated in the chamber itself, it is oriented at an angle to such shaft and chamber. This ensures a continuously changing coating pattern as the cathodic workpiece rotates within the grid-type electrode. It has been found when using grid-type electrodes such as shown in FIG. 16, for example, that certain parts of the cathodic workpiece being coated tend to remain under portions of the grid for greater periods than other sections, and this may tend not only to cause differential coating thicknesses requiring additional grinding between passes, but if the rotation or movement of the cathodic workpiece is slow enough, may even tend to cause the hard chrome deposition to cease plating. Normally, however, the speed of the workpiece or the workpiece surface under the portions of the grid is sufficiently rapid so that the passage from one portion of the grid to another is sufficiently connected so that the deposition of the hard chrome will not cease, but still may cause differential thicknesses of chrome to be built up on those sections of the workpiece which end up, on the average, under or directly opposite to a portion of the electrode grid for longer periods. By angling the grid, the opportunity of the work surface to remain under an actual grid member will, on the average, be evened out between all parts of the surface. Of course, some angles will be found more efficient than other angles. For example, if the angle selected is 45 degrees, there may again be a tendency for certain portions of the cathodic work surface to, on the average, remain under an actual portion of the grid for longer average periods in the aggregate. However, if an exemplary angle between 45 degrees and 90 degrees is selected to provide the maximum similarity and average times of coverage by the electrode sections of any given series of adjacent portions of the work surface a smooth uniform coating will be attained. The angle should also be arranged so that the jam-type interconnecting portions 223 of the wiper blades 217 can be conveniently forced into an opening between the grid members of the electrode. If a regular sequence of openings which will both hold the jam fittings of the wiper blade and also cause a random coating pattern with respect to any given time that the workpiece spins under any given portion of the coating electrode grid cannot be worked out, an alternative support for the wiper blades can be devised. It is possible, for example, for some of the jam-type interconnections to be removed where they may abut closed portions of the electrode grid rather than open portions, since it has been found that the jam-type interconnections are sufficiently strong so that a maximum number of interconnections between the wiper blade and the grid-type electrode through such jam-time interconnections is not usually necessary. Rather than angling a regular grid-type electrode, as shown in FIG. 21, the electrode itself can be made with random elements, particularly if combined with angling so that there will be no regular pattern of passage of the electrode surface past the rapidly rotating cathodic workpiece surface. Various other arrangements for supporting the wiping blade may also be provided. It will be noted in FIG. 21 that the expanded tops 225A of the interconnections 223 have been fabricated with an actual button or mushroom shape rather than the stamped out two dimensional construction shown in FIGS. 16, 16A and 17.

As will be recognized from the above descriptions and discussions in connection with the appended drawings, the present inventor has discovered that hard chrome coatings can be formed upon a cathodic workpiece by a brush coating or modified selective coating arrangement wherein (a) there is effectively complete electrode coverage of the surface to be coated, (b) where the anode is maintained closely spaced to the cathodic work surface, (c) where the electrolytic coating solution is prevented from becoming depleted at the point of coating by rapid replacement of such electrolytic solution, and (d) where the surface of the workpiece is substantially continuously or consecutively acted upon by an open structure wiper which contacts a minimum of the surface and presents sufficient open space within or about such wiper so that bubbles displaced by such wiper from the surface of the workpiece are not inhibited from immediately leaving the vicinity of the coated surface and dendritic material displaced from the surface does not become entrapped in the wiping material, but can be rapidly removed from the area of the coating in order not to damage the coating surface. It has been found that when these criteria are maintained, good hard chrome coatings will be attained, provided that the recommended current density and temperature of the electrolytic solution for that type of solution, as usually recommended by the manufacturer or supplier, are maintained during the coating operation.

Since the method and apparatus of the present invention are designed to function using the various tank plating solutions normally available to all chrome plating shops, it is advisable to consider the different operating parameters of each type of bath that could, in general, be used in any brush plating program.

There are three broad types of electrolytic baths generally used for hard chrome tank plating, i.e. conventional, mixed catalyst and proprietary fluoride-free. The following are the significant parameters of each type of bath when used for tank plating:

| | Conventional | Mixed Catalyst | Proprietary Fluoride-Free |
|---|---|---|---|
| Cathode Current Density | .25–2.5 ASI | 1–6 ASI | 1–6 ASI |
| Temperature | 120–140° F. | 128–140° F. | 128–140° F. |
| Anode material | Tin/led or Antimony/Lead | Tin/Lead | Tin/Lead |
| Chromic acid-Sulfate Ratio | 100/1 | 100–155/1 | 98–100/1 |
| Chromic acid Concentration | 20–48 oz/gal | 20–48 oz/gal | 28–40 oz/gal |

As a general rule, the use of brush plating procedure permits the use of higher current densities and higher bath concentrations than for comparable tank plating. However, because of speed limitations with respect to rotation equipment, particularly where small diameters are being plated, and/or the availability of sufficient rectification required for very large pieces, adjustments may have to be made in the recommended current density or surface speed. In order to obtain the optimum hardness, wear resistance, deposition rate, crack pattern, brightness, etc., other adjustments may also have to be made in these parameters as they relate to each other. However, if the requirements as set forth above for the present process are followed as well as the current density and temperatures recommended by the manufacturer for the particular solution used, good hard chrome coating should be obtained.

The preferred wiper blade arrangement, as described above, is comprised of a resilient plastic resin wiper blade resistant to degradation by chromic acid solutions and arranged to bear against the cathodic work surface being coated, the resiliency of the blade itself providing the force maintaining the edge of the blade against the surface being coated. The resiliency of the plastic as it is bent in the direction in which the cathodic workpiece rotates retains the outer end of the blade against the work surface just sufficiently to break off protruding dendritic processes or material and also discharge hydrogen bubbles from the surface. Such resiliency also allows the coating to build up upon the surface of the workpiece, as the blade flexes to allow thicker coatings to pass under it. No burnishing or working of the surface is desired or desirable, so only a light pressure against the coating surface is maintained. Such light pressure is, however, quite sufficient to cause detachment of bubbles of hydrogen from the surface as well as, and very importantly, nucleation of both any thin cathodic film or small bubbles of hydrogen into larger bubbles which are then displaced from the surface and removed from the vicinity by their own buoyancy as well as the flow of the electrolytic solution at and adjacent to the surface area being coated.

While the use of a thin flexible wiper blade which can be extended with a slight bias against the surface of the cathodic workpiece is simple, effective and convenient, it is possible also to make use of a less resilient wiper which essentially extends directly against the coating surface. Such a relatively inflexible wiper blade, however, is necessarily spring or resiliently mounted so that only a light continuous pressure of the contact portion of the blade is applied against the coating surface and so that the blade can be displaced as the coating increases in thickness. Such resiliency can be provided in several different manners, including the use of a spring mounting at the top of the blade which either biases the blade lightly straight downwardly toward the work surface or, alternatively, pivots the blade from a hinge-type attachment at the top to rotate the blade at the opposite end toward the coating surface. Some of these additional embodiments of wiping blades are more convenient also for attachment to a nonaligned grid-type electrode as shown in FIG. 21.

Various other types of anodes can also be used in the process of the invention. For example, in FIGS. 1 through 15, the anode used is a fluted anode having an anode wrap material upon its surface which provides the means of providing a continuous copious flow of electrolyte to the coating theatre to prevent depletion of said electrolyte as coating proceeds. The anode is not perforated, since no electrolyte is provided on the opposite side of the anode, in any event. Instead of using the plastic bristle brush processes disclosed in FIGS. 1 to 15 for wiping the surface, the fibrous knitted or woven material shown in FIGS. 19 and 20 could be used on the surface as a fibrous anode wrap. However, the plastic brush bristles shown in FIGS. 1 through 15 have a rather better resistance to abrasion than such woven material and also complement the electrolyte reservoir capacity of the plastic felt or other porous anode wrap material.

The wiper blades shown in FIGS. 16 to 18A could also be used with the anode wrap material shown in the previous views and would work quite effectively so long as the electrolyte is maintained between the felted surface of the anode wrap and the surface of the workpiece. In such instance, the felted surface would extend close to the electrolytic coating surface, but not touch such surface, and the wiper blade would be conveniently accommodated in grooves in the felted material. If such felted material touched the coating surface, it would act as its own wiping means, but would have the disadvantage of being less abrasion resistant and also most importantly, would have the disadvantage of tending to hold broken off dendritic material on its the surface which may cause detrimental scratching of the surface and thieving of the current resulting in uneveness of the coating. The roughness of the coating would also tend to damage the felted material.

In order to obtain more anode-to-cathode surface area and thus increase the effective current density and throwing power, the anode surface can be pocketed with depressions either pyramidal or having other forms providing more surface area. A stepped pyramidal indentation pattern very effectively increases the surface area.

The grid-type electrode shown in FIGS. 16 through 19 is very effective in increasing the surface area of the anode and also has the further advantage of providing easy passage of electrolyte through the anode to aid in maintaining fresh undepleted electrolyte at the surface of the cathodic workpiece being coated. Good circulation of electrolyte not only allows efficient continuous access of undepleted electrolyte to the coating surface, but also unimpeded removal or escape of bubbles of hydrogen from the coating surface and washing away of broken off dendritic material from the coating theatre.

As indicated above, it has been found necessary for the production of quality coatings (a) that the anode be substantially continuously in effective opposition with the cathodic work surface to be electrolytically coated, (b) that the area between the two be continuously bathed in non-depleted electrolytic solution, i.e. that a forced circulation of some form of the electrolytic solution be continuously present to prevent any substantial depletion, (c) that the anode cathode gap be relatively small, and (d) that the cathodic surface be wiped continuously to remove hydrogen bubble and cathodic layer accumulation and also to break off and remove dendritic material upon the accumulating coating on the cathode. The wiper also must have an open structure which allows such dendritic material to be removed and the bubbles of hydrogen to escape. Several manners of accomplishing or fulfilling these combined requirements are disclosed above, including use as a wiper of (a) continuous interconnected polymeric fibrous material including loosely woven polymeric material and loosely gathered and adhered polymeric material, (b) discontinuous randomly connected fibrous material including very open felted material, i.e. having sufficient open area between the fibers to allow substantially unrestricted flow between the fibers of an electrolytic solution, (c) discontinuous and connected polymeric fibrous material such as brush material and the like with both randomly and regularly spaced fibers, and (d) solid wiper material. Each one of these constructions must incorporate substantial edge oriented material which contacts the surface of the cathodic plating surface to induce the disconnection of bubbles of hydrogen from such surface as well as, it is believed, to encourage any cathodic film of hydrogen to coalesce into bubbles of hydrogen and be displaced from the surface as well as to sever or break off dendritic material, and must have, as explained, a sufficiently open construction to allow the passage of the removed bubbles and dendritic material away from the cathodic surface and into the body of liquid of the electrolyte.

As indicated above, the solid-type wiper, which may be analogized to a windshield wiper, is essentially the ultimate in open construction and does a superior job in encouraging or allowing the free removal of hydrogen bubbles and dendritic material from the vicinity of the coating surface. In addition, the solid-type wiper will not usually be used with a porous electrolyte containing material through which electrolyte is forced to the plating surface, but will instead be used in an essentially open space between the anode and the cathodic plating surface, which, however, will be closely spaced to each other. The wiper blade, therefore, will frequently be used in a modified selective plating arrangement using tank-type apparatus rather than in a brush coating-type arrangement using forced feed of coating solution through a porous material to the coating location. However, as illustrated in appended FIGS. 23 and 24, described hereinafter, the wiper blade can be used with a porous solution feed material also and, therefore, may be used also in a traditional brush coating-type arrangement. As indicated, the plastic or dielectric wiper blade will usually extend from the anode to the cathodic work surface at intervals along such surface while electrolytic solution is flowed between the two anode surfaces and preferably also, through orifices in the anode surface from a somewhat larger body of liquid electrolyte behind the anode. It has been found, in addition, that the use of the solid wiper blade has a very significant additional advantage. Normally, as a workpiece either rotates in a coating bath or passes through the bath, it carries along with it a surface layer of electrolytic solution. Such layer of traveling solution tends to become depleted of coating metal thus interfering with the plating process. Various arrangements to provide fresh solution may be made, including the use of a porous material through which the electrolytic solution is forced to the surface, such as shown in FIGS. 1 through 14 or the use of forced jets of liquid or the like to encourage exchange of electrolyte at the surface. It has been found, however, that the use of a solid wiper blade past which a flat or curved coating surface passes is very effective to cause an interchange of electrolyte at the surface as coating proceeds. For example, as shown in FIG. 16, as the coating surface 219 of the workpiece 201 rotates within the outer casing 203 adjacent to the grid-type electrode 207 and electrolytic fluid is fed into the casing 203 through the feed lines 227 and flows out of the outlet pipes 229, there is a general circulation of electrolyte within the casing 203, particularly outside the grid-type electrode 207.

Within or adjacent to the grid-type electrode, the surface 207 of the workpiece 207 tends to carry about with it a layer of electrolyte which intermixes with the layer along the anode 207 which tends to remain rotatably stationary with the anode itself. There is thus some intermixing along the interface of the two bodies of liquid. However, the very movement of the inner layer of electrolyte along with the workpiece itself tends to isolate the rotating body of liquid from the non-rotating body so that as coating proceeds under the impetus of the applied electrolytic field the rotating body of electrolyte tends to become depleted of coating metal ions. This is contrary, however, to what is required for the deposition of a hard chrome coating, as explained above.

With the presence of the wiper blades 217, however, the thin film of electrolyte rotating along with the surface of the workpiece is blocked from proceeding farther and is forced to flow towards the sides as well as through the orifices in the anode, while fresh electrolytic solution flows in from behind the wiper blade. The coalescence and passage of the hydrogen bubbles from the surface also aids in creating a current away from the work surface, but the main interchange of electrolytic solution is as the result of the abrupt blockage of the electrolyte from proceeding farther, its forced flow upward and to the side about the wiper blade by which it is mixed with fresh electrolytic solution, and the flow of such remixed solution as well as other fresh solution back to the surface of the workpiece behind the wiper blade. The contact of the wiper blade, meanwhile, being very narrow along the surface of the workpiece, the electrolytic solution is removed, or partially removed, from the surface only momentarily and plating is not halted or interfered with. The interchange of solution has been found to be so efficient that no other means for forced circulation of solution within the plating chamber is usually necessary. The process is thus simpler than some previous processes as well as more economical and effective.

Figure 24:
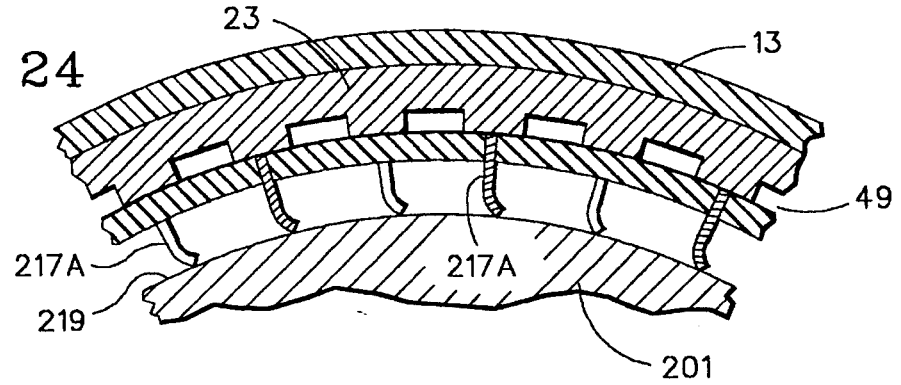
FIGS. 24 and 25 are respectively a section through a portion of an alternative apparatus for practice of the invention and a spread out inside view of the wiping surface as viewed from the vicinity of the work piece surface.

FIGS. 22 through 24 are partial transverse sections through alternative embodiments of the invention wherein several different versions of alternative single or combined wiping means are shown. In FIG. 22, there is shown a partial view of a section of a coating arrangement such as shown in FIGS. 1 or 13 in which an outer casing wall 13 is directly mounted against a grooved lead anode 23 over the grooves 24 of which is provided a felted plastic layer 49 which provides a medium through which electrolytic solution is forced to a layer of open flow path knitted plastic fibers 287 which bear on one side against the felted plastic layer 49 receiving electrolyte from such layer and against the cathodic work surface 219 of a workpiece 201 on the lower side. The plastic fibers may have the same general form as those illustrated in FIGS. 19, 19A and 19B, but are extended out over the entire surface of the anode or the felted plastic material directly upon the electrode. The knitted fibers are preferably in the general form of the material customarily used for domestic pot scrubbers, but may be desirably of somewhat heavier construction than the customary plastic fibers and the knitted fibers are also preferably adhered to each other by a heat treatment or other adhesive treatment as well as being knitted. The open structure of such knitted material allows bubbles of hydrogen as well as severed or broken off dendritic material to readily flow from the open structure and escape from the electrolytic chamber. Since the fresh electrolytic solution is forced to the fibers through the felted plastic material, it is not necessary for the fibers to themselves cause a replacement of electrolytic solution.

FIG. 23 is a further sectional view similar to that shown in FIG. 22 in which there is a thin layer of knitted fibrous wiping material 287 between the cathodic work surface 219 and the felted material 49. In addition, however, there is a further wiping blade 217 provided extending at one point from the surface of the anode through the woven fibrous material and impinging in a flexed configuration upon the surface of the cathodic workpiece. Such additional wiping blade which is secured to the electrode and/or the knitted material in any convenient manner provides additional assurance of severing all outwardly extended dendritic material on the coating surface and thoroughly removing hydrogen accumulation both in the form of hydrogen bubbles and any thin cathodic film of hydrogen which is efficiently coalesced by the passage of the wiper blade. The wiper blade has little effect upon replacement of electrolytic solution, however, because of the restricted access of the solution to the cathodic work surface, except through the forced circulation of electrolytic solution through the felted layer 49.

Figure 25:
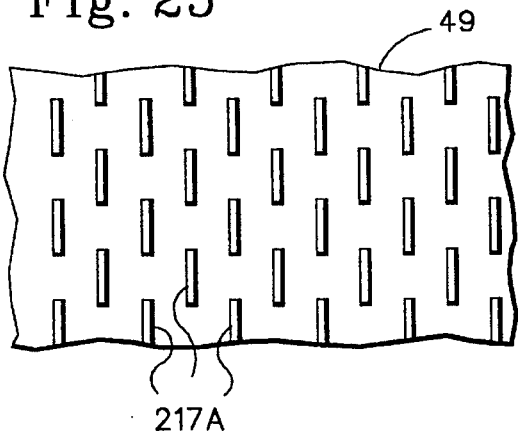

FIGS. 24 and 25 are a partial side section as well as a partial surface view of an arrangement in which a forced feed of electrolytic solution is fed through a felted material 49, as shown in FIGS. 22 and 23, and longitudinally restricted wiping blades 217A extend downwardly through the felted layer and impinge upon the work surface 219 of the workpiece 201. The wiping blades 217A, which do not extend through a layer of fibrous wiping material, but only through a felted material 49, are, instead of being extended across the entire work surface, each of limited length and are staggered so that each portion of the surface of the workpiece is wiped by a series of consecutive short wiping blades. The short wiping blades 217A are fixed in or secured to the anode and/or the felted material in any suitable manner and serve to very effectively wipe hydrogen bubbles from the cathodic surface as well as to continuously sever dendritic material on the cathodic coating surface. This arrangement causes each blade to effect complete replacement of the electrolytic solution from one side to the other resulting in thorough mixing of the solution within the space between the fibrous material and the work surface. However, because of the arrangement for directing the electrolytic solution toward the workpiece surface, the full benefits of interchange of electrolytic solution by means of solid wiper blades is not attained. The apparatus is, in effect, a modification of a brush coating system.

It will be understood in this regard that when a solid wiper blade is referred to, what is meant is a continuous surface wiper blade and that, in fact, the upper portions of the blade may be either perforated or solid, depending upon the construction. However, better replacement and mixing of the electrolytic solution in the space between a perforated or grid-type electrode, as shown, for example, in FIGS. 16, 17 or 18 or 18A, may be attained.

Figure 15:
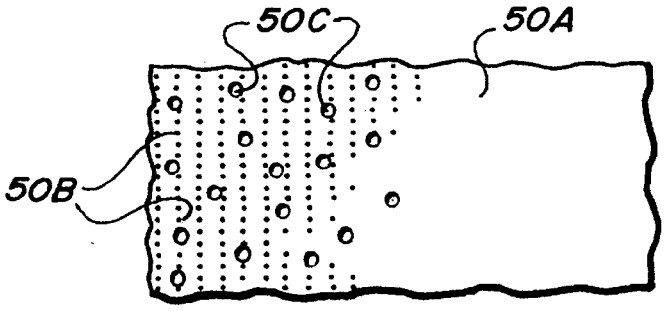
FIG. 15 is a bottom view of the anode wrap element shown in FIG. 14 showing the arrangement of the bristles of the brush element and the orifices in the bristle backing leading to the absorbent plastic felt.
Figure 26:
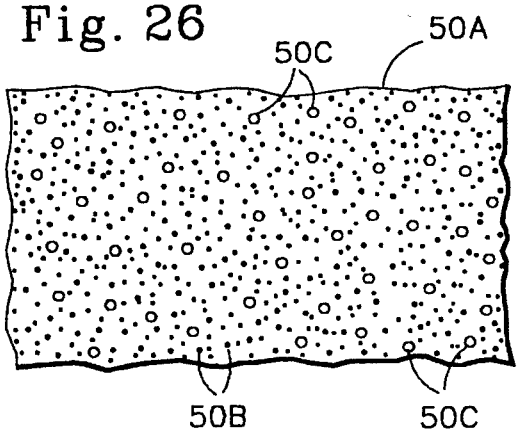
FIG. 26 is a view similar to FIG. 15 of a plastic brush surface showing randomly distributed plastic bristles as well as randomly distributed fluid orifices through the membrane between the plastic brush bristles and the plastic felt material.

FIG. 26 is a view similar to FIG. 15 showing the outer surface of a plastic brush section 50 as shown in FIG. 14 in which the bristles 50B are generally randomly oriented rather than oriented in rows as shown in FIG. 15. The same flow orifices 50C in the intermediate plastic membrane 50A between the absorbent felt material 49 (see FIG. 14) and the plastic bristles 50B is shown in FIG. 26 interspersed among the randomly oriented bristles 50B. The random orientation shown in FIG. 26 is somewhat more efficient in removing bubbles of hydrogen, and particularly a cathodic layer of hydrogen, than oriented bristles from a cathodic work surface because over a short time interval, virtually every portion of the surface of the cathodic workpiece will be actually contactêd or rubbed by the end of wiping bristle. Furthermore, if the spacing of the bristles is not too close, the escape of hydrogen and severed dendritic material will be as effective as in the regular arrangement of the bristles 50B shown in FIG. 15.

The equipment generally required for coating in accordance with the invention is as follows:

1. A custom made lead anode of the proper size and shape to completely cover the area of the workpiece to be coated at all times. The anode is preferably approximately 7% tin and should be shaped to provide an anode/cathode surface area ratio of approximately 1.5 to 1 or more as well as liquid channels for effective distribution of coating solution across the face of the anode. The anode should preferably be pre-electrolyzed prior to beginning of coating.
2. A rectifier with less than 5% and preferably less than 1% ripple or ripple effect for the provision of the electrical potential between the anode and the cathodic workpiece.
3. A heated filtered reservoir for electrolytic solution.
4. A chromic-acid resistant plastic wiping material adequate to remove substantially all bubbles of gas continuously from the surface of the workpiece during plating.
5. Chromic acid resistant fittings.
6. Electrolytic bath analysis equipment.
7. Means for providing continuous relative movement of the anode and workpiece in close proximity to each other while retaining a section of the anode face substantially at all times over, or immediately adjacent to, every portion of the area of the workpiece to be hard chrome plated.
8. A pumping and reservoir arrangement to continuously supply fresh electrolytic solution to the area between the face of the anode and remove it before it becomes significantly depleted of chromic plating material. The arrangement may include replenishment apparatus for making up or correcting for any depletion or other change in the bath analysis detected by the bath analysis equipment.
9. An acceptable environmental antipollution arrangement.

As indicated above, the electrolytic solution can be a conventional fluoride-type so-called mixed catalyst electrolytic plating solution for tank plating. Good chrome plating practices with respect to initial cleaning, the types of materials coated and the like are adhered to in all cases as the normal principles of chromizing in general continue to apply.

As the plating progresses and the chrome deposit approaches 0.004–0.005 inches in thickness, the surface may become rough, particularly over any thieving tape, so that it may become difficult to continue proper relative movement of the anode with respect to the cathode. At this point, it may be necessary to stop the operation, remove the masking and grind smooth any nodularity in the chrome, after which the plating operation can be begun again in the same mode as when originally plating chromium on chrome ab initio. For very heavy coatings, it may be possible to lay down as much as 0.008 inches of chrome or more before smoothing by grinding becomes necessary. For example, in providing a 0.020 coating, three 0.008 coatings may be deposited consecutively with grinding between each stage. Since nodularity and roughness inherently becomes greater as plating proceeds, a very thick buildup may become so rough as to effectively destroy the brush element if plating is continued too long and it is more effective with respect to materials and time to provide intermediate stages of grinding after each of which, of course, the coating process is restarted as from the beginning. It has been found that when using the wiper blades as described above, heavier coatings can generally be formed before grinding is necessary.

Commercial equipment for continuously analyzing the bath composition and replenishing the bath or adjusting its composition to bring it back to a desired composition is available. Such bath analysis is necessarily conducted more frequently in most cases in a brush plating operation than in a plating tank bath because the brush plating solution volume is small. The same is true in a modified brush plating operation.

The process and apparatus of the invention has been found very satisfactory for the plating of hard chromium of significant thicknesses such as four-to-six thousandths of an inch or more of hard chrome from hexavalent electrolytic chromium plating solutions. However, it can also be used to plate from a trivalent plating solution. Hard chrome coatings only a fraction as heavy, such as, for example, four-or-five ten thousandths of an inch, have only been available before from brush plating-type processes, except in those cases where the process is continuously restarted or initiated over long periods, an essentially impractical procedure. In most prior attempts to provide hard chrome coatings by brush plating, initial plating would begin fairly satisfactorily, but the plating rate rapidly declined to almost nothing in fairly short order, and could not be brought back to a reasonable operating rate, the reason for such difficulties not being known.

It will be recognized from the foregoing description and explanation in connection with the appended drawings that the present invention provides a very effective and efficient method and apparatus for providing hard chromium coatings upon workpieces by means of a brush coating or modified brush coating-type operation. While brush coating of soft chromium coatings has been achievable before, the attainment of hard chromium coatings of any significant thickness was previously unobtainable. As explained in more detail above, the Applicants have been able to obtain consistent and more than satisfactory hard chromium coatings upon workpieces by following the requirements of their process or processes and apparatus which essentially requires the substantial maintenance of a constant and uniform current density over all portions of the material to be coated while coating is taking place and in order to obtain this requirement, requires that the anode be substantially continuously maintained above or adjacent to the portion of the material being coated, if the best quality coating is to be obtained. Applicants also maintain close spacing between their anode and cathodic workpiece. Furthermore, the Applicants have found that in order to obtain good hard chromium coatings, one must maintain a relatively constant and fairly rapid flow of electrolytic solution over the electrode surface during plating and that no portions of said solution can be allowed to become depleted of the chromium metal else the hard chromium coatings will cease deposition and/or become seriously defective. Last, but not least, Applicants continuously wipe the surface being coated to remove all bubbles of hydrogen and break off small upwardly extending dendritic material from the coating surface by means of a lightly applied wiper while maintaining constant open conditions adjacent to and/or within the wiping mechanism to encourage rapid removal of the hydrogen bubbles and severed dendritic material from the coating area. Applicant is able to obtain, therefore, hard chromium coatings, by a combination of factors precisely calculated to obtain hard chromium coatings including apparatus which maintains a lead or lead-tin anode substantially always over and closely adjacent to the portion of the workpiece which is to be coated, which maintains a substantially constant current density within the range for which the electrolytic solution is designed between the anode and the cathodic workpiece, which maintains a constant flow of plating solution at all times over the surface to be coated or otherwise prevents the solution from becoming depleted, which maintains a constant temperature within ranges determined by the solution used, which also maintains a constant current density between the anode and the cathodic material at all times without any significant variation which might lead to the deposition of defective chromium coatings or no chromium coating at all rather than the desired hard chromium coatings and which wipes away hydrogen bubbles and severed dendritic material to prevent marring of the coating surface.

In the foregoing discussion and description as well as in the following claims the following terms should be understood to have the meanings assigned as follows:

(a) "Brush plating" is an electrolytic plating operation involving the use of electroplating solutions applied to a restricted area of a workpiece and held or maintained between the workpiece surface and an adjacent anode by means of an absorbent or solution-holding material often having the characteristics of a felt-like material.

(b) "Modified brush coating", "tank-type selective plating" or "selective plating" refers to a process in which the surface of a cathodic workpiece is wiped as distinguished from abraded or burnished in order to remove bubbles of hydrogen and/or a cathodic film of hydrogen which may otherwise interfere with coating as well, if necessary, severing dendritic material extending upwardly from the coating surface, but wherein the electrolytic material may not be applied to or reach the coating surface through a porous electrolytic conducting material adjacent the face of the anode.

(c) "Continuous interconnected polymeric fibrous material" refers to a fibrous polymeric material having an interconnected fibrous structure in which the various fibers are interconnected with each other at both ends, either as a result of having a woven construction, or as the result of having the component fibers adhered to each other where they intersect, or both.

(d) "Discontinuous end connected polymeric fibrous material" refers to a fibrous polymeric material in which the individual fibers are connected only toward one end so that such fibers tend to extend away from a common adherent point or plane forming a bed of more or less cooperatively interconnected mutually oriented fibers.

(e) "Discontinuous randomly connected polymeric fibrous material" refers to a fibrous polymeric material in which the individual fibers are connected or interengaged at various points along the fiber surface including an open felted material.

(f) "Open material" or "solution path open material" or "open free flow path material" refers to a material through which or past which an electrolytic material may freely pass, particularly when carrying a quantity of hydrogen bubbles or severed dendritic coating material.

(g) "Open Form Wiper" refers to the surface wiper for an electrolytic coating process which wiper is essentially open in construction so it does not present any significant barrier for the migration of hydrogen bubbles away from a coating site and includes both open woven scraping material and blade-type wipers or scrapers.

(h) "Wiping blade" refers to a single or multiple blade arrangement adapted for contacting an electrolytic coating surface with a light contact effective to remove bubbles of hydrogen and protruding dendritic material, but not to burnish or heavily rub the surface.

(i) "Brush material" refers to a material within the general definition of a "discontinuous end connected polymeric fibrous material" having the general characteristics of a brush in that it incorporates a plurality of individual or discontinuous rubbing or contact elements usually in the form of elongated bristles or the like for movable contact with a surface to effect such surface in some manner and particularly to facilitate removal or detachment of material including gases from such surface and which is in the present context effective to continuously remove or sweep bubbles of oxygen or other contaminants from such surface when immersed in a liquid. Such brush material should be sufficiently restricted in space between individual brushing elements or bristles and contact of such elements with the surface to be coated both to maintain a full volume of surrounding coating liquid and to effectively brush the entire surface of the adjacent material being brushed. However, it should be sufficiently open not on impede bubbles of hydrogen or dendritic material from passing from the coating theatre.

(j) "Chrome electroplating solution", "electrolytic coating solution" or "bath" refers to any proprietary or especially formulated chromium electroplating solution which can be effectively used for either tank plating or brush plating to provide an electro deposited chromium coating, such solution may contain either trivalent or hexavalent chromium compounds or complexes and may and usually does contain other compounds such as brightening agents, inhibiting agents and the like.

(k) "Soft chromium coating" or "soft chromium plating" refers to an electroplated chromium deposit which has a relatively low specific weight, is more or less porous and is relatively weak in compression and has a relatively low abrasion resistance.

(l) "Hard chromium coating" or "hard chromium plating" refers to an electroplated chromium metal deposit which has a relatively high specific weight, is dense and compacted rather than porous and is relatively strong in compression and has a relatively high abrasion resistance.

(m) "Vat or tank electroplating" or "vat or tank electrocoating" refers to the provision of electroplated coatings upon workpieces while such pieces are substantially immersed either completely, partially or effectively within a container of plating solution and includes the coating of a portion of a workpiece which is specifically contacted with or partially immersed within a body of plating solution as contrasted with having a relatively restricted or limited quantity of electroplating solution applied in a relatively restricted volume or layer upon a portion of a workpiece to be plated.

(n) "Absorbent material" or "absorbent felt-like material" means a material having the capacity to absorb or hold a quantity of liquid and to retain such liquid at least to a reasonable extent against the force of gravity and, in the present context, particularly a plastic resin material having the property of taking up or absorbing and retaining an electrolytic coating solution and effectively retaining such solution in such material sufficiently so that at least if such coating solution is continuously supplied to one side or end of such material a surface in contact with another side of such material will be continuously bathed in the solution and in which the chemical composition and structure of the absorbent material is such that it is not significantly attacked by the electrolytic solution which is absorbed or held within it.

(o) "Open interconnected porous polymeric material" refers to a polymeric material having internal spaces through which liquid may migrate and falls within the definition of an "absorbent material" as here defined and including felted polymeric material and open cell polymeric foam material.

(p) "Effective anode contact" in the present context means having the anode of a brush plating apparatus adjacent to and at a relatively small distance from a cathodic workpiece so that the anode is electrically coupled through any intervening electrolytic or electrically conducting liquid or medium with such adjacent workpiece. Effective anode contact implies that the surface of the anode and the surface of the workpiece in the area of such contact are substantially parallel. The interval between the workpiece and the electrode surface may usually be taken up or established by an essentially dielectric separating material through which discrete current-conducting entities such as metallic ions may migrate under an electric potential, but the area between the anode and the cathodic workpiece may also be essentially open and unrestricted.

(q) "Active surface" when applied to an anode refers to that surface which is electrically coupled with an adjacent surface or workpiece or is intended to be the surface through which electrical coupling is effected.

(r) "Electrolyzed" and "electrolyzed lead base" composition means a lead based or lead tin base material preliminarily treated by an electrolysis treatment comprising passing an electric current through the electrode while submerged in the electrolyte that is to be used as an electrolytic coating bath to form a coating on the surface, such electrolyzation being effected prior to use as a coating electrode.

(s) "Effectively attached" means that two bodies or structures are secured in position adjacent to each other either by attachment means or entities joining the two or via other positioning and securing means that effectively secure the two structures into operative position closely adjacent to each other.

(t) "Movement in a continuous mode" means that the relative position of two oppositely charged electrodes is continuously changing, but retained within certain predetermined limits.

(u) "Anode wrap" means an "absorbent material" and "brush material" taken together with the absorbent material separated from the brush material by a backing having perforations for passage of electrolytic coating solution.

(v) "Full anode coverage" means that a coating anode, portion of a coating anode or a series of coating anodes are in substantially full apposition with a cathodic surface to be coated at all times. Thus, the cathodic coating surface is maintained at all times adjacent an opposing anode. All anode surfaces are not necessarily adjacent or in apposition with a cathodic coating surface, however.

Several embodiments of the invention have been shown and described. However, it will be understood that the invention may be also practiced with other embodiments. It will also be understood that the invention as described is a brush coating or selective coating apparatus and method or a modified brush or selective coating apparatus and method and has successfully produced hard chromium coatings and will produce such hard chromium coatings if practiced in accordance with the instructions given, even though such hard chromium coatings have not been obtainable by brush coating or modified brush coating before.

While the present invention has been described at some length and with some particularity with respect to several described embodiments, it is not intended that it should be limited to any such particulars or embodiments or any particular embodiment, but is to be construed broadly with reference to the appended claims so as to provide the broadest possible interpretation of such claims in view of the prior art and therefore to effectively encompass the intended scope of the invention.

We claim:

1. An improved apparatus for selective electrolytic plating of a hard chromium coating upon a cathodic workpiece comprising:

(a) a dielectric electrode support means, (b) a lead based anodic electrode arranged and constructed for support by said dielectric support means closely spaced to a predetermined surface of a cathodic workpiece to be plated and effecting at all times during electroplating substantially full anode coverage of the area of the surface of the cathodic workpiece to be plated, (c) an anode wrap material positioned upon the active surface of the anodic electrode in opposition to and contigous with the cathodic workpiece, (d) conduit means for delivering a chromic acid containing electrolytic solution to the anode wrap material, (e) means to facilitate substantially continuous relative movement of the anodic electrode with respect to the contiguous surface of the cathodic workpiece with the anode wrap material against such surface to be coated, and (f) means arranged and adapted to allow continuous feed and replacement of electrolytic solution in the anode wrap material.

2. An improved apparatus in accordance with claim 1 additionally comprising:

(g) an electrolyte supply means for dispensing heated coating electrolyte to the anode wrap material upon the lead base anodic electrode via the conduit means, and (h) pump and conduit means to move electrolyte from the electrolyte supply means to a porous plastic material forming at least a portion of the anode wrap material and conduit means to move the electrolyte in a continuous circuit from the electrode chamber means to the electrolyte supply means.

3. An improved apparatus in accordance with claim 2 wherein the electrode comprises a lead-tin alloy and the anode wrap material is comprised of:

(i) a porous felt-like polymeric resin material substantially resistant to deterioration by chromic acid positioned adjacent and effectively attached to the active surface of said lead-based electrode, and (j) an abrasion resistant polymeric resin brush-like material substantially resistant to chromic acid positioned atop and effectively attached to the porous felt-like polymeric resin material in a position for contact with the surface of the workpiece to be coated during a coating operation, (k) said brush-like material having plastic bristles spaced at distances adapted to form a workpieces contacting structure having sufficient space between the bristles so as to present no substantial barrier to free movement of undepleted electrolytic solution to the workpiece coating surface to replace a solution from which plating has already taken place or to impede free movement of hydrogen bubbles or dendritic material displaced by said bristles from said surface workpiece away from said surface or to impede release of said hydrogen bubbles or dendritic material from within said plastic bristles.

4. An improved apparatus in accordance with claim 3 where the active surface of the lead-based electrode is a pre-electrolyzed surface.

5. An improved apparatus in accordance with claim 2 wherein the anode wrap material is comprised of:

(i) a porous felt-like polymeric resin material substantially resistant to deterioration by chromic acid positioned adjacent and effectively attached to the active surface of said lead-based electrode means, and (j) an at least somewhat abrasion resistant interconnected continuous fibrous polymeric resin material substantially resistant to chromic acid positioned atop and effectively secured to the porous felt-like resin material in a position for contact with the surface of the workpiece to be coated during a coating operation, (k) said fibrous polymeric resin material having its component fibers spaced at distances adapted to form a wiper construction having sufficient space between the fibers to present no substantial barrier to free movement of undepleted electrolytic solution to the workpiece surface to replace solution from which plating has already taken place or to impede free movement of hydrogen bubbles or dendrites displaced by said fibers from said workpiece surface away from said surface or to impede release of said hydrogen bubbles or dendritic material from within said plastic polymeric fibers.

6. An improved apparatus in accordance with claim 2 wherein the lead-based electrode is arranged and constructed for movement in a continuous mode or manner over all portions of the surface to be plated at all times.

7. An improved apparatus in accordance with claim 6 wherein the lead-based electrode substantially surrounds an elongated workpiece which is suitably journaled for rotary movement within a dielectric electrode chamber means.

8. An improved apparatus in accordance with claim 7 wherein the edges of the dielectric electrode chamber means are in sealing relationship with the surface of the workpiece which is to be coated with chromium and an alternate drainage means is provided.

9. An improved apparatus in accordance with claim 6 wherein the lead-based electrode is made in two adjoining halves and has a ridged and valleyed surface adapted to provide an anode-to-cathode surface ratio of at least about 1.5 to 1.

10. An improved apparatus in accordance with claim 6 wherein the lead-based electrode is formed with other than a circumferential active surface and such surface is arranged and constructed such that it has at least an anode-to-cathode surface ratio of at least about 1.5 to 1.

11. An improved apparatus in accordance with claim 10 wherein a rectifier having a ripple factor no greater than 5% is connected to the lead-based anode.

12. A method of selective plating of a hard chromium coating upon a conductive base material comprising:

(a) substantially completely encompassing a portion of the surface of a metal workpiece to be electrolytically coated with a lead base anode, (b) adjusting the distance between the surface of the lead-base anode and the surface of the metal workpiece to be coated to be within a range of one eighth of an inch to one inch, (c) establishing an electrical circuit from a source of direct current between the workpiece acting as a cathode and the lead base anode, (d) contacting the surface of the metal workpiece to be electrolytically coated with a polymeric wiping means having a relatively open construction arranged and constructed to contact the surface of the metal workpiece simultaneously with coating and dislodge bubbles of hydrogen plus dendritic material from said surface and allow said bubbles and dendritic material to be discharged into the coating bath, (e) establishing continuous movement between the anode plus the adjacent polymeric material as a whole and the surface of the workpiece to be coated while maintaining at least a portion of the anode surface adjacent at all times to each portion of the surface of the workpiece to be coated, and (f) continuously maintaining undepleted coating electrolyte between the anode and metal workpiece to maintain fresh solution constantly available at all plating areas between said anode and the metal workpiece.

13. A method in accordance with claim 12 wherein the polymeric wiping means which contacts the relatively moving metal workpiece has the form of a bristle-type brush surface having an open construction that will allow ready passage through and from said bristle structure of hydrogen bubbles and severed dendritic coating material.

14. A method in accordance with claim 13 wherein the polymeric wiping means which contact the surface of the relatively moving metal workpiece takes the form of an open weave polymeric material that will allow ready passage through and from said open weave structure of hydrogen bubbles and severed dendritic coating material.

15. A method in accordance with claim 12 additionally comprising circulating the undepleted coating electrolyte in a continuous circuit between a supply and the coating areas of the metal workpiece at a rate sufficiently rapid to prevent any substantial depletion of a desired concentration of chromium in the electrolyte as plating of chromium proceeds.

16. An improved apparatus for selective electrolytic plating of a hard chrome coating upon a cathodic workpiece comprising:

(a) a dielectric outer shell and support means, (b) an anode within said dielectric outer shell, (c) means for supporting a cathodic workpiece adjacent said anode with surfaces to be coated within one eighth inch to one inch of each other, (d) said anode being arranged and constructed to completely cover the cathodic surface to be chrome coated at all times, (e) a cathodic surface wiping means having a relatively open construction that does not tend to impede either the discharge from said wiper of hydrogen bubbles or dendritic coating material wiped from the surface of the cathodic workpiece positioned to bear against the surface of said cathodic workpiece, and (e) means to relatively move the cathodic workpiece surface with respect to the anode and the wiping means.

17. An improved apparatus for selective plating of a hard chromium coating upon a cathodic workpiece in accordance with claim 16 wherein the open construction cathodic surface wiping means is comprised of continuous interconnected polymeric fibrous material.

18. An improved apparatus for selective electrolytic coating in accordance with claim 17 wherein the wiping means is comprised of an open construction fibrous polymeric scraping material having relatively widely spaced individual fibers.

19. An improved apparatus for selective electrolytic coating in accordance with claim 18 wherein the wiping means is comprised of an open weave fibrous woven material.

20. An improved apparatus for selective electrolytic coating in accordance with claim 18 wherein the wiping means is comprised of an open construction knitted material.

21. An improved apparatus for selective electrolytic coating in accordance with claim 18 wherein the wiping means is comprised of an open construction braided material.

22. An improved apparatus for selective plating of a hard chromium coating upon a cathodic workpiece in accordance with claim 16 wherein the open construction cathodic surface wiping material is comprised of discontinuous end connected polymeric fibrous material.

23. An improved apparatus for selective electrolytic coating in accordance with claim 22 wherein the wiping means is comprised of a polymeric brush-type wiper having relatively widely spaced bristles.

24. An improved apparatus for selective electrolytic coating in accordance with claim 16 wherein the wiping means is comprised of a solid polymeric wiping blade.

25. An improved apparatus for selective electrolytic coating in accordance with claim 24 wherein the solid polymeric wiping blade extends substantially across the entire cathodic surface.

26. An improved apparatus for selective electrolytic coating in accordance with claim 24 wherein there are a plurality of solid polymeric wiping blades extending at least partially across the cathodic surface.

* * * * *